US012631374B2

(12) United States Patent
Hirokawa et al.

(10) Patent No.: US 12,631,374 B2
(45) Date of Patent: May 19, 2026

(54) HEAT EXCHANGER AND HEAT PUMP DEVICE

(71) Applicant: DAIKIN INDUSTRIES, LTD., Osaka (JP)

(72) Inventors: Tomoki Hirokawa, Osaka (JP); Kouju Yamada, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/418,669

(22) Filed: Jan. 22, 2024

(65) Prior Publication Data

US 2024/0159434 A1 May 16, 2024

Related U.S. Application Data

(60) Division of application No. 17/562,338, filed on Dec. 27, 2021, now Pat. No. 11,913,689, which is a (Continued)

(30) Foreign Application Priority Data

Jun. 28, 2019 (JP) ..... 2019-122167

(51) Int. Cl.
*F28F 9/02* (2006.01)
*F25B 39/00* (2006.01)
*F28F 9/22* (2006.01)

(52) U.S. Cl.
CPC ..... *F25B 39/00* (2013.01); *F28F 9/0202* (2013.01); *F28F 9/22* (2013.01); *F28F 9/0221* (2013.01);
(Continued)

(58) Field of Classification Search
CPC ..... F28F 9/22; F28F 9/0202; F28F 9/0285; F28F 9/0221; F28D 2021/0096
See application file for complete search history.

(56) References Cited

U.S. PATENT DOCUMENTS 5,241,839 A 9/1993 Hughes
11,098,927 B2 8/2021 Higashiiue et al.
(Continued)

FOREIGN PATENT DOCUMENTS

EP 3217135 A1 9/2017
EP 3467404 A1 4/2019
(Continued)

OTHER PUBLICATIONS

International Search Report issued in corresponding International Application No. PCT/JP2020/025377 mailed Sep. 15, 2020 (5 pages).
(Continued)

*Primary Examiner* — Paul Alvare
(74) *Attorney, Agent, or Firm* — Osha Bergman Watanabe & Burton LLP

(57) ABSTRACT

A heat exchanger, connected to a refrigerant pipe, includes: heat transfer tubes; and a header that connects the refrigerant pipe and the heat transfer tubes, and that forms a refrigerant flow path between the refrigerant pipe and the heat transfer tubes. The header includes a first member that includes a first plate-shaped portion, and a second member that includes a second plate-shaped portion that is stacked on a heat transfer tubes side of the first plate-shaped portion. The first plate-shaped portion has a first opening that forms the refrigerant flow path. The second plate-shaped portion has a second opening that forms the refrigerant flow path. When viewed in a stacking direction of the first plate-shaped portion and the second plate-shaped portion, the second opening and the first opening overlap each other at a first region and at a second region that is different from the first region.

5 Claims, 45 Drawing Sheets

Related U.S. Application Data continuation of application No. PCT/JP2020/025377, filed on Jun. 26, 2020.

(52) U.S. Cl.
CPC ..... *F28F 9/0246* (2013.01); *F28F 2009/0285* (2013.01)

(56) References Cited

U.S. PATENT DOCUMENTS

| | | | |
|---|---|---|---|
| 2015/0300758 | A1 | 10/2015 | Hofmann et al. |
| 2016/0076823 | A1 | 3/2016 | Okazaki et al. |
| 2016/0076824 | A1 | 3/2016 | Matsuda et al. |
| 2016/0076825 | A1 | 3/2016 | Matsuda et al. |
| 2016/0169595 | A1 | 6/2016 | Matsuda et al. |
| 2016/0195335 | A1 | 7/2016 | Nishiyama et al. |
| 2016/0202000 | A1 | 7/2016 | Higashiiue et al. |
| 2017/0328652 | A1 | 11/2017 | Matsui et al. |
| 2020/0018528 | A1 | 1/2020 | Akaiwa et al. |

FOREIGN PATENT DOCUMENTS

| | | | | |
|---|---|---|---|---|
| EP | 3499169 | A1 | 6/2019 | |
| JP | 2018-162965 | A | 10/2018 | |
| JP | 6481793 | B1 | 3/2019 | |
| WO | 2009/105454 | A2 | 8/2009 | |
| WO | 2015/004719 | A1 | 1/2015 | |
| WO | 2018/078746 | A1 | 5/2018 | |
| WO | 2018/116413 | A1 | 6/2018 | |
| WO | WO-2019073610 | A1 * | 4/2019 | ..... F25B 39/00 |

OTHER PUBLICATIONS

Decision to Grant a Patent issued in Japanese Patent Application No. 2019-122167 mailed Jul. 13, 2021 (5 pages).
Notice of Reasons for Refusal issued in Japanese Patent Application No. 2019-122167 mailed Apr. 6, 2021 (6 pages).
International Preliminary Report on Patentability issued in corresponding International Application No. PCT/JP2020/025377 mailed Jan. 6, 2022 (7 pages).
Extended European Search Report issued in corresponding European Application No. 20832568.8, mailed on Jun. 28, 2022 (7 pages).

* cited by examiner

HEAT EXCHANGER AND HEAT PUMP DEVICE

CROSS-REFERENCE TO RELATED APPLICATIONS

This is a divisional application of U.S. patent application Ser. No. 17/562,338, filed on Dec. 27, 2021, which is continuation application of International Patent Application No. PCT/JP2020/025377, filed on Jun. 26, 2020, and claims priority to Japanese Patent Application No. 2019-122167, filed on Jun. 28, 2019. The content of these priority applications are incorporated herein by reference.

TECHNICAL FIELD

The present disclosure relates to a heat exchanger and a heat pump device.

BACKGROUND

Hitherto, a refrigerant cycle device of, for example, an air conditioner has used a heat exchanger constituted by connecting a heat transfer tube in which a refrigerant flows to a header.

For example, a heat exchanger described in Patent Literature 1 (International Publication No. 2015/004719) uses a header constituted by stacking a plurality of plate-shaped members having openings.

PATENT LITERATURE

PTL 1: International Publication No. 2015/004719

SUMMARY

A heat exchanger according to one or more embodiments is a heat exchanger to which a refrigerant pipe is connected and that includes a plurality of heat transfer tubes and a header. The refrigerant pipe and the plurality of heat transfer tubes are connected to the header. The header forms a refrigerant flow path between the refrigerant pipe and the heat transfer tubes. The header includes a first member and a second member. The first member includes a first plate-shaped portion. The first plate-shaped portion has one or a plurality of first openings that form the refrigerant flow path. The second member includes a second plate-shaped portion that is stacked on a heat transfer tubes side relative to the first plate-shaped portion. The first plate-shaped portion has one or a plurality of first openings that form the refrigerant flow path. The second plate-shaped portion has one or a plurality of second openings that form the refrigerant flow path. When viewed in a stacking direction of the first plate-shaped portion and the second plate-shaped portion, the second opening and the first opening overlap each other at a first region and at a second region that is located at a position different from a position of the first region. A refrigerant flows to the first plate-shaped portion from the second plate-shaped portion at the first region, the refrigerant flows to the second region from the first region at the first opening, and the refrigerant flows to the second plate-shaped portion from the first plate-shaped portion at the second region, or a refrigerant flows to the first plate-shaped portion from the second plate-shaped portion at the second region, the refrigerant flows to the first region from the second region at the first opening, and the refrigerant flows to the second plate-shaped portion from the first plate-shaped portion at the first region. The first opening of the first plate-shaped portion includes a third region that overlaps a connection portion between the refrigerant pipe and the header when viewed in the stacking direction. The third region, the first region, and the second region are disposed side by side in a direction in which the plurality of heat transfer tubes are disposed side by side. A longitudinal direction of the header is a direction that is tilted in a range of ±45 degrees with respect to a horizontal direction or a horizontal plane. The first opening of the first plate-shaped portion includes a connection region between the first region and the third region, a width of the connection region in a direction perpendicular to both the direction in which the plurality of heat transfer tubes are disposed side by side and the stacking direction being smaller than the third region.

DETAILED DESCRIPTION

Embodiments of an air conditioner using a heat exchanger of the present disclosure are described below.

(1) Structure of Air Conditioner

An air conditioner 1 according to one or more embodiments is described with reference to the drawings.

Figure 1:
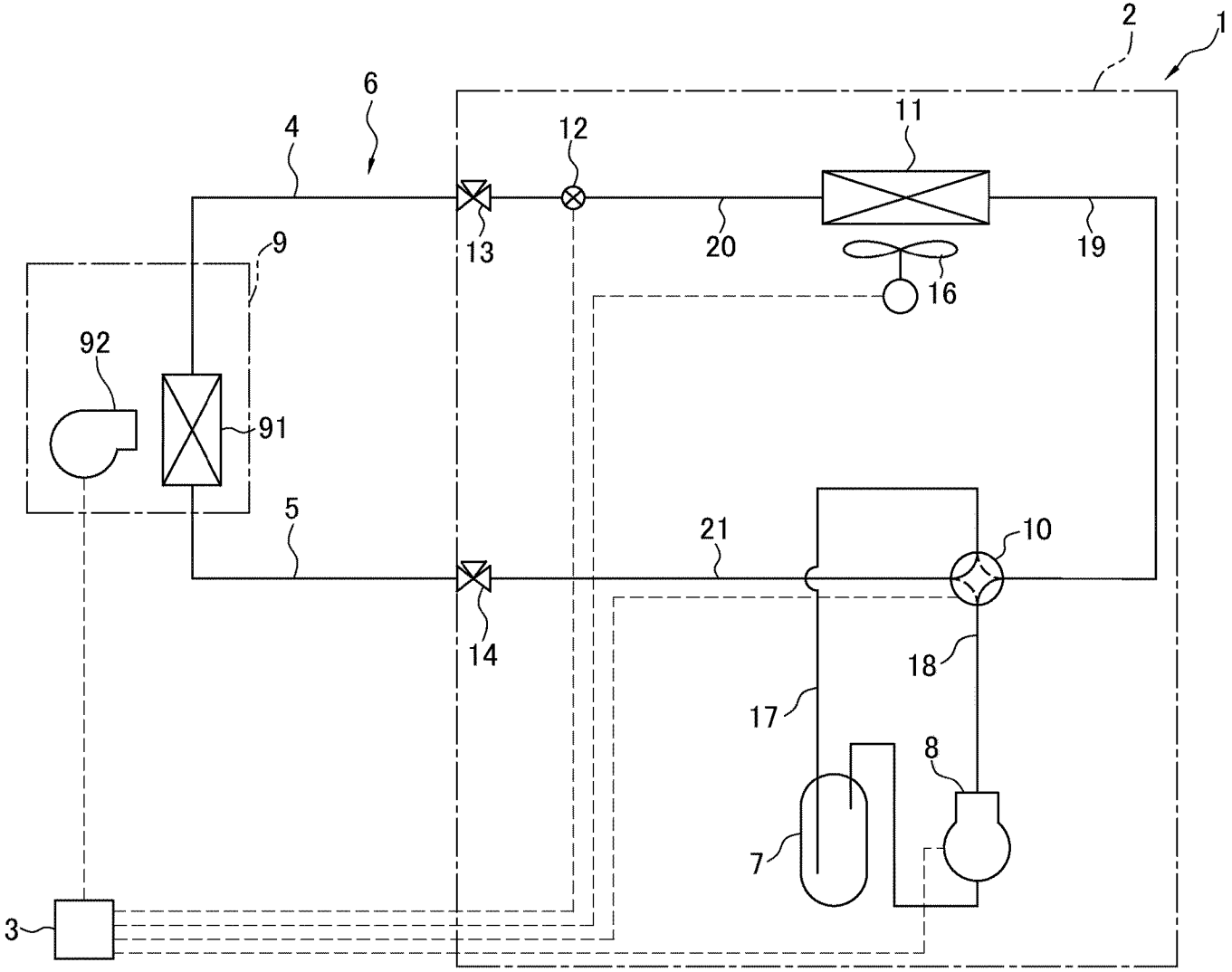
FIG. 1 is a schematic structural view of an air conditioner using a heat exchanger according to one or more embodiments.

FIG. 1 is a schematic structural view of the air conditioner 1 including a heat exchanger according to one or more embodiments of the present disclosure as an outdoor heat exchanger 11.

The air conditioner 1 (an example of a heat pump device) is a device that cools and heats a space to be air-conditioned by performing a vapor-compression refrigeration cycle. The space to be air-conditioned is, for example, a space in buildings, such as office buildings, commercial facilities, or residences. Note that the air conditioner is merely one example of a refrigerant cycle device, and the heat exchanger of the present disclosure may be used in other refrigerant cycle devices, such as a refrigerator, a freezer, a water heater, or a floor heating device.

As shown in FIG. 1, the air conditioner 1 primarily includes an outdoor unit 2, an indoor unit 9, a liquid-refrigerant connection pipe 4 and a gas-refrigerant connection pipe 5, and a control unit 3 that controls structural devices of the outdoor unit 2 and the indoor unit 9. The liquid-refrigerant connection pipe 4 and the gas-refrigerant connection pipe 5 are refrigerant connection pipes that connect the outdoor unit 2 and the indoor unit 9 to each other. In the air conditioner 1, the outdoor unit 2 and the indoor unit 9 are connected to each other via the liquid-refrigerant connection pipe 4 and the gas-refrigerant connection pipe 5 to constitute a refrigerant circuit 6.

Note that, although in FIG. 1, the air conditioner 1 includes one indoor unit 9, the air conditioner 1 may include a plurality of indoor units 9 that are connected in parallel with respect to the outdoor unit 2 by the liquid-refrigerant connection pipe 4 and the gas-refrigerant connection pipe 5. The air conditioner 1 may also include a plurality of outdoor units 2. The air conditioner 1 may be an integrated air conditioner in which the outdoor unit 2 and the indoor unit 9 are integrated with each other.

(1-1) Outdoor Unit

The outdoor unit 2 is installed outside a space to be air-conditioned, such as on the roof of a building or near a wall surface of a building.

The outdoor unit 2 primarily includes an accumulator 7, a compressor 8, a four-way switching valve 10, the outdoor heat exchanger 11, an expansion mechanism 12, a liquid-side shutoff valve 13 and a gas-side shutoff valve 14, and an outdoor fan 16 (see FIG. 1).

The outdoor unit 2 primarily includes, as refrigerant pipes that connect various devices constituting the refrigerant circuit 6, a suction pipe 17, a discharge pipe 18, a first gas-refrigerant pipe 19, a liquid-refrigerant pipe 20, and a second gas-refrigerant pipe 21 (see FIG. 1). The suction pipe 17 connects the four-way switching valve 10 and a suction side of the compressor 8 to each other. The accumulator 7 is provided at the suction pipe 17. The discharge pipe 18 connects a discharge side of the compressor 8 and the four-way switching valve 10 to each other. The first gas-refrigerant pipe 19 connects the four-way switching valve 10 and a gas side of the outdoor heat exchanger 11 to each other. The liquid-refrigerant pipe 20 connects a liquid side of the outdoor heat exchanger 11 and the liquid-side shutoff valve 13 to each other. The expansion mechanism 12 is provided at the liquid-refrigerant pipe 20. The second gas-refrigerant pipe 21 connects the four-way switching valve 10 and the gas-side shutoff valve 14 to each other.

The compressor 8 is a device that sucks in a refrigerant having a low pressure in a refrigeration cycle from the suction pipe 17, compresses the refrigerant at a compression mechanism (not shown), and discharges the compressed refrigerant to the discharge pipe 18.

The four-way switching valve 10 is a mechanism that, by switching a direction of flow of a refrigerant, changes the state of the refrigerant circuit 6 between a cooling operation state and a heating operation state. When the refrigerant circuit 6 is in the cooling operation state, the outdoor heat exchanger 11 functions as a heat dissipater (condenser) of a refrigerant and the indoor heat exchanger 91 functions as an evaporator of a refrigerant. When the refrigerant circuit 6 is in the heating operation state, the outdoor heat exchanger 11 functions as an evaporator of a refrigerant and the indoor heat exchanger 91 functions as a condenser of a refrigerant. When the four-way switching valve 10 changes the state of the refrigerant circuit 6 to the cooling operation state, the four-way switching valve 10 causes the suction pipe 17 to communicate with the second gas-refrigerant pipe 21, and causes the discharge pipe 18 to communicate with the first gas-refrigerant pipe 19 (see solid line in the four-way switching valve 10 in FIG. 1). When the four-way switching valve 10 changes the state of the refrigerant circuit 6 to the heating operation state, the four-way switching valve 10 causes the suction pipe 17 to communicate with the first gas-refrigerant pipe 19, and causes the discharge pipe 18 to communicate with the second gas-refrigerant pipe 21 (see broken line in the four-way switching valve 10 in FIG. 1).

The outdoor heat exchanger 11 (an example of a heat exchanger) is a device that causes a refrigerant that flows therein and air existing at a place of installation of the outdoor unit 2 (heat source air) to exchange heat with each other. The outdoor heat exchanger 11 is described in detail below.

The expansion mechanism 12 is disposed between the outdoor heat exchanger 11 and the indoor heat exchanger 91 in the refrigerant circuit 6. In one or more embodiments, the expansion mechanism 12 is disposed at the liquid-refrigerant pipe 20 between the outdoor heat exchanger 11 and the liquid-side shutoff valve 13.

The accumulator 7 may be a container having a gas-liquid dividing function of dividing a refrigerant that flows in into a gas refrigerant and a liquid refrigerant. The accumulator 7 is also a container having the function of storing excess refrigerant occurring in accordance with, for example, variations in an operation load.

The liquid-side shutoff valve 13 is a valve that is provided at a connection portion between the liquid-refrigerant pipe 20 and the liquid-refrigerant connection pipe 4. The gas-side shutoff valve 14 is a valve that is provided at a connection portion between the second gas-refrigerant pipe 21 and the gas-refrigerant connection pipe 5. The liquid-side shutoff valve 13 and the gas-side shutoff valve 14 are open when the air conditioner 1 operates.

The outdoor fan 16 is a fan for sucking in external heat source air into a casing of the outdoor unit 2 (not shown), supplying the air to the outdoor heat exchanger 11, and discharging the air that has exchanged heat with a refrigerant in the outdoor heat exchanger 11 to the outside of the casing of the outdoor unit 2.

(1-2) Indoor Unit

The indoor unit 9 is a unit that is installed in a space to be air-conditioned. Although the indoor unit 9 is, for example, a ceiling-embedded unit, the indoor unit 9 may be a ceiling-suspension unit, a wall-mounted unit, or a floor unit. The indoor unit 9 may be installed outside a space to be air-conditioned. For example, the indoor unit 9 may be installed in an attic, a machine chamber, or a garage.

The indoor unit 9 primarily includes the indoor heat exchanger 91 and an indoor fan 92 (see FIG. 1).

In the indoor heat exchanger 91, a refrigerant that flows in the indoor heat exchanger 91 and air in a space to be air-conditioned exchange heat with each other.

One end of the indoor heat exchanger 91 is connected to the liquid-refrigerant connection pipe 4 via a refrigerant pipe. The other end of the indoor heat exchanger 91 is connected to the gas-refrigerant connection pipe 5 via a refrigerant pipe.

The indoor fan 92 is a mechanism that sucks in air in a space to be air-conditioned into a casing (not shown) of the indoor unit 9, supplies the air to the indoor heat exchanger 91, and blows out the air that has exchanged heat with a refrigerant in the indoor heat exchanger 91 to the space to be air-conditioned.

(1-3) Control Unit

The control unit 3 is a functional part that controls the operations of various devices that form the air conditioner 1.

The control unit 3 is constituted by, for example, connecting an outdoor control unit (not shown) of the outdoor unit 2 and an indoor control unit (not shown) of the indoor unit 9 via a transmission line (not shown) to allow communication. The outdoor control unit and the indoor control unit are, for example, a microcomputer or a unit including, for example, a memory that stores various programs for controlling the air conditioner 1, which are executable by the microcomputer. Note that, for convenience sake, FIG. 1 illustrates the control unit 3 at a position located away from the outdoor unit 2 and the indoor unit 9.

Note that the function of the control unit 3 does not need to be realized by cooperation between the outdoor control unit and the indoor control unit. For example, the functions of the control unit 3 may be realized by either one of the outdoor control unit and the indoor control unit, or some or all of the functions of the control unit 3 may be realized by a control device (not shown) that differs from the outdoor control unit and the indoor control unit.

As shown in FIG. 1, the control unit 3 electrically connects various devices of the outdoor unit 2 and the indoor unit 9, including the compressor 8, the four-way switching valve 10, the expansion mechanism 12, the outdoor fan 16, and the indoor fan 92. The control unit 3 is also electrically connected to various sensors (not shown) that are provided at the outdoor unit 2 and the indoor unit 9. The control unit 3 is constituted to allow communication with a remote controller (not shown) that is operated by a user of the air conditioner 1.

The control unit 3 controls the operation and stopping of the air conditioner 1 or the operations of the various devices that constitute the air conditioner 1, based on, for example, a measurement signal of each of the various sensors or an instruction that is received from a remote controller (not shown).

(2) Structure of Outdoor Heat Exchanger

A structure of the outdoor heat exchanger 11 is described with reference to the drawings.

Figure 2:
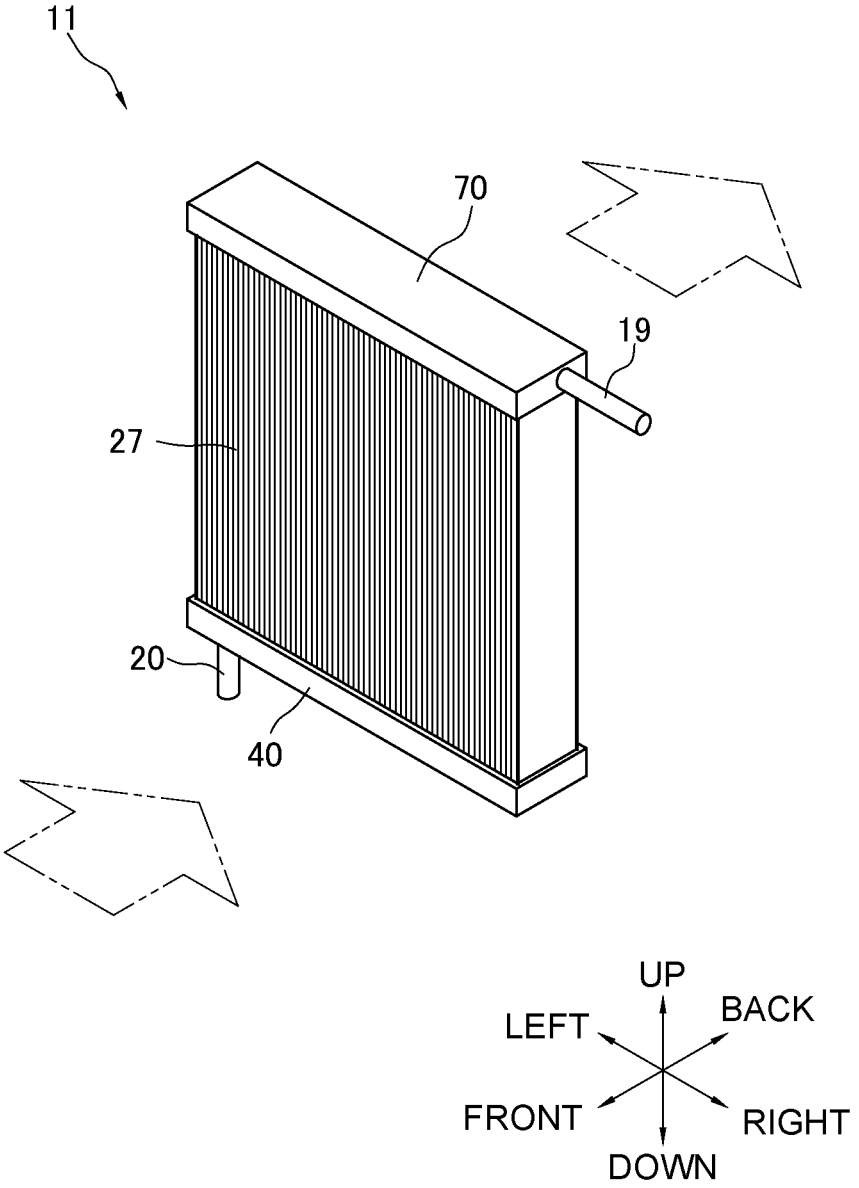
FIG. 2 is an external perspective view of an outdoor heat exchanger according to one or more embodiments.
Figure 3:
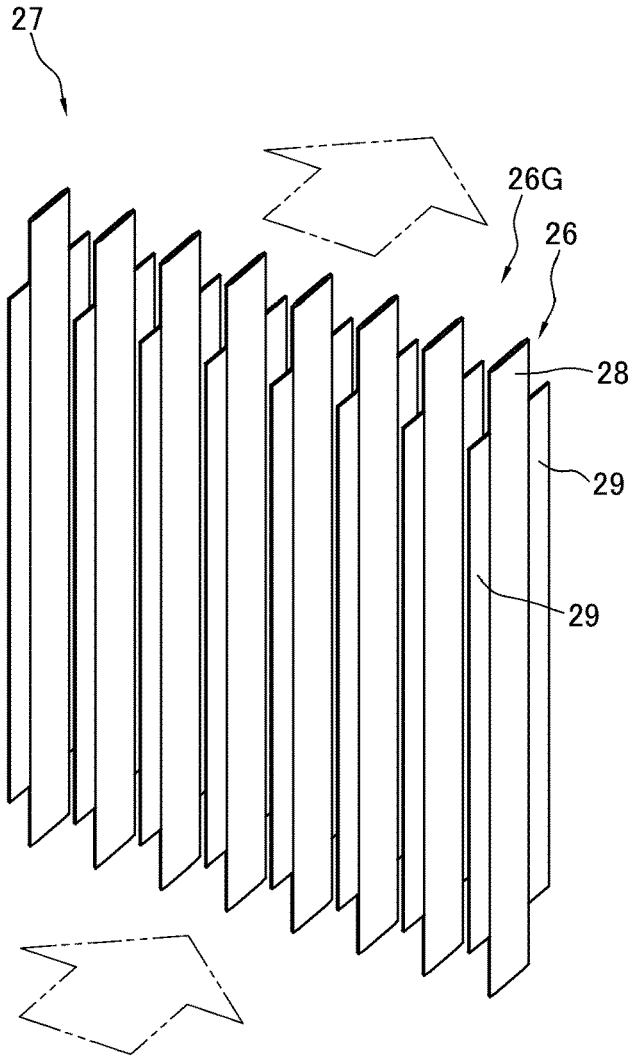
FIG. 3 is an external perspective view of a heat transfer portion according to one or more embodiments.
Figure 4:
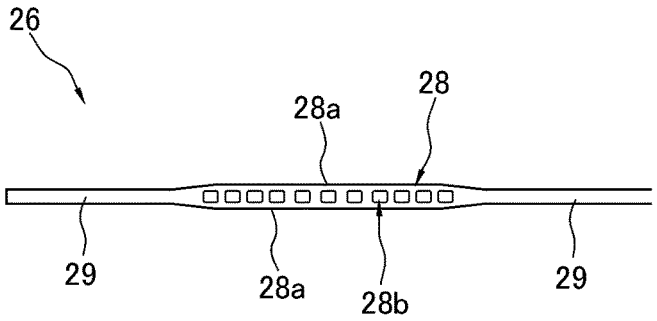
FIG. 4 is a sectional view of a flow path of the heat transfer portion according to one or more embodiments.
Figure 5:
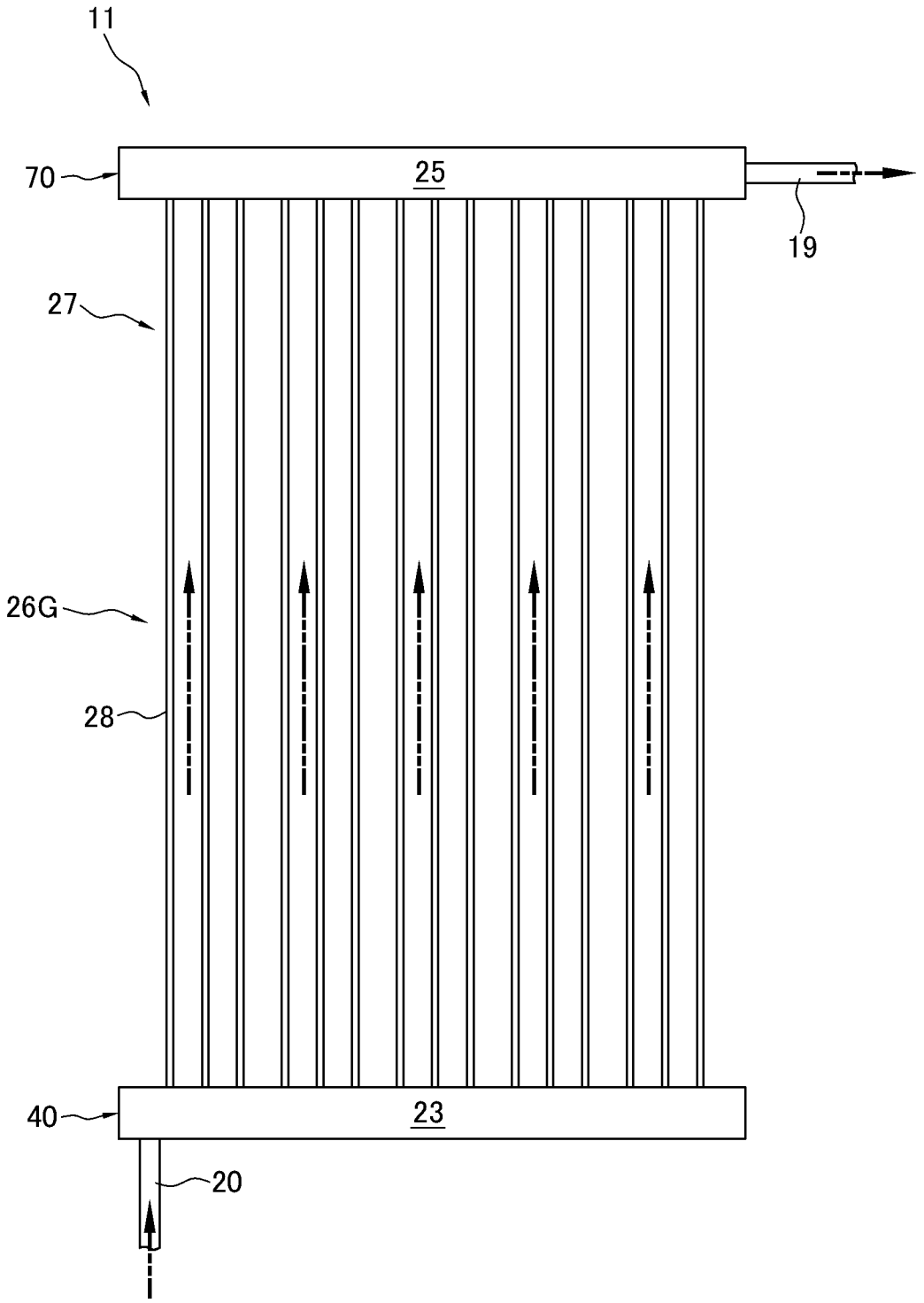
FIG. 5 is an explanatory view illustrating flow of a refrigerant in the outdoor heat exchanger serving as an evaporator according to one or more embodiments.

FIG. 2 is a schematic perspective view of the outdoor heat exchanger 11. FIG. 3 is an external perspective view of a heat transfer portion 26 of the outdoor heat exchanger 11. FIG. 4 is a sectional view of a flow path of the heat transfer portion 26. FIG. 5 is an explanatory view illustrating flow of a refrigerant when the outdoor heat exchanger 11 functions as an evaporator of a refrigerant. The arrows shown in FIG. 5 indicate flow of a refrigerant at the time of a heating operation (when the outdoor heat exchanger 11 functions as an evaporator).

Note that, in the description below, for describing an orientation and a position, terms, such as "up", "down", "left", "right", "front (front side)", or "back (back side)" may be used. Unless otherwise specified, these terms are in conformity with the directions of the arrows shown in FIG. 2. Note that these terms that indicate these directions and positions are used for convenience of explanation, and, unless otherwise specified, the orientation and the position of the entire outdoor heat exchanger 11 and the orientation and the position of each structure of the outdoor heat exchanger 11 are not to be determined by the orientations and the positions indicated by these terms.

The outdoor heat exchanger 11 is a device that causes heat to be exchanged between a refrigerant that flows therein and air.

The outdoor heat exchanger 11 primarily includes a heat-transfer-portion group 26G including a plurality of heat transfer portions 26, a liquid header 40 (an example of a header), and a gas header 70 (see FIGS. 3 and 4).

As shown in FIGS. 3 and 4, the heat transfer portions 26 are made of the same material, and each include a flat tube 28 and fins 29 that are continuously formed. The heat transfer portions 26 that are oriented with a thickness direction being orthogonal to an air flow direction (see arrows in FIGS. 3 and 4) are disposed side by side in the thickness direction.

In one or more embodiments, the heat transfer portions 26, the liquid header 40, and the gas header 70 are all made of aluminum or an aluminum alloy.

As described below, the plurality of heat transfer portions 26 form a heat transfer portion 27 (see FIGS. 2 and 3). The outdoor heat exchanger 11 is a device including the one-column heat exchange portion 27, and is not a device in which the plurality of heat transfer portions 26 are disposed side by side in the air flow direction and in which the plurality of flat tubes 28 are disposed side by side in the air flow direction. In the outdoor heat exchanger 11, by allowing air to flow in a ventilation path that is formed between the heat transfer portions 26 of the heat exchange portion 27, a refrigerant that flows in the flat tubes 28 exchanges heat with the air that flows in the ventilation path.

(2-1) Flat Tubes 28

Each flat tube 28 constitutes a central portion of a corresponding one of the heat transfer portions 26 in the air flow direction, and is a flat heat transfer tube having flat surfaces 28*a* on the left and right, the flat surfaces 28*a* being heat transfer surfaces, as shown in FIG. 4. As shown in FIG. 3, the flat tubes 28 have a plurality of refrigerant passages 28*b* in which a refrigerant flows. For example, the flat tubes 28 are flat multi-hole tubes where many refrigerant passages 28*b* in which a refrigerant flows and whose passage cross-sectional area is small are formed. In one or more embodiments, the plurality of refrigerant passages 28*b* are provided side by side in the air flow direction.

In the outdoor heat exchanger 11, the flat tubes 28 extending in an up-down direction between the liquid header 40 and the gas header 70 are disposed side by side in a left-right direction in a plurality of layers. Note that, in one or more embodiments, the flat tubes 28 extending between the liquid header 40 and the gas header 70 extend in a straight line. In one or more embodiments, the plurality of flat tubes 28 are disposed apart from each other by a certain interval in the left-right direction.

(2-2) Fins

The fins 29 are fins for increasing the heat transfer area of the outdoor heat exchanger 11, and, in one or more embodiments, are constituted as portions of a corresponding one of the heat transfer portions 26 other than a corresponding one of the flat tubes 28. Each fin 29 extends from a corresponding one of an upstream-side end portion and a downstream-side end portion in the air flow direction of the corresponding flat tube 28, and extends parallel to the flat surfaces 28*a* of the corresponding flat tube 28. Although not limited, the flat tube 28 and the fins 29 constituting each heat transfer portion 26 may be integrally formed by extrusion molding.

(2-3) Gas Header and Liquid Header

The gas header 70 and the liquid header 40 have hollow structures.

As shown in FIG. 5, one end portion of each flat tube 28 is connected to the liquid header 40, and the other end portion of each flat tube 28 is connected to the gas header 70. The outdoor heat exchanger 11 is disposed in the casing (not shown) of the outdoor unit 2 so that longitudinal directions of the liquid header 40 and the gas header 70 are substantially the same as a horizontal direction (an example of a third direction).

(2-3-1) Gas Header

The gas header 70 is a hollow structural body having a gas-side internal space 25 therein. Specifically, the gas header 70 has a substantially rectangular parallelepiped shape formed by surfaces facing respective directions, that is, an upper direction, a lower direction, a left direction, a right direction, a front direction, and a back direction.

Upper ends of the plurality of flat tubes 28 are connected to the gas-side internal space 25. A first gas-refrigerant pipe 19 is connected to the gas-side internal space 25 via an end portion of the gas header 70 in the longitudinal direction thereof (see FIGS. 2 and 5).

Although not shown, the gas header 70 may be constituted by, with its up-down direction being a plate-thickness direction, stacking a plurality of plate-shaped members having through openings in the plate-thickness direction upon each other in the up-down direction.

(2-3-2) Liquid Header

The liquid header 40 is a hollow structural body having a liquid-side internal space 23 therein. Specifically, the liquid header 40 has a substantially rectangular parallelepiped shape formed by surfaces facing respective directions, that is, the upper direction, the lower direction, the left direction, the right direction, the front direction, and the back direction. The longitudinal direction of the liquid header 40 of one or more embodiments is an up-down direction and a vertical direction (an example of a second direction).

Lower ends of the plurality of flat tubes 28 are connected to the liquid-side internal space 23. A liquid-refrigerant pipe 20 is connected to the liquid-side internal space 23 via a portion of a lower surface of the liquid header 40 near an end portion thereof in the longitudinal direction (see FIGS. 2 and 5).

(3) Flow of Refrigerant in Outdoor Heat Exchanger

When the air conditioner 1 performs a heating operation and thus the outdoor heat exchanger 11 functions as an evaporator of a refrigerant, a refrigerant in a gas-liquid two-phase state that flows in the liquid-refrigerant pipe 20 flows into the liquid-side internal space 23. The refrigerant that has flowed into the liquid-side internal space 23 flows in each of the flat tubes 28 that is connected to the liquid header 40. The refrigerant flowings in the respective flat tubes 28 exchange heat with air and thus evaporate and become gas-phase refrigerant, and flow into the gas-side internal space 25 of the gas header 70 to merge with each other.

When the air conditioner 1 performs a cooling operation or a defrost operation, the refrigerant flows in the refrigerant circuit 6 in a direction opposite to that when the air conditioner 1 performs the heating operation. Specifically, a high-temperature gas-phase refrigerant flows into the gas-side internal space 25 of the gas header 70 via the first gas-refrigerant pipe 19. The refrigerant that has flowed into the gas-side internal space 25 of the gas header 70 is divided and flows into each flat tube 28. The refrigerant that has flowed into the respective flat tubes 28 passes through the respective flat tubes 28, and flows into the liquid-side internal space 23 of the liquid header 40. The refrigerant that has flowed into the liquid-side internal space 23 merges and flows out to the liquid-refrigerant pipe 20.

(4) Details of Liquid Header

Figure 6:
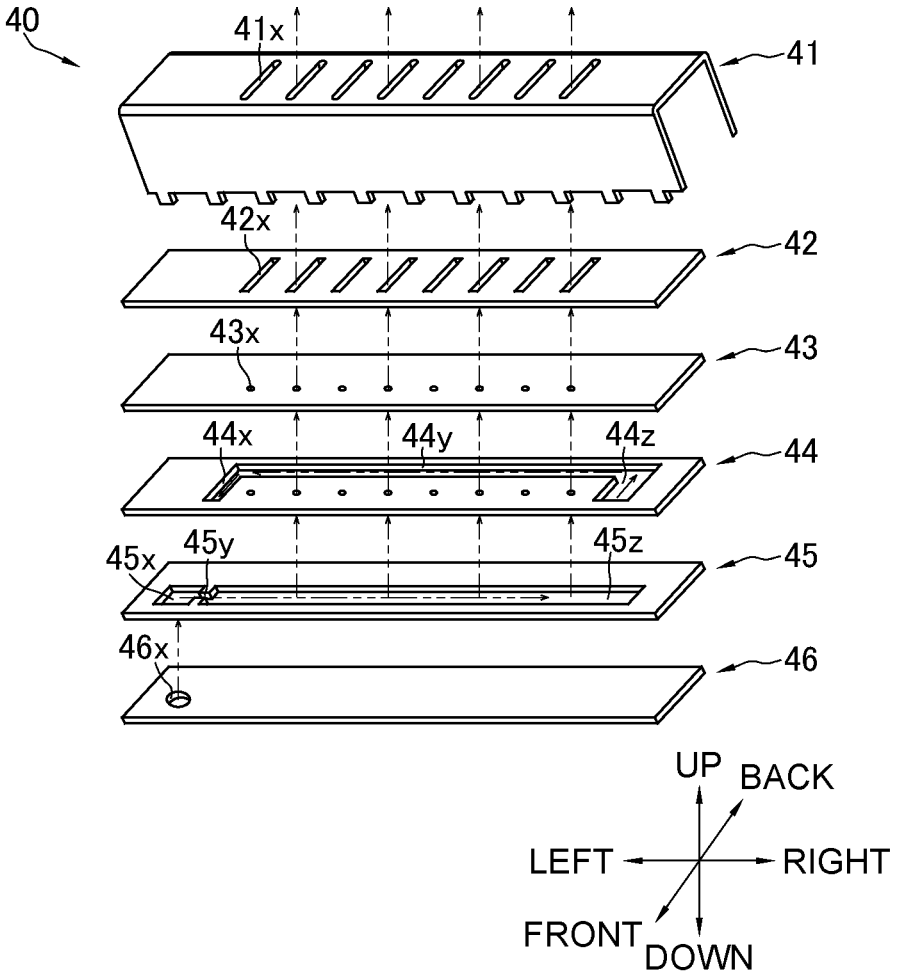
FIG. 6 is an exploded perspective view of a liquid header according to one or more embodiments.
Figure 7:
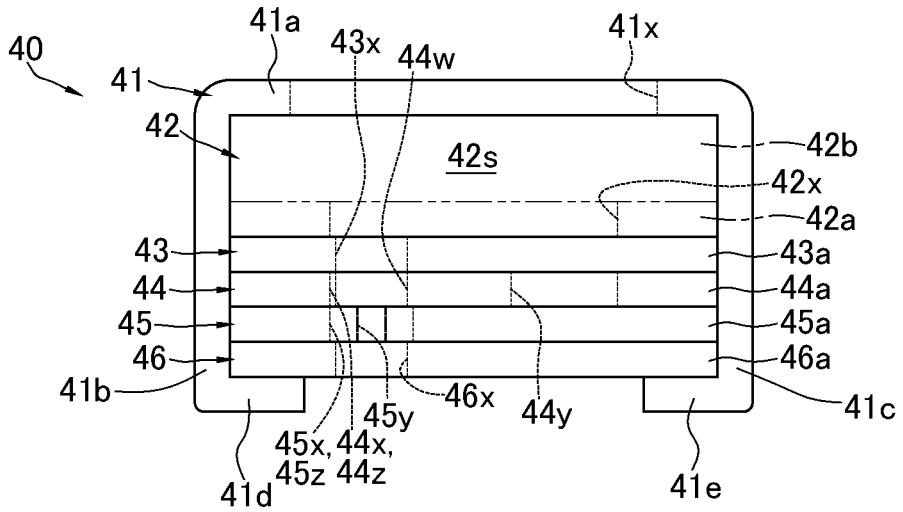
FIG. 7 is a structural view of an arrangement of the liquid header according to one or more embodiments when viewed in a longitudinal direction thereof.
Figure 7:
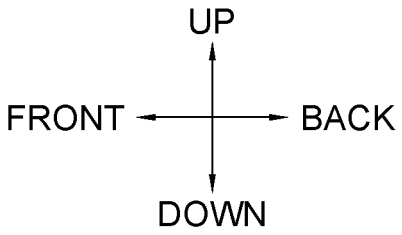
Figure 8:
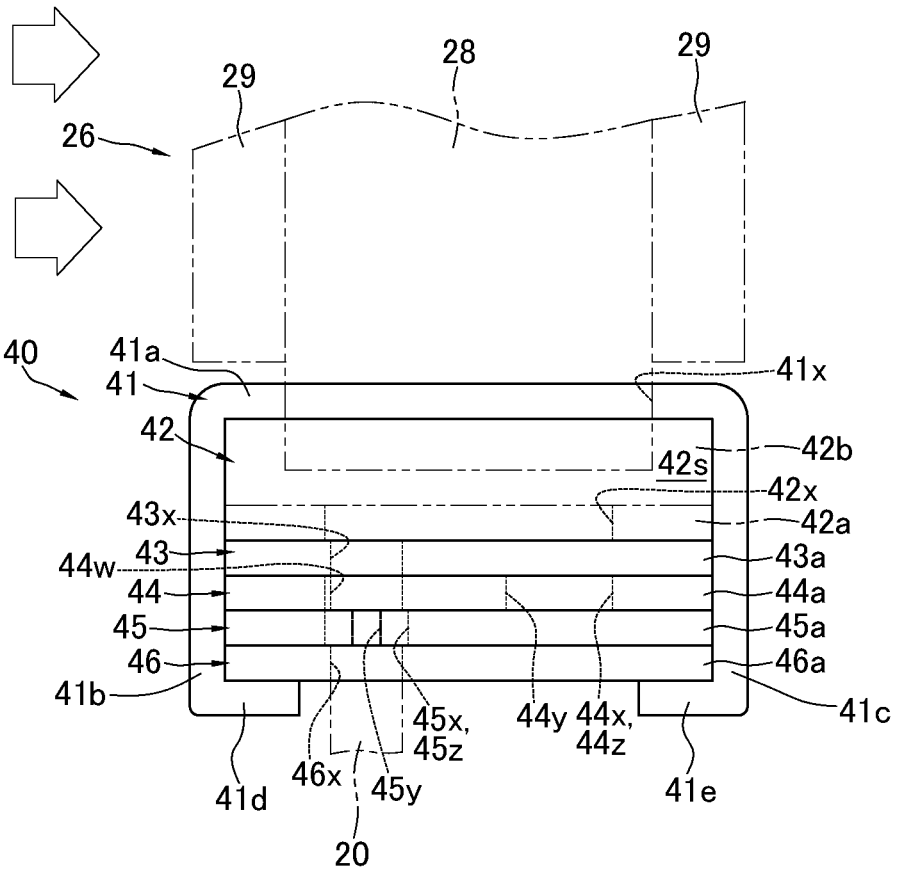
FIG. 8 is a structural view of an arrangement of the liquid header to which the heat transfer portion and a liquid-refrigerant pipe are connected according to one or more embodiments when viewed in the longitudinal direction of the liquid header.
Figure 8:
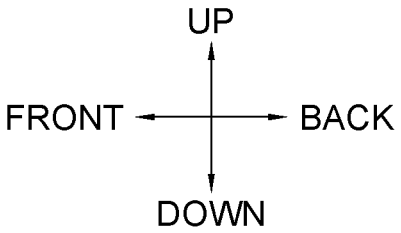

FIG. 6 is an exploded perspective view of the liquid header 40. Note that, in FIG. 6, alternate-long-and-two-short-dash-line arrows indicate the flow of a refrigerant when the outdoor heat exchanger 11 functions as an evaporator of the refrigerant. FIG. 7 is a structural view of an arrangement of the liquid header 40 when viewed in the longitudinal direction thereof. FIG. 8 is a structural view of an arrangement of a state in which the heat transfer portions 26 and the liquid-refrigerant pipe are connected to the liquid header 40.

Figure 9:
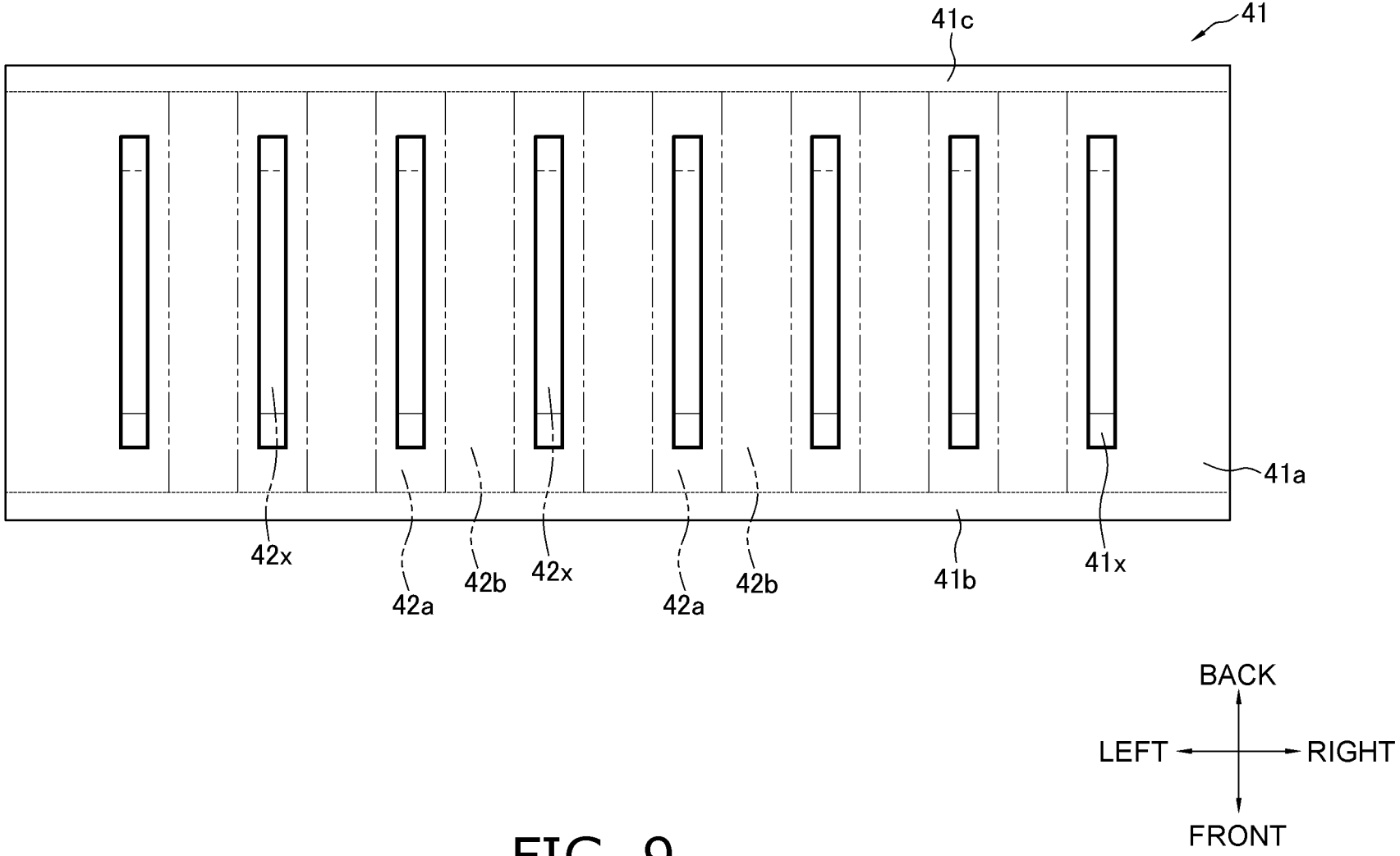
FIG. 9 is a top schematic view of a first liquid-side member according to one or more embodiments.
Figure 10:
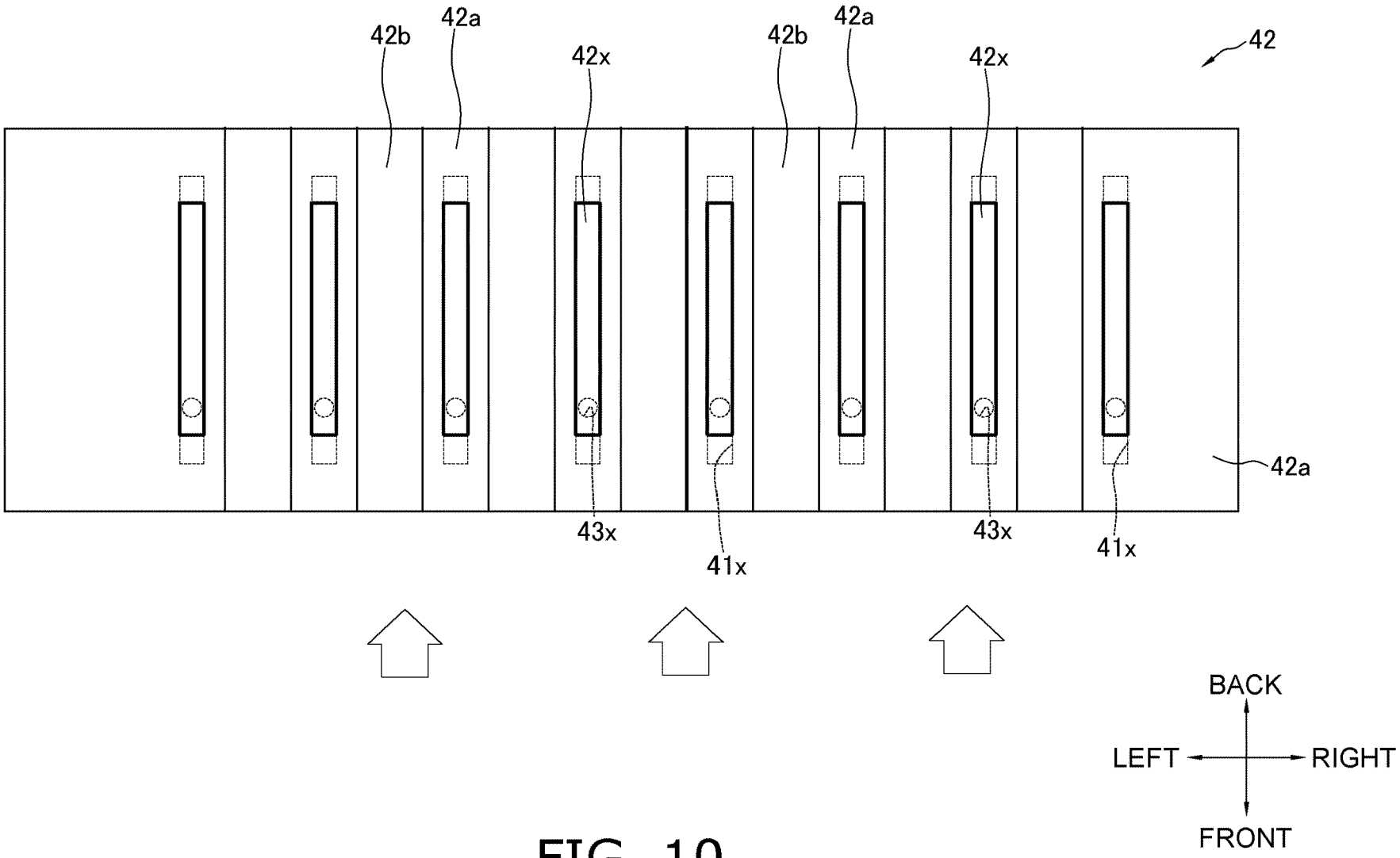
FIG. 10 is a top schematic view of a second liquid-side member according to one or more embodiments.
Figure 11:
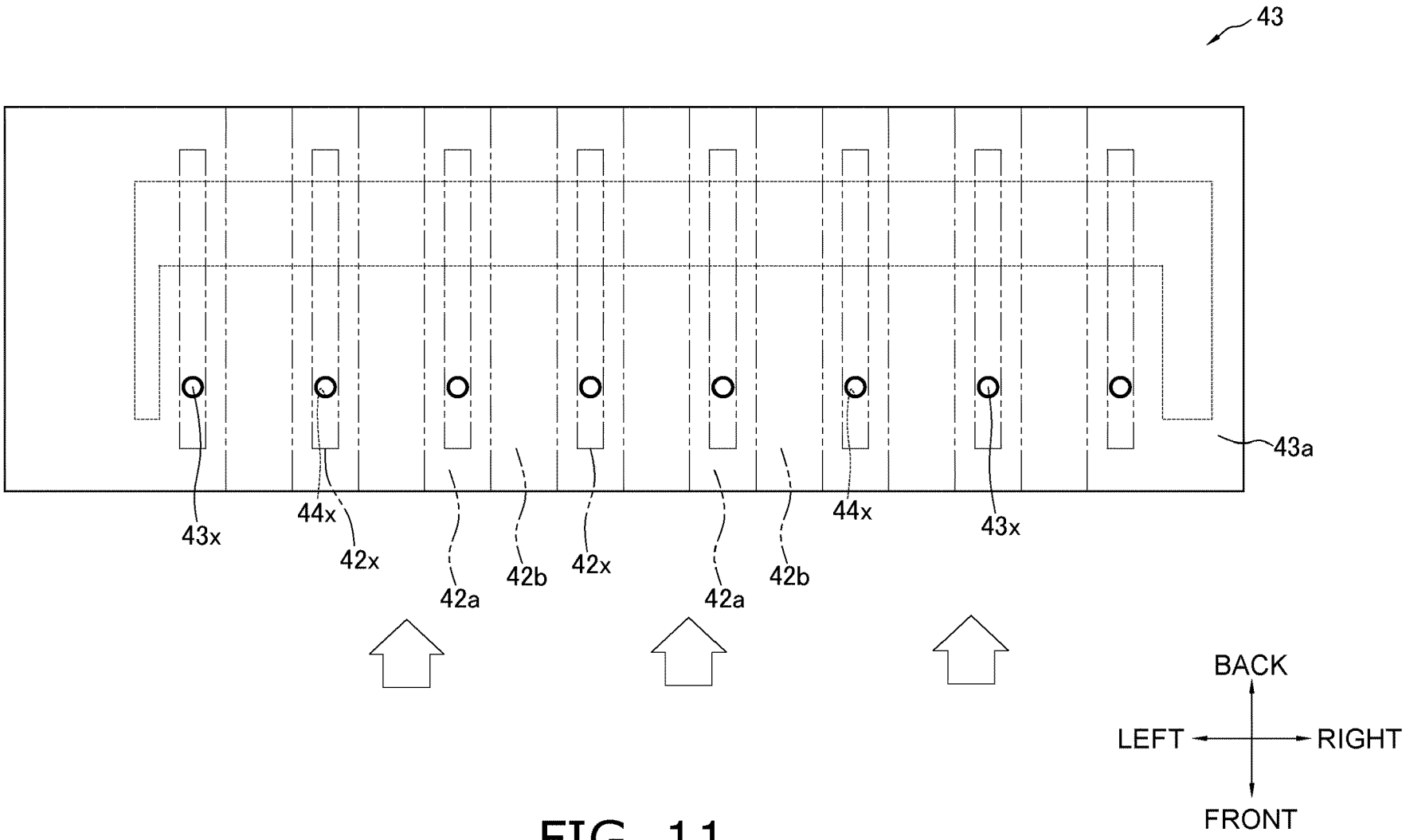
FIG. 11 is a top schematic view of a third liquid-side member according to one or more embodiments.
Figure 12:
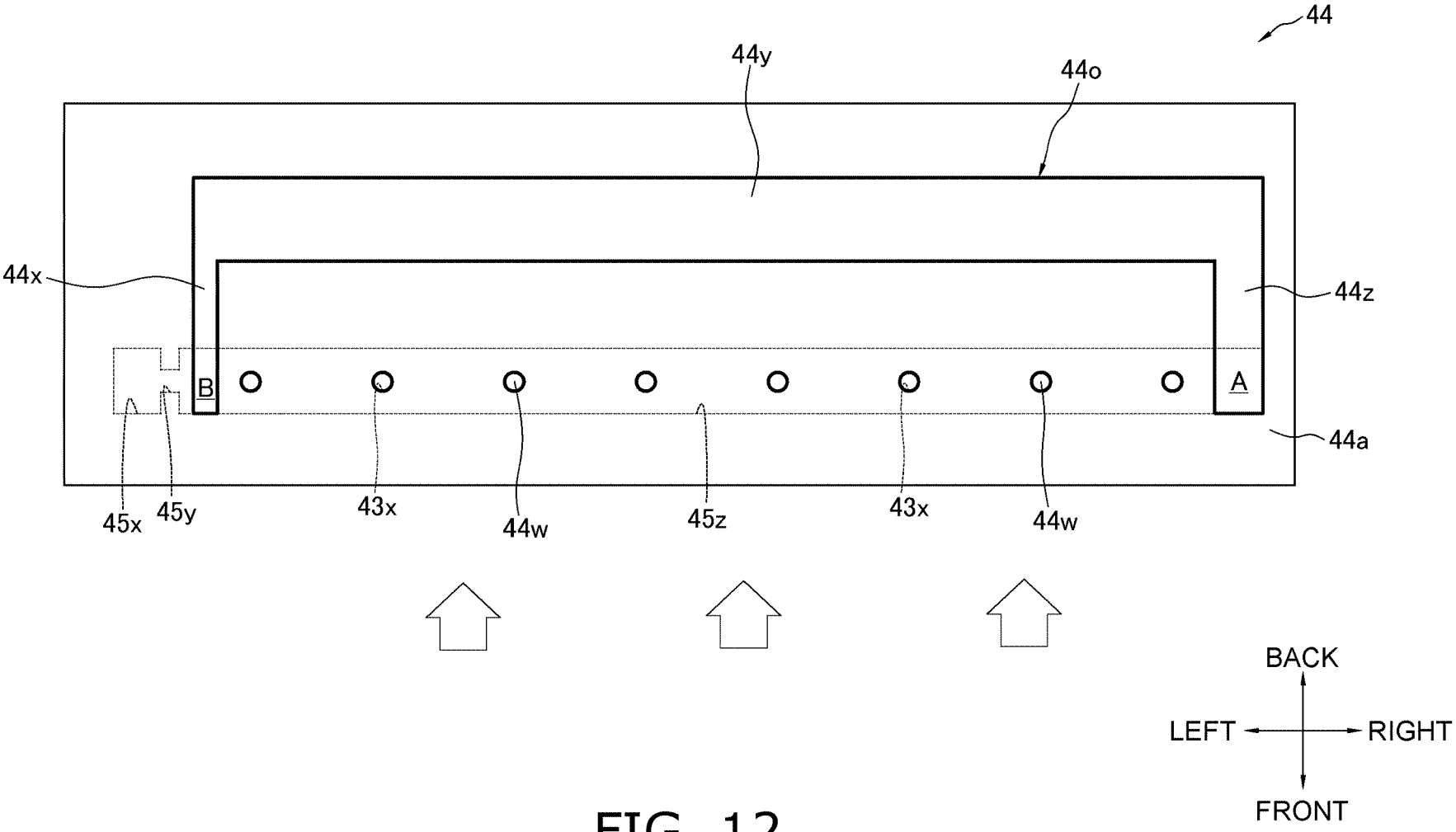
FIG. 12 is a top schematic view of a fourth liquid-side member according to one or more embodiments.
Figure 13:
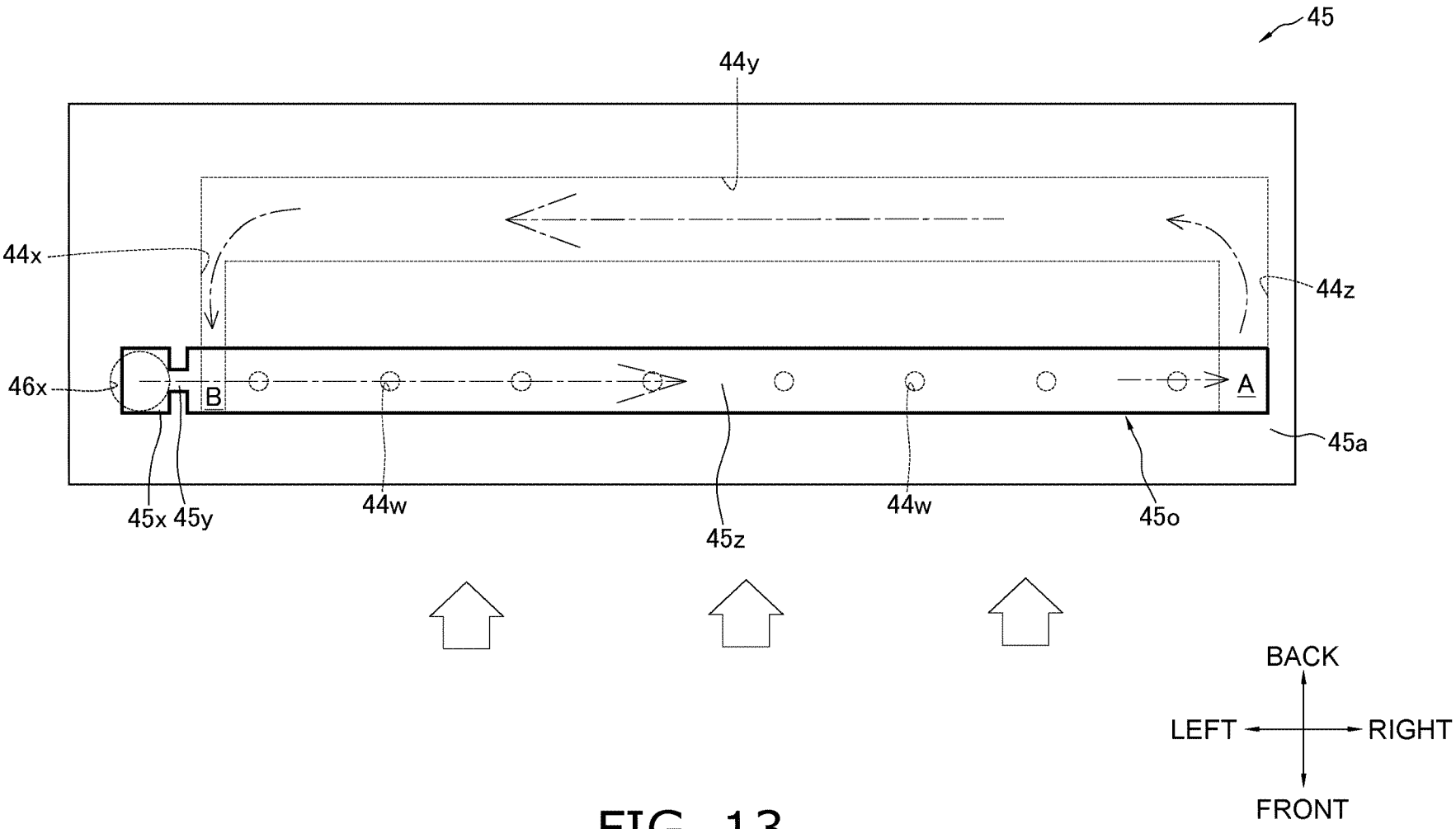
FIG. 13 is a top schematic view of a fifth liquid-side member according to one or more embodiments.
Figure 14:
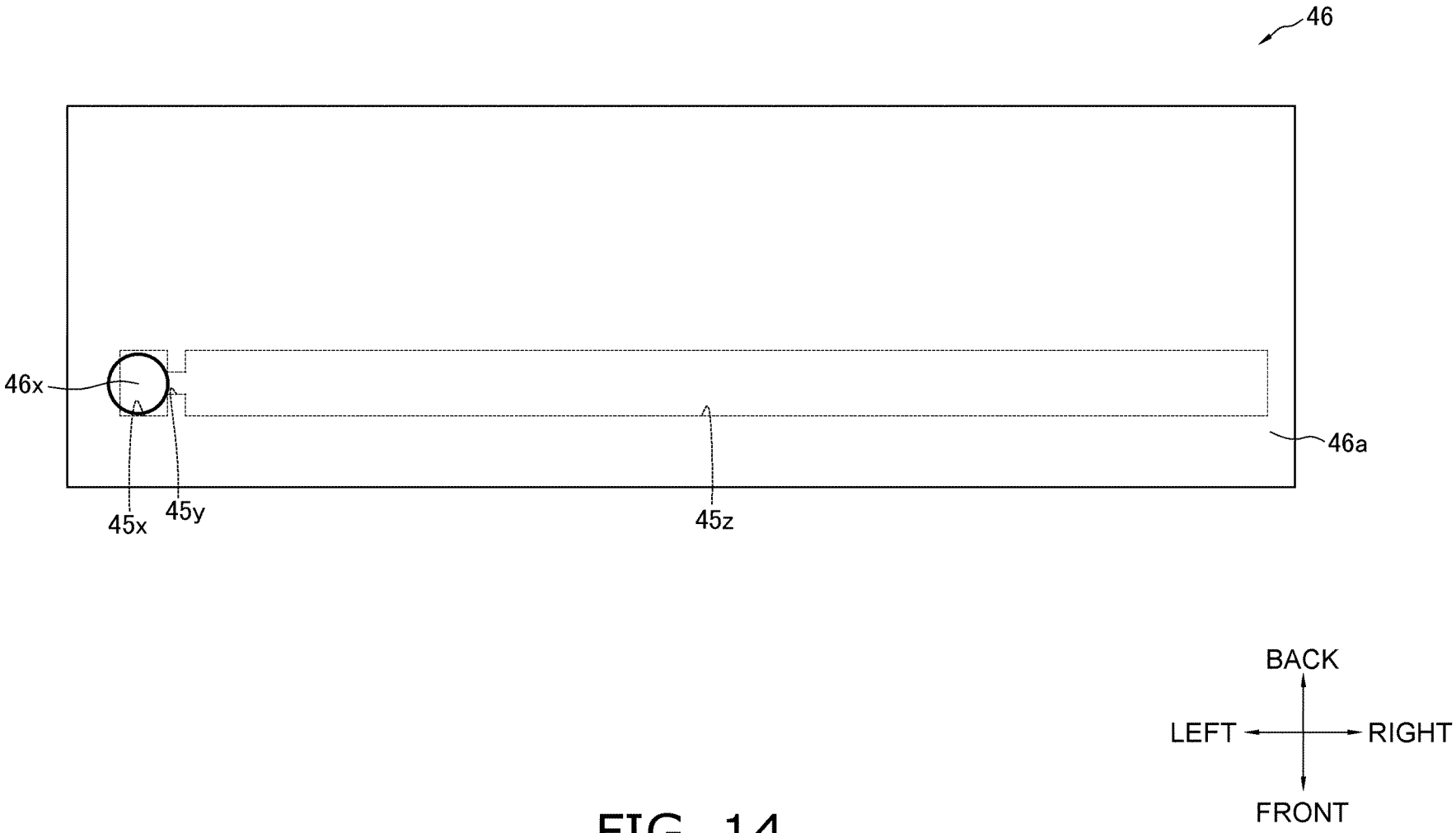
FIG. 14 is a top schematic view of a sixth liquid-side member according to one or more embodiments.

FIG. 9 is a top schematic view of a first liquid-side member 41. FIG. 10 is a top schematic view of a second liquid-side member 42. FIG. 11 is a top schematic view of a third liquid-side member 43. FIG. 12 is a top schematic view of a fourth liquid-side member 44. FIG. 13 is a top schematic view of a fifth liquid-side member 45. FIG. 14 is a top schematic view of a sixth liquid-side member 46. Note that each of these figures show with, for example, broken lines, the relationship between the positions of openings of members that are disposed adjacent to each other while projecting them.

The liquid header 40 includes the first liquid-side member 41, the second liquid-side member 42, the third liquid-side member 43, the fourth liquid-side member 44, the fifth liquid-side member 45, and the sixth liquid-side member 46. The liquid header 40 is constituted by joining the first liquid-side member 41, the second liquid-side member 42, the third liquid-side member 43, the fourth liquid-side member 44, the fifth liquid-side member 45, and the sixth liquid-side member 46 to each other by brazing.

Note that it is desirable that the first liquid-side member 41, the third liquid-side member 43, the fourth liquid-side member 44, the fifth liquid-side member 45, and the sixth liquid-side member 46 be constituted to have a plate thickness of 3 mm or less. It is desirable that the first liquid-side member 41, the second liquid-side member 42, the third liquid-side member 43, the fourth liquid-side member 44, the fifth liquid-side member 45, and the sixth liquid-side member 46 each be a member having a thickness in a plate-thickness direction that is smaller than a length in a front-back direction and that is smaller than a length in a left-right direction. The first liquid-side member 41, the third liquid-side member 43, the fourth liquid-side member 44, the fifth liquid-side member 45, and the sixth liquid-side member 46 are stacked in a stacking direction (an example of a first direction), which is the plate-thickness direction.

An external shape of the liquid header 40 in plan view is a substantially quadrilateral shape having a connection portion of the flat tubes 28 as one side.

(4-1) First Liquid-Side Member

The first liquid-side member 41 is primarily a member that, together with the sixth liquid-side member 46 described below, constitutes the periphery of the external shape of the liquid header 40. It is desirable that the first liquid-side member 41 have a clad layer formed on a surface thereof, the clad layer having a brazing material.

The first liquid-side member 41 includes a liquid-side flat-tube connection plate 41*a*, a first liquid-side outer wall 41*b*, a second liquid-side outer wall 41*c*, a first liquid-side claw portion 41*d*, and a second liquid-side claw portion 41*e*.

Although not limited, the first liquid-side member 41 of one or more embodiments can be formed by bending one metal plate obtained by rolling with the longitudinal direction of the liquid header 40 being a direction of fold. In this case, the plate thickness of each portion of the first liquid-side member 41 is uniform.

The liquid-side flat-tube connection plate 41*a* is a flat-shaped portion extending in the front-back direction and in the left-right direction. A plurality of liquid-side flat-tube connection openings 41*x* disposed side by side in the left-right direction are formed in the liquid-side flat-tube connection plate 41*a*. Each liquid-side flat-tube connection opening 41*x* is a through opening in a thickness direction of the liquid-side flat-tube connection plate 41*a*. With the flat tubes 28 being inserted in the liquid-side flat-tube connection openings 41*x* such that one end of each flat tube 28 passes completely through the corresponding liquid-side flat-tube connection opening 41*x*, the flat tubes 28 are joined to the liquid-side flat-tube connection openings 41*x* by brazing. In the joined state realized by brazing, the entire inner peripheral surface of each liquid-side flat-tube connection opening 41*x* and the entire outer peripheral surface of the corresponding flat tube 28 are in contact with each other. Here, since the thickness of the first liquid-side member 41 including the liquid-side flat-tube connection plate 41*a* is relatively small, such as on the order of 1.0 mm or greater and 2.0 mm or less, the length of the inner peripheral surface of each gas-side flat-tube connection opening 71*x* in the plate-thickness direction can be short. Therefore, when, in a stage before the joining by brazing, the flat tubes 28 are inserted into the liquid-side flat-tube connection openings 41*x*, friction that is produced between the inner peripheral surfaces of the liquid-side flat-tube connection openings 41*x* and the outer peripheral surfaces of the flat tubes 28 can be kept low, and the insertion operation can be facilitated.

The first liquid-side outer wall 41*b* is a flat-shaped portion extending downward from a lower surface of a front end portion of the liquid-side flat-tube connection plate 41*a*.

The second liquid-side outer wall 41*c* is a flat-shaped portion extending downward from a lower surface of a back end portion of the liquid-side flat-tube connection plate 41*a*.

The first liquid-side claw portion 41*d* is a portion extending toward the back from a lower end portion of the first liquid-side outer wall 41*b*. The second liquid-side claw portion 41*e* is a portion extending toward the front from a lower end portion of the second liquid-side outer wall 41*c*.

In a state before the second liquid-side member 42, the third liquid-side member 43, the fourth liquid-side member 44, the fifth liquid-side member 45, and the sixth liquid-side member 46 are disposed on an inner side of the first liquid-side member 41 when viewed in the longitudinal direction of the liquid header 40, the first liquid-side claw portion 41*d* and the second liquid-side claw portion 41*e* are each in an extended state on an extension line of a corresponding one of the first liquid-side outer wall 41*b* and the second liquid-side outer wall 41*c*. In a state in which the second liquid-side member 42, the third liquid-side member 43, the fourth liquid-side member 44, the fifth liquid-side member 45, and the sixth liquid-side member 46 are disposed on the inner side of the first liquid-side member 41 when viewed in the longitudinal direction of the liquid header 40, the first liquid-side claw portion 41*d* and the second liquid-side claw portion 41*e* are bent toward each other to crimp the second liquid-side member 42, the third liquid-side member 43, the fourth liquid-side member 44, the fifth liquid-side member 45, and the sixth liquid-side member 46 by the first liquid-side member 41, as a result of which they are fixed to each other. When, in this state, the brazing is performed, for example, inside a furnace, the members are joined to each other by the brazing and are completely fixed to each other.

(4-2) Second Liquid-Side Member

The second liquid-side member 42 includes a plate-shaped base portion 42*a* and a plurality of protrusions 42*b* that protrude toward the liquid-side flat-tube connection plate 41*a* from the base portion 42*a*. The second liquid-side member 42 may not have a clad layer formed on a surface thereof, the clad layer having a brazing material.

The base portion 42*a* extends parallel to the liquid-side flat-tube connection plate 41*a* and has a plate shape in which the direction of extension of the flat tubes 28 is the plate-thickness direction. The width of the base portion 42*a* in the front-back direction is the same as the width of a portion of the liquid-side flat-tube connection plate 41*a* in the front-back direction excluding two end portions. A plurality of communication holes 42*x* provided side by side in the left-right direction are formed in a one-to-one correspondence with the flat tubes 28 at positions in the base portion 42*a* other than the positions where the protrusions 42*b* are provided. In plan view, the shape of each communication hole 42*x* substantially overlaps a portion of an end portion of the corresponding flat tube 28 where the refrigerant passages 28*b* are provided.

The protrusions 42*b* extend in the vertical direction up to where they come into contact with a lower surface of the liquid-side flat-tube connection plate 41*a* by extending upward from portions of the base portion 42*a* between the communication holes 42*x* adjacent to each other. Therefore, there are formed insertion spaces 42*s* surrounded by the lower surface of the liquid-side flat-tube connection plate 41*a* of the first liquid-side member 41, the first liquid-side outer wall 41*b* and the second liquid-side outer wall 41*c* of the first liquid-side member 41, the protrusions 42*b* that are adjacent to each other in the left-right direction of the second liquid-side member 42, and portions of an upper surface of the base portion 42*a* of the second liquid-side member 42 other than the communication holes 42*x*. The insertion spaces 42*s* are provided side by side in the longitudinal direction of the liquid header 40. End portions of the flat tubes 28 are positioned in the insertion spaces 42*s*. Note that the lengths of the protrusions 42*b* in the up-down direction are adjusted to be larger than the plate thickness of any of the first liquid-side member 41, the third liquid-side member 43, the fourth liquid-side member 44, the fifth liquid-side member 45, and the sixth liquid-side member 46 that constitute the liquid header 40. Therefore, even if an error occurs in the amount of insertion of the flat tubes 28 into the liquid header 40, as long as the error is within a range of the lengths of the protrusions 42*b* in the up-down direction, blockages or difficulty flowing, such as portions at which a flow of a refrigerant is blocked or portions at which a refrigerant has difficulty flowing being formed when the liquid header 40 has been completed, are less likely to occur. It is also possible to suppress a brazing material from moving due to a capillary action when the members are joined by brazing, and to thus suppress the brazing material from closing the refrigerant passages 28*b* of the flat tubes 28.

(4-3) Third Liquid-Side Member

The third liquid-side member 43 is a member that is stacked on a lower surface of the base portion 42*a* of the second liquid-side member 42 so as to face and contact this surface. The length of the third liquid-side member 43 in the front-back direction is the same as the length of the second liquid-side member 42 in the front-back direction. It is desirable that the third liquid-side member 43 have a clad layer formed on a surface thereof, the clad layer having a brazing material.

The third liquid-side member 43 (an example of a third member) includes a third internal plate 43*a* and a plurality of third flow-dividing openings 43*x*.

The third internal plate 43*a* (an example of a third plate-shaped portion, an example of a plate-shaped portion) has a flat shape extending in the front-back direction and the left-right direction.

The plurality of third flow-dividing openings 43*x* (an example of third openings) are disposed side by side in the left-right direction, and are circular openings that penetrates in the plate-thickness direction of the third internal plate 43*a*. In one or more embodiments, each third flow-dividing opening 43*x* is positioned toward the front side of the third internal plate 43*a*. In plan view, each third flow-dividing opening 43*x* overlaps a front region of a corresponding one of the communication holes 42*x* of the second liquid-side member 42 and communicates therewith. Therefore, a refrigerant that flows in a blowing space 45*z* (described below) can be caused to flow by being branched toward each fourth flow-dividing opening 44*w* and each third flow-dividing opening 43*x*, and the flow of the refrigerant can be divided with respect to each flat tube 28 connected to a corresponding one of the third flow-dividing openings 43*x*.

Note that a surface of a portion of a lower surface of the third internal plate 43*a* other than a portion where the third flow-dividing openings 43*x* are formed covers a fourth liquid-side opening 44*o* of the fourth liquid-side member 44 (described below) to close the fourth liquid-side opening 44*o* from thereabove.

(4-4) Fourth Liquid-Side Member

The fourth liquid-side member 44 is a member that is stacked on the lower surface of the third internal plate 43*a* of the third liquid-side member 43 so as to face and contact this surface. The length of the fourth liquid-side member 44 in the left-right direction is the same as the length of the third liquid-side member 43 in the left-right direction. The fourth liquid-side member 44 may not have a clad layer formed on a surface thereof, the clad layer having a brazing material.

The fourth liquid-side member 44 (an example of a second member) includes a fourth internal plate 44*a* (an example of a second plate-shaped portion, an example of a plate-shaped portion), the plurality of fourth flow-dividing openings 44*w* (an example of second openings, an example of fourth openings, and an example of ninth openings), and the fourth liquid-side opening 44*o*.

The fourth internal plate 44*a* has a flat shape extending in the front-back direction and in the left-right direction.

The plurality of fourth flow-dividing openings 44*w* are openings formed to extend through the fourth internal plate 44*a* in the plate-thickness direction. In plan view, each fourth flow-dividing opening 44*w* overlaps each third flow-dividing opening 43*x* of the third liquid-side member 43 in a one-to-one correspondence.

The fourth liquid-side opening 44*o* (an example of a second opening) is an opening formed to extend through the fourth internal plate 44*a* in the plate-thickness direction, and is an opening that is independent of the plurality of fourth flow-dividing openings 44*w*. Note that, in plan view, the fourth liquid-side opening 44*o* does not overlap the third flow-dividing openings 43*x* of the third liquid-side member 43.

The fourth liquid-side opening 44*o* has a left connection space 44*x*, an intermediate connection space 44*y*, and a right connection space 44*z*.

On a back side of the plurality of fourth flow-dividing openings 44*w* (on a leeward side with respect to the fourth flow-dividing openings 44*w*), the intermediate connection space 44*y* is a region extending along the arrangement of the fourth flow-dividing openings 44*w*.

The left connection space 44*x* is a region extending toward an overlapping region B (described below) from a left end portion of the intermediate connection space 44*y*. In other words, the left connection space 44*x* is a space that connects one end portion of the intermediate connection space 44*y* and the overlapping region B. Here, in plan view, the left connection space 44*x* is positioned to the left of the plurality of fourth flow-dividing openings 44*w*, and extends toward the front up to a position that is roughly in correspondence with the positions of front end portions of the plurality of fourth flow-dividing openings 44*w*.

The right connection space 44*z* is a region extending toward an overlapping region A (described below) from a right end portion of the intermediate connection space 44*y*. In other words, the right connection space 44*z* is a space that connects the other end portion of the intermediate connection space 44*y* and the overlapping region A. Here, in plan view, the right connection space 44*z* is positioned to the right of the plurality of fourth flow-dividing openings 44*w*, and extends toward the front up to a position that is roughly in correspondence with the positions of the front end portions of the plurality of fourth flow-dividing openings 44*w*. Here, when viewed in the stacking direction, it is desirable that the area of the right connection space 44*z* be larger than the area of the left connection space 44*x*, and that the width of the right connection space 44*z* in the left-right direction be larger than the width of the left connection space 44*x* in the left-right direction. Therefore, a refrigerant that has reached a right end portion in the blowing space 45*z* of the fifth liquid-side member 45 (described below) is easily guided into the fourth liquid-side opening 44*o* of the fourth liquid-side member 44. When the width of the left connection space 44*x* in the left-right direction is small, a refrigerant that flows in the blowing space 45*z* of the fifth liquid-side member 45 (described below) can be suppressed from flowing in a reverse direction toward the fourth liquid-side opening 44*o* via the left connection space 44*x*.

(4-5) Fifth Liquid-Side Member

The fifth liquid-side member 45 is a member that is stacked on a lower surface of the fourth internal plate 44*a* of the fourth liquid-side member 44 so as to face and contact this surface. The length of the fifth liquid-side member 45 in the left-right direction is the same as the length of the fourth liquid-side member 44 in the left-right direction. It is desirable that the fifth liquid-side member 45 have a clad layer formed on a surface thereof, the clad layer having a brazing material.

The fifth liquid-side member 45 (an example of a first member) includes a fifth internal plate 45*a* (an example of a first plate-shaped portion) and a fifth liquid-side opening 45*o* (an example of a first opening).

The fifth internal plate 45*a* has a flat shape extending in the front-back direction and in the left-right direction.

The fifth liquid-side opening 45*o* is an opening formed to extend through the fifth internal plate 45*a* in the plate-thickness direction. Note that, in plan view, the fifth liquid-side opening 45*o* does not overlap the intermediate connection space 44*y* of the fourth liquid-side member 44.

The fifth liquid-side opening 45*o* has an introduction space 45*x* (an example of a third region), a nozzle 45*y* (an example of a connection region), and the blowing space 45*z*. In one or more embodiments, the introduction space 45*x*, the nozzle 45*y*, and the blowing space 45*z* are provided side by side in this order toward the right from the left, which is one side of the fifth liquid-side member 45 in a longitudinal direction thereof. In one or more embodiments, the widths of the introduction space 45*x*, the nozzle 45*y*, and the blowing space 45*z* in the up-down direction are the same.

The introduction space 45*x*, the nozzle 45*y*, and the blowing space 45*z* are spaces that are interposed in the up-down direction between the lower surface of the fourth internal plate 44*a* of the fourth liquid-side member 44 and an upper surface of a liquid-side external plate 46*a* of the sixth liquid-side member 46 (described below).

The introduction space 45*x* is provided at a left front portion of the fifth internal plate 45*a*. The introduction space 45*x* faces the lower surface of the fourth internal plate 44*a* of the fourth liquid-side member 44, does not overlap the fourth liquid-side opening 44*o* and each fourth flow-dividing opening 44*w* of the fourth liquid-side member 44 in plan view, and does not communicate with the fourth liquid-side opening 44*o* and each fourth flow-dividing opening 44*w*. Note that, in plan view, the introduction space 45*x* overlaps an external liquid-pipe connection opening 46*x* of the sixth liquid-side member 46 (described below) and communicates with the external liquid-pipe connection opening 46*x*.

The nozzle 45*y* is provided side by side with and to the right of the introduction space 45*x* at the left front portion of the fifth internal plate 45*a*. The nozzle 45*y* faces the lower surface of the fourth internal plate 44*a* of the fourth liquid-side member 44, does not overlap the fourth liquid-side opening 44*o* and each fourth flow-dividing opening 44*w* of the fourth liquid-side member 44 in plan view, and does not communicate with the fourth liquid-side opening 44*o* and each fourth flow-dividing opening 44*w*. Note that the nozzle 45*y* faces the upper surface of the liquid-side external plate 46*a* of the sixth liquid-side member 46 (described below), does not overlap the external liquid-pipe connection opening 46*x* of the sixth liquid-side member 46 (described below) in plain view, and does not communicate with the external liquid-pipe connection opening 46*x*.

The blowing space 45*z* is a front portion of the fifth internal plate 45*a*, and is provided to the right of the nozzle 45*y* to extend in the left-right direction. The blowing space 45*z* faces the lower surface of the fourth internal plate 44*a* of the fourth liquid-side member 44, overlaps the plurality of fourth flow-dividing openings 44*w* in plan view, and communicates with the plurality of fourth flow-dividing openings 44*w*. Note that, although not limited, the number of fourth flow-dividing openings 44*w* with which the blowing space 45*z* communicates is desirably 3 or more and may be 5 or more.

In plan view, the blowing space 45*z* does not overlap the intermediate connection space 44*y* of the fourth liquid-side member 44, and does not communicate with the intermediate connection space 44*y*. The blowing space 45*z* is such that, as indicated by "A" in FIGS. 12 and 13, in plan view, an overlapping region A (an example of a first region) that is a portion of the blowing space 45*z* near a right end portion thereof, overlaps and communicates with an overlapping region A (an example of a first region) that is a front portion of the right connection space 44*z* of the fourth liquid-side member 44. Note that, in plan view, the overlapping regions A are positioned further to the right of the fourth flow-dividing opening 44*w* located farthest from the nozzle 45*y* among the plurality of fourth flow-dividing openings 44*w*. The blowing space 45*z* is such that, as indicated by "B" in FIGS. 12 and 13, in plan view, an overlapping region B (an example of a second region) that is a portion of the blowing space 45*z* near a left end portion thereof, overlaps and communicates with an overlapping region B (an example of a second region) that is a front portion of the left connection space 44*x* of the fourth liquid-side member 44. Note that, in plan view, the overlapping regions B are positioned between the nozzle 45*y* and the fourth flow-dividing opening 44*w* that is closest to the nozzle 45*y* among the plurality of fourth flow-dividing openings 44*w*. The overlapping regions A and the overlapping regions B are provided at different positions when viewed in the stacking direction. Note that the blowing space 45*z* faces the upper surface of the liquid-side external plate 46*a* of the sixth liquid-side member 46 (described below), does not overlap the external liquid-pipe connection opening 46*x* of the sixth liquid-side member 46 (described below) in plain view, and does not communicate with the external liquid-pipe connection opening 46*x*. Note that the length of the blowing space 45*z* in the longitudinal direction of the liquid header 40 is longer than the length of the introduction space 45*x* in the longitudinal direction of the liquid header 40 and is longer than the length of the nozzle 45*y* in the longitudinal direction of the liquid header 40. Therefore, it is possible to increase the number of flat tubes 28 that are made to communicate via the blowing space 45*z*.

Note that the blowing space 45*z* can form a refrigerant flow path extending along the longitudinal direction of the liquid header 40 by using the lower surface of the fourth internal plate 44*a* of the fourth liquid-side member 44, the upper surface of the liquid-side external plate 46*a* of the sixth liquid-side member 46 (described below), and thick portions of front and back edges of the fifth liquid-side opening 45*o* of the fifth internal plate 45*a* of the fifth liquid-side member 45. Therefore, the structure is one that makes it less likely for errors in a flow-path cross-sectional area of the blowing space 45*z* caused by manufacturing to occur, and that makes it easy to obtain the liquid header 40 that allows a refrigerant to flow stably.

Here, the width (length) of the nozzle 45*y* in the front-back direction (a direction that is perpendicular to the longitudinal direction of the liquid header 40 and that is perpendicular to the direction of extension of the flat tubes 28 (an example of a third direction)) is smaller than the width (length) of the introduction space 45*x* in the front-back direction and smaller than the width (length) of the blowing space 45*z* in the front-back direction. Therefore, when the outdoor heat exchanger 11 is used as an evaporator of a refrigerant, a refrigerant that has been sent to the introduction space 45*x* has its flow velocity increased when passing through the nozzle 45*y* and easily reaches the right end portion of the blowing space 45*z* that is located far away from the nozzle 45*y*. Note that, since the width of the blowing space 45*z* in the front-back direction can be narrower than the width of the introduction space 45*x* in the front-back direction and a passage cross-sectional area of a refrigerant in the blowing space 45*z* can be decreased, the flow velocity of the refrigerant that flows toward the right in the blowing space 45*z* can be kept high.

Here, in the front-back direction that is perpendicular to the longitudinal direction of the liquid header 40 and that is perpendicular to the plate-thickness direction of the fifth internal plate 45*a*, the width of the nozzle 45*y* is larger than the plate thickness of the fifth internal plate 45*a*. Therefore, an opening width can be made larger than the plate thickness. Therefore, for example, when the fifth liquid-side opening 45*o* is to be formed in the fifth internal plate 45*a* by a punching operation, it is possible to reduce the load applied to a punch portion corresponding to the nozzle 45*y* and to suppress damage to the punch portion.

Note that, in plan view, the plurality of fourth flow-dividing openings 44*w* of the fourth liquid-side member 44 are positioned to overlap the inside of a range of a virtual region obtained by extending in a virtual manner the nozzle 45*y* in the longitudinal direction of the liquid header 40. When the outdoor heat exchanger 11 functions as an evaporator of a refrigerant, although a refrigerant that has passed through the nozzle 45*y* has its flow velocity increased and flows toward the right, a liquid refrigerant tends to be retained in front and back spaces of the blowing space 45*z* located slightly to the right of the nozzle 45*y*. In contrast, by disposing the plurality of fourth flow-dividing openings 44*w* and the nozzle 45*y* in the arrangement relationship above, it is possible to prevent the liquid refrigerant from flowing in a concentrated manner with respect to the leftmost fourth flow-dividing opening 44*w* among the fourth flow-dividing openings 44*w* that communicate with the blowing space 45*z*.

(4-6) Sixth Liquid-Side Member

The sixth liquid-side member 46 is a member that is stacked on a lower surface of the fifth internal plate 45*a* of the fifth liquid-side member 45 so as to face and contact this surface. The length of the sixth liquid-side member 46 in the front-back direction is the same as the length of the fifth liquid-side member 45 in the front-back direction. It is desirable that the sixth liquid-side member 46 have a clad layer formed on a surface thereof, the clad layer having a brazing material.

The sixth liquid-side member 46 (an example of a third member, an example of a second member) includes the liquid-side external plate 46*a* (an example of a third plate-shaped portion, an example of a second plate-shaped portion) and the external liquid-pipe connection opening 46*x*.

The liquid-side external plate 46*a* has a flat shape extending in the front-back direction and in the left-right direction.

The external liquid-pipe connection opening 46*x* is a through opening in the plate-thickness direction of the liquid-side external plate 46*a*. In plan view, the external liquid-pipe connection opening 46*x* overlaps a part of the introduction space 45*x* of the fifth liquid-side opening 45*o* of the fifth liquid-side member 45 and communicates therewith. Note that, in plan view, the external liquid-pipe connection opening 46*x* does not overlap the nozzle 45*y* and the blowing space 45*z* of the fifth liquid-side member 45, and does not communicate therewith. One end of the liquid-refrigerant pipe 20 is connected to the external liquid-pipe connection opening 46*x*.

Therefore, when the outdoor heat exchanger 11 functions as an evaporator of a refrigerant, a refrigerant that flows in the liquid-refrigerant pipe 20 is sent to the introduction space 45*x* of the fifth liquid-side opening 45*o* via the external liquid-pipe connection opening 46*x*.

Note that a lower surface of the sixth liquid-side member 46 is in contact with and crimped to the first liquid-side claw portion 41*d* and the second liquid-side claw portion 41*e* of the first liquid-side member 41.

(5) Flow of Refrigerant in Liquid Header

A flow of a refrigerant in the liquid header 40 when the outdoor heat exchanger 11 functions as an evaporator of the refrigerant is described below. Note that, when the outdoor heat exchanger 11 functions as a condenser or a heat dissipater of the refrigerant, the flow is in a direction substantially opposite to that when the outdoor heat exchanger 11 functions as an evaporator.

First, a liquid refrigerant or a refrigerant in a gas-liquid two-phase state that flows in the liquid-refrigerant pipe 20 flows into the liquid-side internal space 23 of the liquid header 40. Specifically, the refrigerant flows into the introduction space 45*x* of the fifth liquid-side opening 45*o* of the fifth liquid-side member 45 via the external liquid-pipe connection opening 46*x* of the sixth liquid-side member 46.

The refrigerant that has flowed into the introduction space 45*x* has its flow velocity increased when the refrigerant passes through the nozzle 45*y*, and flows toward the right in the blowing space 45*z*. Note that, even if a refrigerant circulation amount of the refrigerant circuit 6 is small, such as even if a driving frequency of the compressor 8 is low, by causing the width of the blowing space 45*z* in the front-back direction to be less than or equal to half of the width of the fifth liquid-side member 45 in the front-back direction, the refrigerant that has flowed into blowing space 45*z* easily reaches the fourth flow-dividing opening 44*w* that communicates therewith at the vicinity of the right end portion of the blowing space 45*z*. Here, the refrigerant that has flowed into the blowing space 45*z* moves to the vicinity of the right end portion of the blowing space 45*z* while being divided and flowing toward each fourth flow-dividing opening 44*w*. Note that, although, when a refrigerant circulation amount of the refrigerant circuit 6 is large, such as when a driving frequency of the compressor 8 is high, a large amount of refrigerant reaches the vicinity of the right end portion of the blowing space 45*z*, the refrigerant that has reached the vicinity of the right end portion of the blowing space 45*z* can flow into the vicinity of a front end portion of the right connection space 44*z* of the fourth liquid-side opening 44*o* of the fourth liquid-side member 44 disposed thereabove. The refrigerant that has flowed into the vicinity of the front end portion of the right connection space 44*z* of the fourth liquid-side opening 44*o* flows toward the back in the right connection space 44*z* and then flows toward the left in the intermediate connection space 44*y* of the fourth liquid-side opening 44*o*, and reaches the vicinity of a back end portion of the left connection space 44*x*. The refrigerant that has reached the vicinity of the back end portion of the left connection space 44*x* flows toward the front in the left connection space 44*x* and then, at the vicinity of a front end portion of the left connection space 44*x*, flows downward toward the vicinity of the left end portion of the blowing space 45*z*, located to the right of the nozzle 45*y* of the fifth liquid-side member 45 positioned therebelow. In particular, in the blowing space 45*z*, since the flow velocity of the refrigerant that flows toward the right is increased as a result of passing through the nozzle 45*y*, the static pressure is lower at a portion of the blowing space 45*z* near the front end portion of the left connection space 44*x* than at a portion of the intermediate connection space 44*y* near the left connection space 44*x*. Therefore, the refrigerant that has flowed toward the left in the intermediate connection space 44*y* is easily returned to the blowing space 45*z* via the left connection space 44*x*.

In this way, since it is possible to circulate the refrigerant by the blowing space 45*z*, the right connection space 44*z*, the intermediate connection space 44*y*, and the left connection space 44*x*, even if there is a refrigerant that has not flowed by being branched by any one of the fourth flow-dividing openings 44*w* when the refrigerant flows toward the right in the blowing space 45*z*, the refrigerant can be returned again to the blowing space 45*z* via the right connection space 44*z*, the intermediate connection space 44*y*, and the left connection space 44*x*. Therefore, the refrigerant easily flows in any one of the fourth flow-dividing openings 44*w*.

As described above, the refrigerant that has flowed by being divided by the fourth flow-dividing openings 44*w* flows into each flat tube 28 via each third flow-dividing opening 43*x* and each insertion space 42*s*, while being kept divided.

(6) Features of Embodiments (6-1)

Since the liquid header 40 of the outdoor heat exchanger 11 of one or more embodiments can be manufactured by stacking a plurality of plate-shaped members (the liquid-side flat-tube connection plate 41*a* of the first liquid-side member 41, the second liquid-side member 42, the third liquid-side member 43, the fourth liquid-side member 44, the fifth liquid-side member 45, and the sixth liquid-side member 46), the assembly operation is easily performed.

In addition, in this way, in the liquid header 40 that is constituted by stacking a plurality of plate-shaped members, a refrigerant that has flowed through the blowing space 45*z* of the fifth liquid-side member 45 flows through the right connection space 44*z*, the intermediate connection space 44*y*, and the left connection space 44*x* of the fourth liquid-side member 44 disposed adjacent to the fifth liquid-side member 45 via the overlapping regions A, and then can return again to the blowing space 45*z* of the fifth liquid-side member 45 via the overlapping regions B. The refrigerant that flows in the intermediate connection space 44*y* of the fourth liquid-side member 44 flows through the left connection space 44*x* of the fourth liquid-side member 44, the blowing space 45*z* of the fifth liquid-side member 45 disposed adjacent to the fourth liquid-side member 44, and the right connection space 44*z* of the fourth liquid-side member 44, and then can return again to the intermediate connection space 44*y* of the fourth liquid-side member 44. In this way, in the liquid header 40, it is possible to, at locations between the plate-shaped members stacked upon each other in the plate-thickness direction, cause a refrigerant to flow back and forth in the stacking direction via the plurality of independent overlapping regions. Therefore, since, compared with a structure in which a refrigerant flows only toward one side in the stacking direction, the flow of the refrigerant can be changed, a liquid refrigerant and a gas refrigerant are easily mixed. Consequently, it is possible to suppress the bias of distribution of the liquid refrigerant and the gas refrigerant in the liquid header 40.

Moreover, in the liquid header 40 of one or more embodiments, since it is possible to cause a refrigerant to flow back and forth between the plate-shaped members joined to each other, a structure for suppressing the bias of distribution of the liquid refrigerant and the gas refrigerant can be realized by a small number of plates. By keeping small the number of plates, the heat input amount when the plate-shaped members are joined to each other by brazing can be kept small.

(6-2)

In the liquid header 40 of the outdoor heat exchanger 11 of one or more embodiments, the length of the nozzle 45*y* in the front-back direction is shorter than the length of the introduction space 45*x* in the front-back direction and is shorter than the length of the blowing space 45*z* in the front-back direction. Therefore, in terms of a flow-path cross-sectional area with respect to a refrigerant passage direction, which is the longitudinal direction of the liquid header 40, the nozzle 45*y* is smaller than the introduction space 45*x* and is smaller than the blowing space 45*z*.

Therefore, when the outdoor heat exchanger 11 functions as an evaporator of a refrigerant, the refrigerant that passes through the nozzle 45*y* has its flow velocity increased and flows into the blowing space 45*z*. Consequently, it is possible to sufficiently guide the refrigerant also to, among the plurality of fourth flow-dividing openings 44*w* that communicate with the blowing space 45*z*, the fourth flow-dividing openings 44*w* that are positioned far above the nozzle 45*y*. Thus, biased distribution flows of the refrigerant between the plurality of flat tubes 28 that communicate with the same blowing space 45*z* can be kept small.

Moreover, as described above, the structure that narrows a flow path for blowing a refrigerant in the longitudinal direction of the liquid header 40, which is the direction in which the flat tubes 28 are disposed side by side, can be realized by one fifth liquid-side member 45.

(6-3)

The longitudinal direction of the liquid header 40 of the outdoor heat exchanger 11 of one or more embodiments is the left-right direction instead of a vertical direction. Here, the longitudinal direction of the blowing space 45*z* that communicates with the plurality of fourth flow-dividing openings 44*w* is also the left-right direction instead of a vertical direction. Therefore, compared with when the liquid header 40 is used in an orientation in which the longitudinal direction of the blowing space 45*z* is a vertical direction, a refrigerant that flows in the blowing space 45*z* is less likely to be subjected to the action of gravity.

(6-4)

In the liquid header 40 of the outdoor heat exchanger 11 of one or more embodiments, the plurality of fourth flow-dividing openings 44*w* communicate with the blowing space 45*z* instead of with the intermediate connection space 44*y*. Therefore, when the outdoor heat exchanger 11 functions as an evaporator of a refrigerant, since a refrigerant that flows in blowing space 45*z* easily flows to be drawn toward the plurality of fourth flow-dividing openings 44*w*, a reverse flow of a refrigerant in the left connection space 44*x* (a flow toward the intermediate connection space 44*y* via the left connection space 44*x* from the blowing space 45*z*) can be suppressed.

(6-5)

If the structure of the liquid header is a structure in which the left connection space 44*x* exists below the blowing space 45*z*, when a refrigerant returns to the blowing space 45*z* from the left connection space 44*x*, the refrigerant must move upward against gravity. Therefore, even if, by blowing out the refrigerant via the nozzle 45*y*, a static pressure difference between an upper space and a lower space of the overlapping regions in plan view of the blowing space 45*z* and the left connection space 44*x* can be produced, the static pressure difference is offset by an upward flow of the refrigerant against gravity toward the blowing space 45*z* from the left connection space 44*x*. Consequently, it is difficult to cause the refrigerant to circulate in the liquid header.

In contrast, the liquid header 40 of the outdoor heat exchanger 11 of one or more embodiments has a structure in which the left connection space 44*x* is positioned above the blowing space 45*z*. Therefore, when the refrigerant returns to the blowing space 45*z* from the left connection space 44*x*, the refrigerant flows downward without opposing gravity. Consequently, the static pressure difference that is produced by an ejector effect at the nozzle 45*y* between the upper space and the lower space of the overlapping regions in plan view of the blowing space 45*z* and the left connection space 44*x* is not offset. Thus, the refrigerant easily returns to the blowing space 45*z* from the left connection space 44*x*, and a flow of circulation of the refrigerant in the liquid header can be reliably produced.

(6-6)

The liquid header 40 of the outdoor heat exchanger 11 of one or more embodiments is capable of causing a refrigerant to flow by being branched by three or more fourth flow-dividing openings 44*w* at the blowing space 45*z*. Therefore, it is possible to divide one refrigerant flow into three or more refrigerant flows by only two plate-shaped members, that is, the fifth liquid-side member 45 and the fourth liquid-side member 44.

(6-7)

The liquid header 40 of the outdoor heat exchanger 11 of one or more embodiments is capable of causing a refrigerant to flow so as to circulate in the liquid header 40 via the blowing space 45*z*, the right connection space 44*z*, the intermediate connection space 44*y*, and the left connection space 44*x*.

Therefore, even if a refrigerant circulation amount in the refrigerant circuit 6 is large or small, biased distribution flow between each fourth flow-dividing opening 44*w* of a refrigerant whose flow is divided toward each fourth flow-dividing opening 44*w* from the blowing space 45*z* can be suppressed.

In the liquid header 40 of one or more embodiments, the blowing space 45*z*, the right connection space 44*z*, the intermediate connection space 44*y*, and the left connection space 44*x* are formed by the two members, that is, the fifth liquid-side member 45 and the fourth liquid-side member 44. Therefore, the structure that causes a refrigerant to flow by circulating in the liquid header 40 can be realized by a small number of components.

(6-8)

In a circular cylindrical header known in the art, when the entire end portions of the flat tubes, which are flat heat transfer tubes, are positioned in an internal space of the header, a large part of the flat tubes is placed in the circular cylindrical header, and useless space in which a refrigerant tends to be retained is formed above and below a portion of each flat tube that is positioned in the circular cylindrical header. In addition, since the inside diameter of the circular cylindrical header needs to have at least a magnitude that contains the entire end portions of the flat tubes, the space in the circular cylindrical header tends to be large, and a passage cross-sectional area when a refrigerant is caused to flow in the header in an axial direction is increased, as a result of which it is difficult to increase the flow velocity of the refrigerant. This tendency becomes noticeable particularly when the length of a cross section of each flat tube in a longitudinal direction is large.

In contrast, a connection portion of the liquid header 40 of one or more embodiments to the flat tubes 28 is a surface that extends in a direction perpendicular to the longitudinal direction of the flat tubes 28, and has a substantially rectangular shape in plan view. Therefore, the shape can be one that does not easily give rise to the difficulty of increasing the flow velocity that may exist in the circular cylindrical header. In addition, since the insertion spaces 42*s*, in which the flat tubes 28 are inserted, and the blowing space 45*z* are separated by the plate-shaped base portion 42*a* of the second liquid-side member 42, the third internal plate 43*a* of the third liquid-side member 43, and the fourth internal plate 44*a* of the fourth liquid-side member 44, useless space in which a refrigerant is retained is not easily formed. The magnitude a flow-path cross-sectional area of the blowing space 45*z* in which a refrigerant flows in the longitudinal direction of the liquid header 40 can be easily adjusted by only adjusting the plate thickness of a plate-shaped member or the size of an opening, and the flow velocity of the refrigerant can also be increased by reducing a passage cross-sectional area of the refrigerant.

(6-9)

In the liquid header 40 of the outdoor heat exchanger 11 of one or more embodiments, the first liquid-side member 41, the third liquid-side member 43, the fourth liquid-side member 44, the fifth liquid-side member 45, and the sixth liquid-side member 46 have a plate thickness of 3 mm or less. Therefore, the through openings in the plate-thickness direction of the members can be easily formed by a pressing operation.

(6-10)

In the liquid header 40 of the outdoor heat exchanger 11 of one or more embodiments, in plan view (when viewed in the stacking direction), the introduction space 45*x* communicates with the external liquid-pipe connection opening 46*x* of the sixth liquid-side member 46 while overlapping it. The introduction space 45*x*, the nozzle 45*y*, and the blowing space 45*z* are provided side by side in this order toward the right (other end) from the left (one end), which is one side of the liquid header 40 in the longitudinal direction thereof. Therefore, a refrigerant that has flowed in the liquid-refrigerant pipe 20 and the external liquid-pipe connection opening 46*x* of the sixth liquid-side member 46 and that has flowed into the introduction space 45*x* can pass through the nozzle 45*y* positioned to the right while flowing toward the right. Therefore, the refrigerant that passes through the nozzle 45*y* and flows in the blowing space 45*z* is blown to the right and the bias of distribution in the front-back direction are suppressed.

More specifically, for example, when the introduction space 45*x* has a long shape in the left-right direction and the external liquid-pipe connection opening 46*x* of the sixth liquid-side member 46 is connected not to a portion of the introduction space 45*x* to the left of the nozzle 45*y* but to a portion of the introduction space 45*x* to the front left or to the back left of the nozzle 45*y*, a refrigerant that has flowed in the liquid-refrigerant pipe 20 and the external liquid-pipe connection opening 46*x* of the sixth liquid-side member 46 and that has flowed into the introduction space 45*x* passes through the nozzle 45*y* toward the back right or toward the back left instead of toward the right. Therefore, the refrigerant that passes through the nozzle 45*y* and flows in the blowing space 45*z* may be biased in the front-back direction. In contrast, in the liquid header 40 of one or more embodiments, defections in the front-back direction of the refrigerant that passes through the nozzle 45*y* and that flows in the blowing space 45*z* are suppressed.

(6-11)

In the liquid header 40 of the outdoor heat exchanger 11 of one or more embodiments, the blowing space 45*z* of the fifth liquid-side member 45 is positioned toward the front side of the fifth internal plate 45*a*, each fourth flow-dividing opening 44*w* of the fourth liquid-side member 44 is positioned toward the front side of the fourth internal plate 44*a*, and each third flow-dividing opening 43*x* of the third liquid-side member 43 is positioned toward the front side of the third internal plate 43*a*. Therefore, when the outdoor heat exchanger 11 functions as an evaporator of a refrigerant, a refrigerant that flows into the plurality of flat tubes 28 from the liquid header 40 is easily sent to, of the plurality of refrigerant passages 28*b* of each flat tube 28, the refrigerant passages 28*b* that are positioned on a windward side than the refrigerant passages 28*b* that are positioned on a leeward side. Therefore, since it is possible to cause a large amount of refrigerant to flow toward the windward side at which the difference between the air temperature and the refrigerant temperature is the largest, it is possible to increase heat exchange efficiency.

(7) Modifications (7-1) Modification A

In the embodiments described above, an example in which the fourth liquid-side member 44 has the left connection space 44*x*, the intermediate connection space 44*y*, and the right connection space 44*z*, the fifth liquid-side member 45 has the blowing space 45*z*, and a refrigerant is circulated between the blowing space 45*z*, the left connection space 44*x*, the intermediate connection space 44*y*, and the right connection space 44*z* has been given and described.

Figure 15:
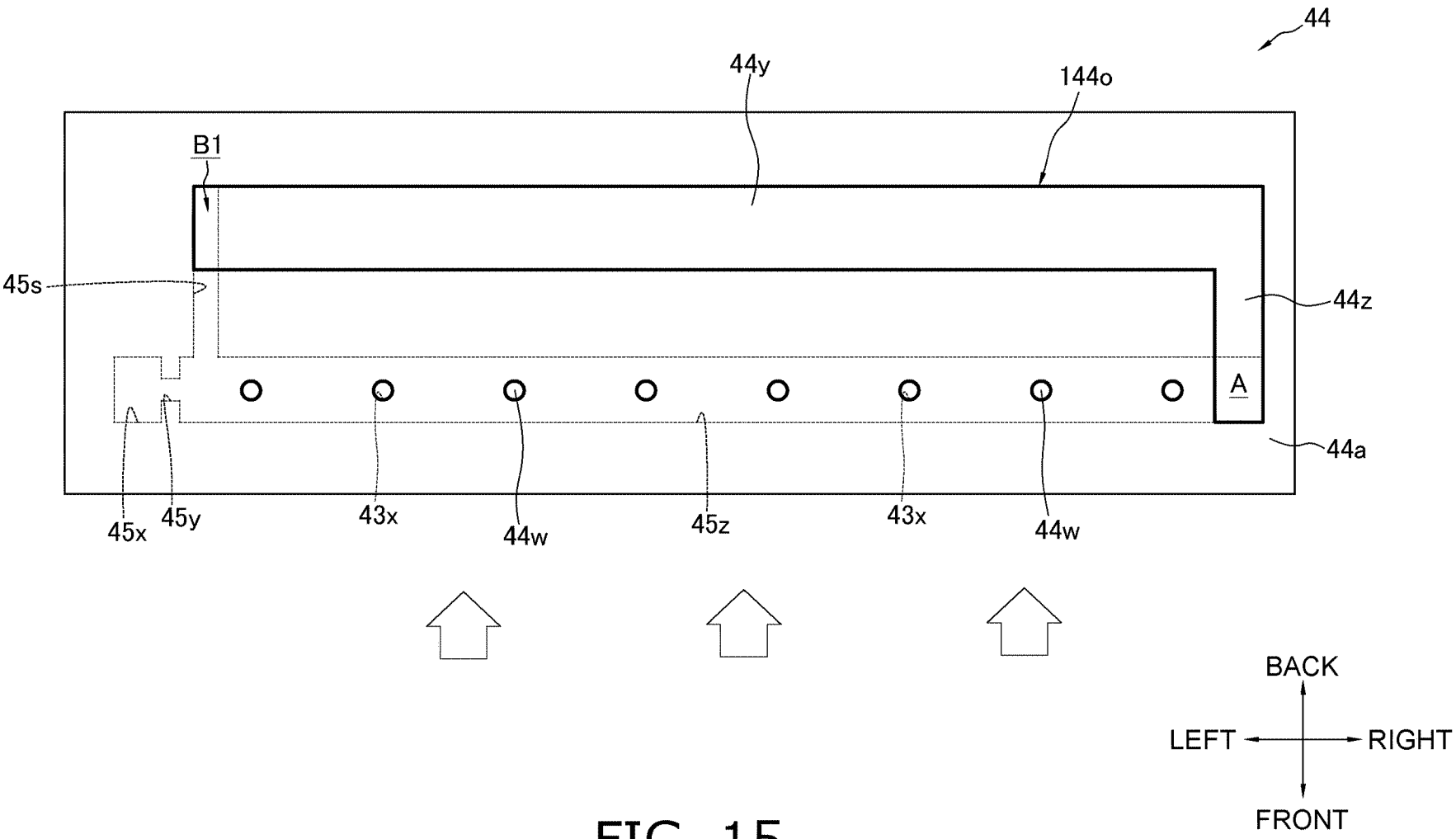
FIG. 15 is a top schematic view of a fourth liquid-side member according to Modification A.
Figure 16:
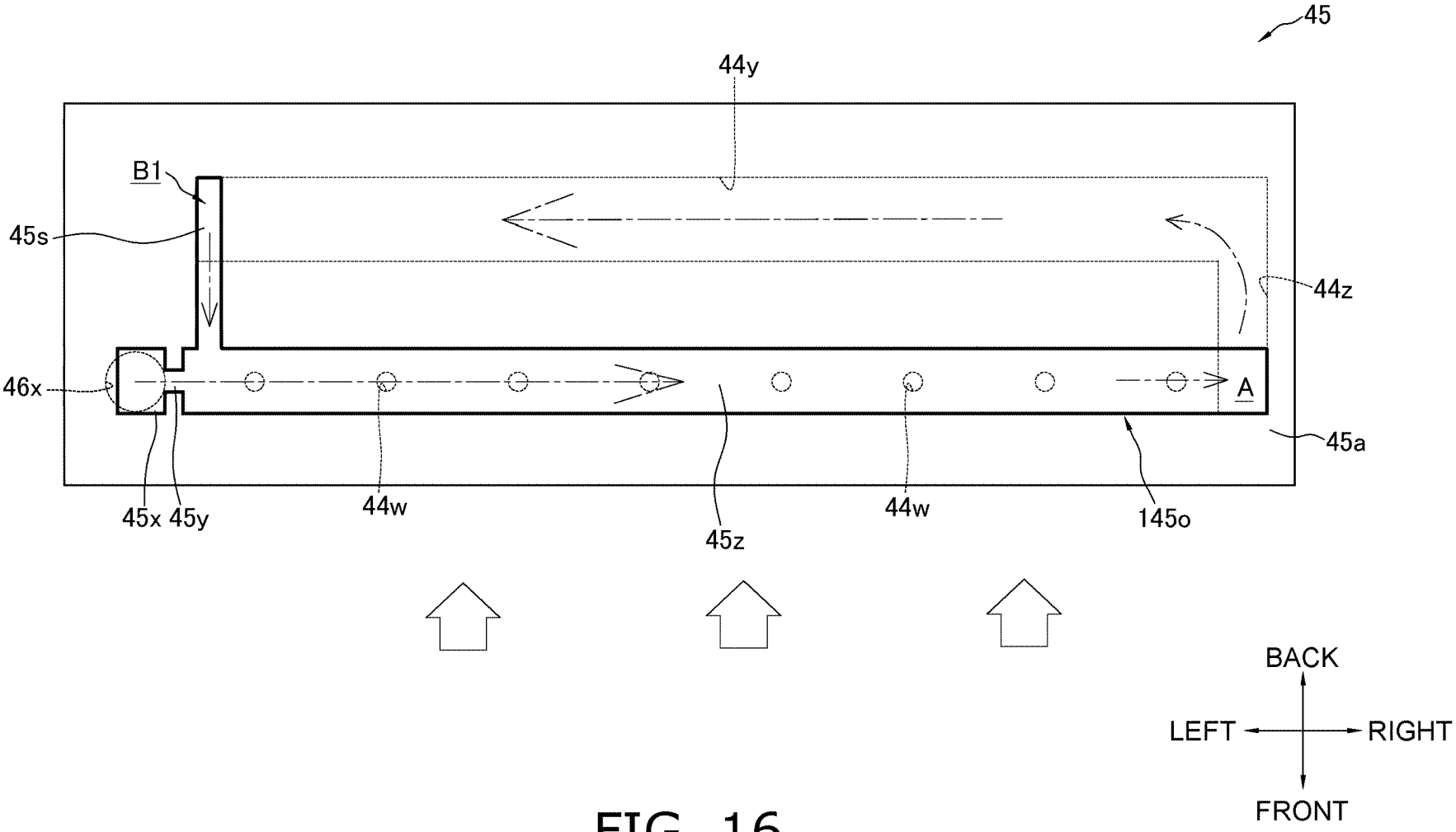
FIG. 16 is a top schematic view of a fifth liquid-side member according to Modification A.

In contrast, for example, as shown in FIGS. 15 and 16, the fourth liquid-side member 44 may have a fourth liquid-side opening 144*o* (an example of a second opening) not having the left connection space 44*x* of the embodiments described above, and the fifth liquid-side member 45 may have a fifth liquid-side opening 145*o* (an example of a first opening) having a left connection space 45*s* extending toward the back from the vicinity of the left end portion of the blowing space 45*z*. In this case, in plan view, an overlapping region B1 that is the left end portion of the intermediate connection space 44*y* and an overlapping region B1 that is a back end portion of the left connection space 45*s* overlap each other.

Even in this case, it is possible to cause a refrigerant to flow so as to circulate in the blowing space 45*z*, the right connection space 44*z*, the intermediate connection space 44*y*, and the left connection space 45*s* via the overlapping regions A and the overlapping regions B1, while the refrigerant moves back and forth between the fourth liquid-side member 44 and the fifth liquid-side member 45.

(7-2) Modification B

Figure 17:
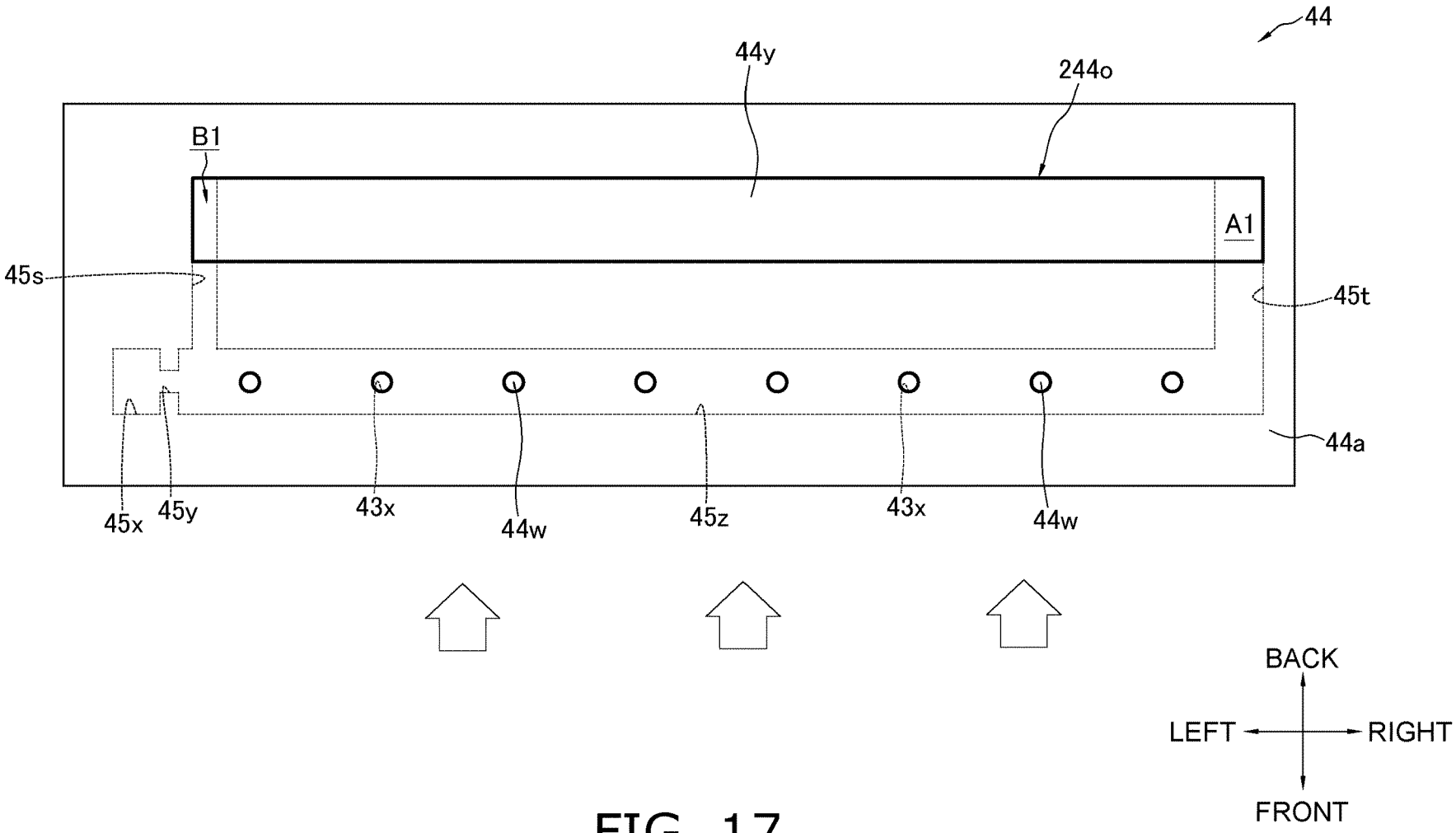
FIG. 17 is a top schematic view of a fourth liquid-side member according to Modification B.
Figure 18:
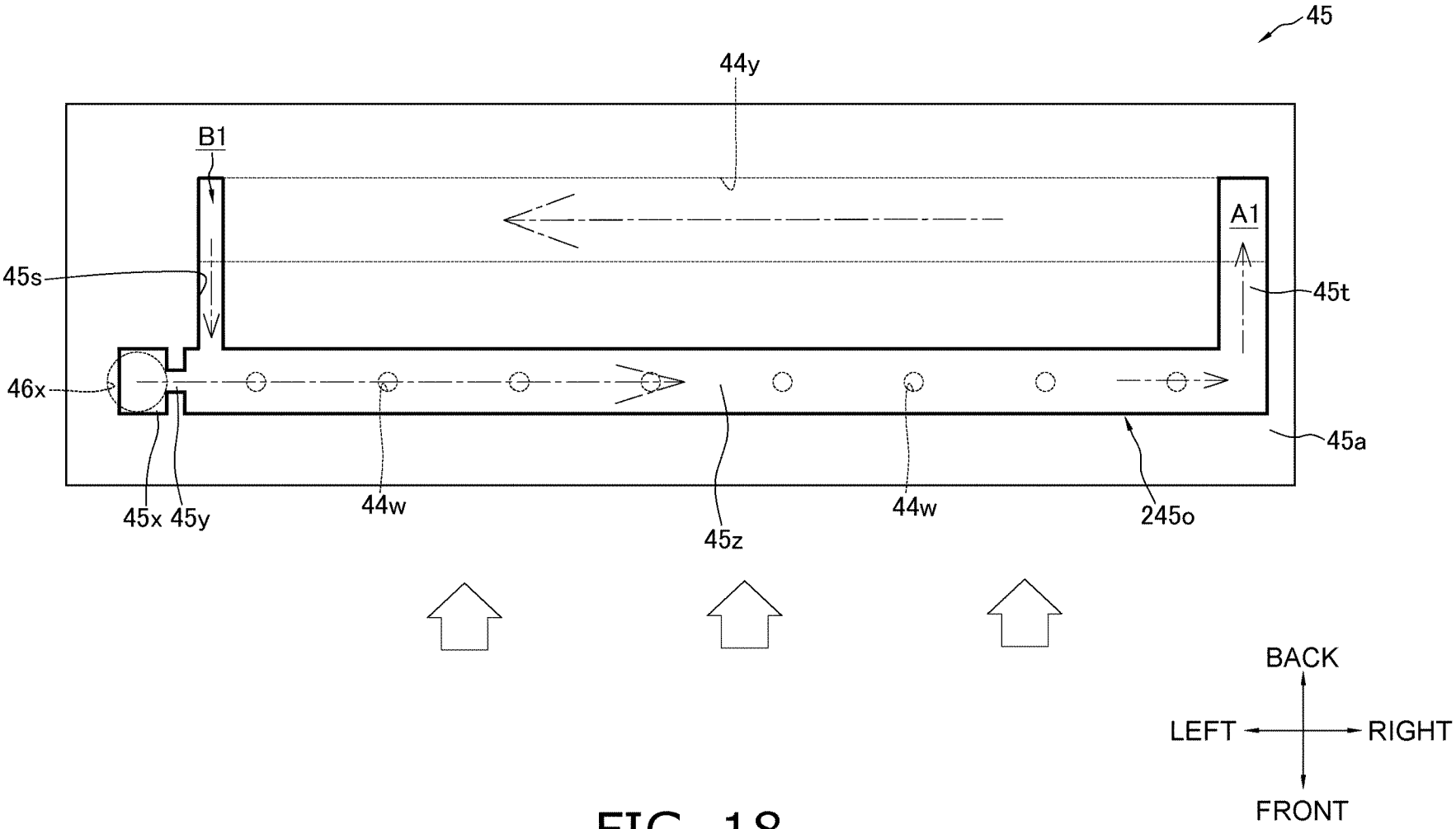
FIG. 18 is a top schematic view of a fifth liquid-side member according to Modification B.

For example, as shown in FIGS. 17 and 18, the fourth liquid-side member 44 may have a fourth liquid-side opening 244*o* (an example of a second opening) not having the left connection space 44*x* and the right connection space 44*z* of the embodiments described above, and the fifth liquid-side member 45 may have a fifth liquid-side opening 245*o* having a left connection space 45*s* extending toward the back from the vicinity of the left end portion of the blowing space 45*z* and a right connection space 45*t* extending toward the back from the vicinity of the right end portion of the blowing space 45*z*. In this case, in plan view, an overlapping region A1 that is the right end portion of the intermediate connection space 44*y* and an overlapping region A1 that is a back end portion of the right connection space 45*t* overlap each other, and an overlapping region B1 that is the left end portion of the intermediate connection space 44*y* and an overlapping region B1 that is a back end portion of the left connection space 45*s* overlap each other.

Even in this case, it is possible to cause a refrigerant to flow so as to circulate in the blowing space 45*z*, the right connection space 45*t*, the intermediate connection space 44*y*, and the left connection space 45*s* via the overlapping regions A1 and the overlapping regions B1, while the refrigerant moves back and forth between the fourth liquid-side member 44 and the fifth liquid-side member 45.

(7-3) Modification C

Figure 19:
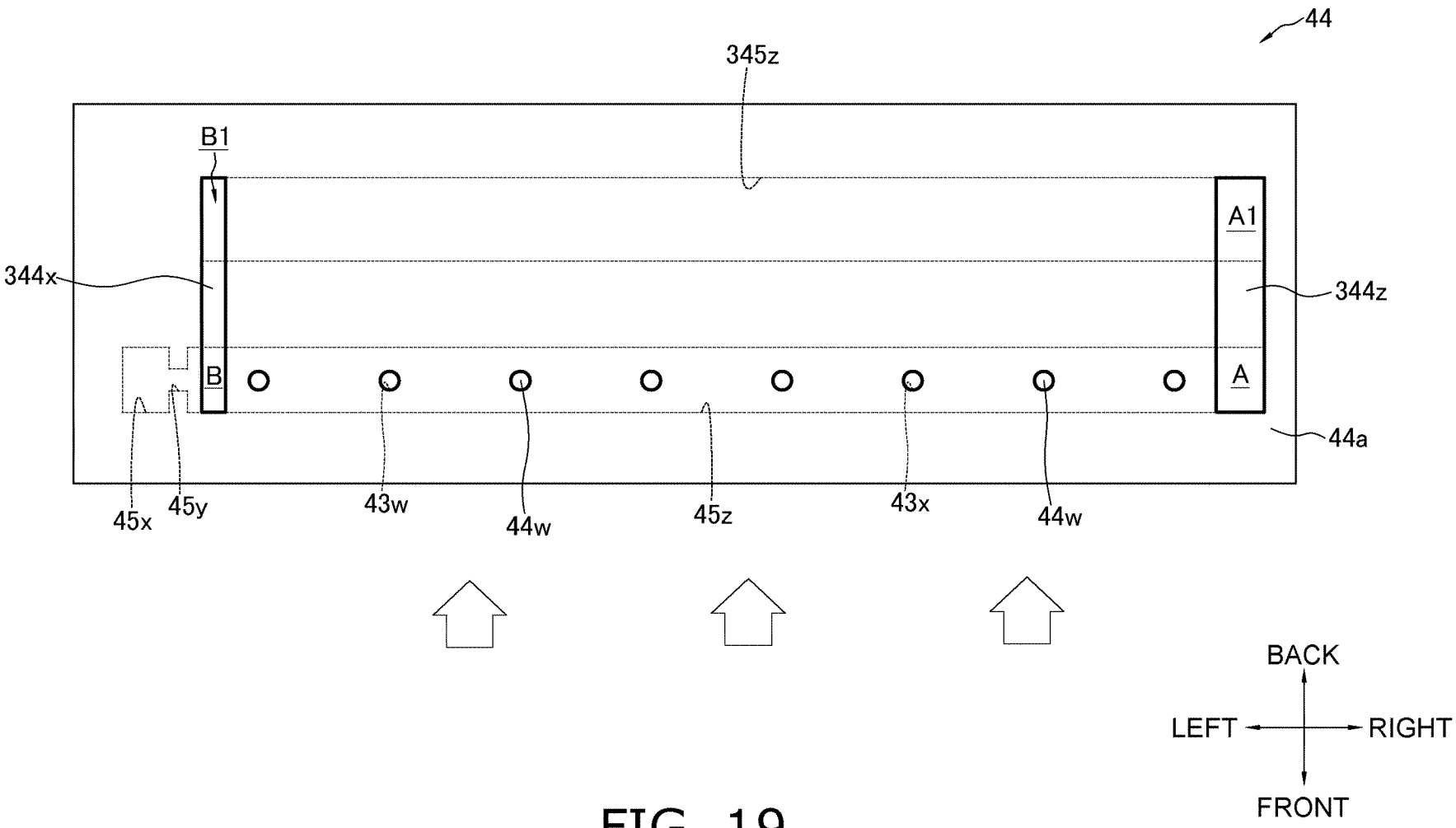
FIG. 19 is a top schematic view of a fourth liquid-side member according to Modification C.
Figure 20:
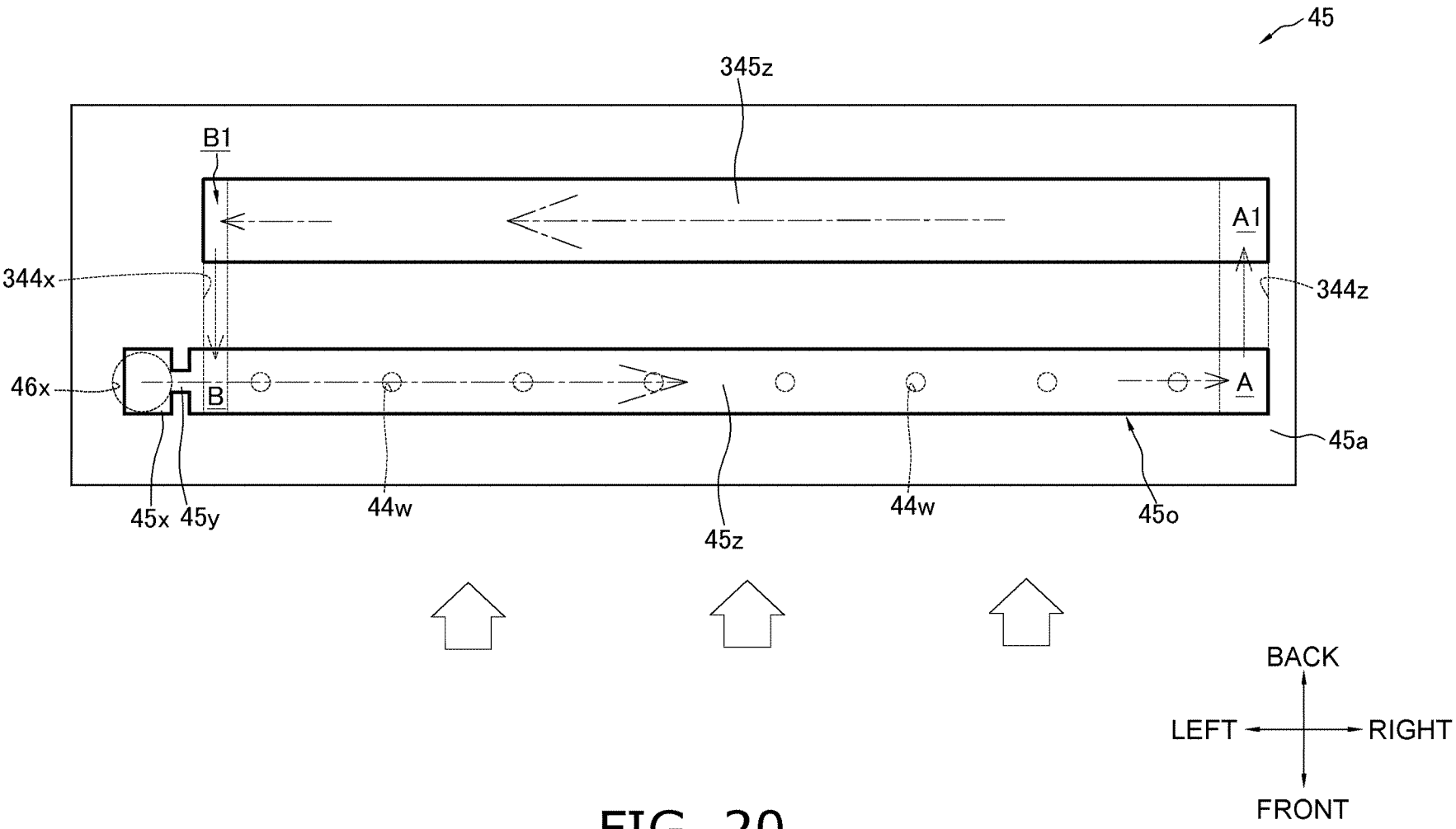
FIG. 20 is a top schematic view of a fifth liquid-side member according to Modification C.

For example, as shown in FIGS. 19 and 20, the fourth liquid-side member 44 may not have the intermediate connection space 44*y* of the embodiments described above and may have a left connection space 344*x* (an example of a second opening, an example of a seventh opening) extending in the front-back direction at the left end portion and a right connection space 344*z* (an example of a second opening, an example of a sixth opening) extending in the front-back direction at the right end portion, and the fifth liquid-side member 45 may have an intermediate connection space 345*z* (an example of a fifth opening) extending parallel to the blowing space 45*z* behind the blowing space 45*z*. In this case, in addition to the overlapping regions A and B in one or more embodiments, further, in plan view, an overlapping region A1 that is a right end portion of the intermediate connection space 345*z* and an overlapping region A1 that is a back end portion of the right connection space 344*z* overlap each other, and an overlapping region B1 that is a left end portion of the intermediate connection space 345*z* and an overlapping region B1 that is a back end portion of the left connection space 344*x* overlap each other.

Even in this case, it is possible to cause a refrigerant to flow so as to circulate in the blowing space 45*z*, the right connection space 344*z*, the intermediate connection space 345*z*, and the left connection space 344*x* via the overlapping regions A, the overlapping regions A1, the overlapping regions B1, and the overlapping regions B, while the refrigerant moves back and forth between the fourth liquid-side member 44 and the fifth liquid-side member 45.

(7-4) Modification D

Figure 21:
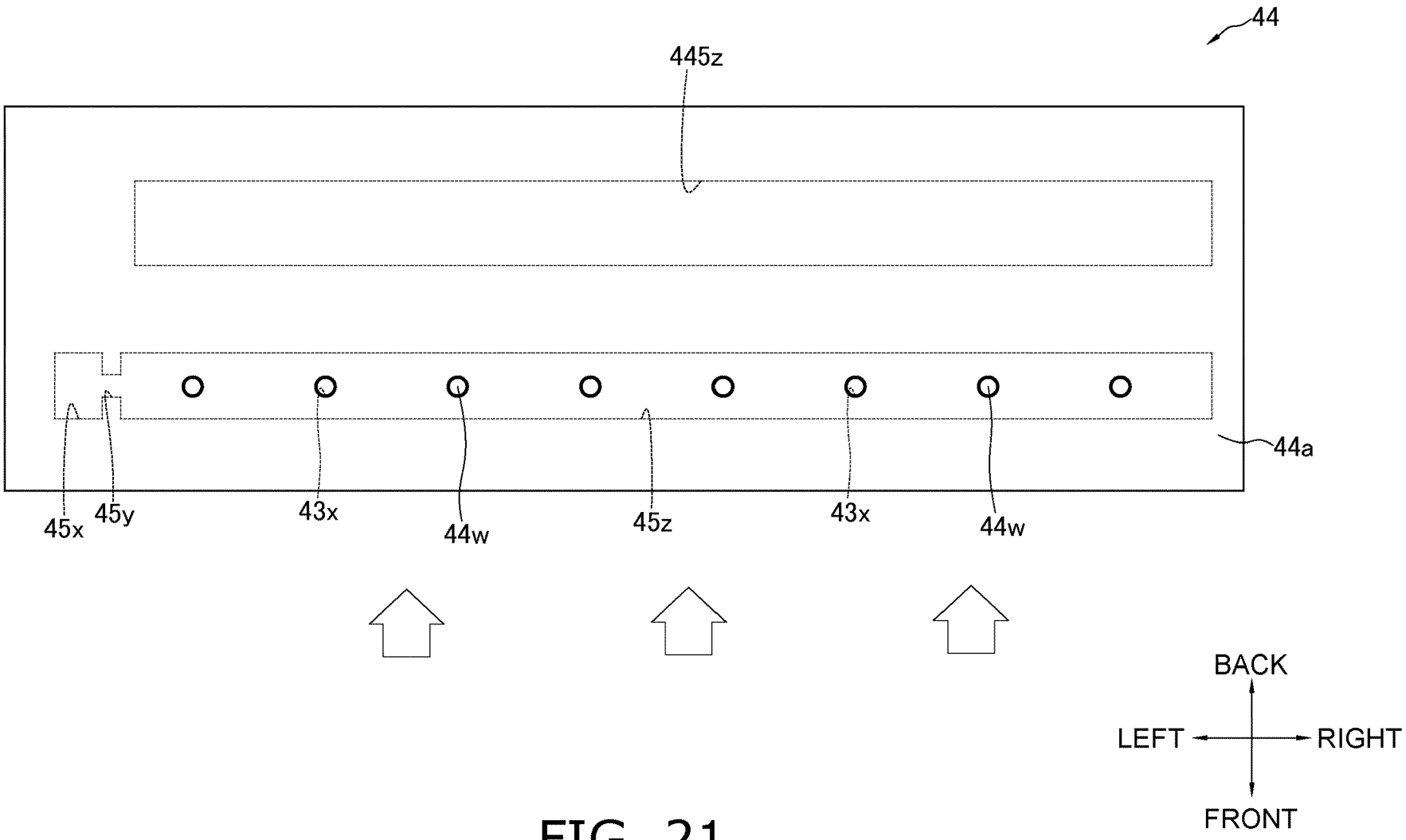
FIG. 21 is a top schematic view of a fourth liquid-side member according to Modification D.
Figure 22:
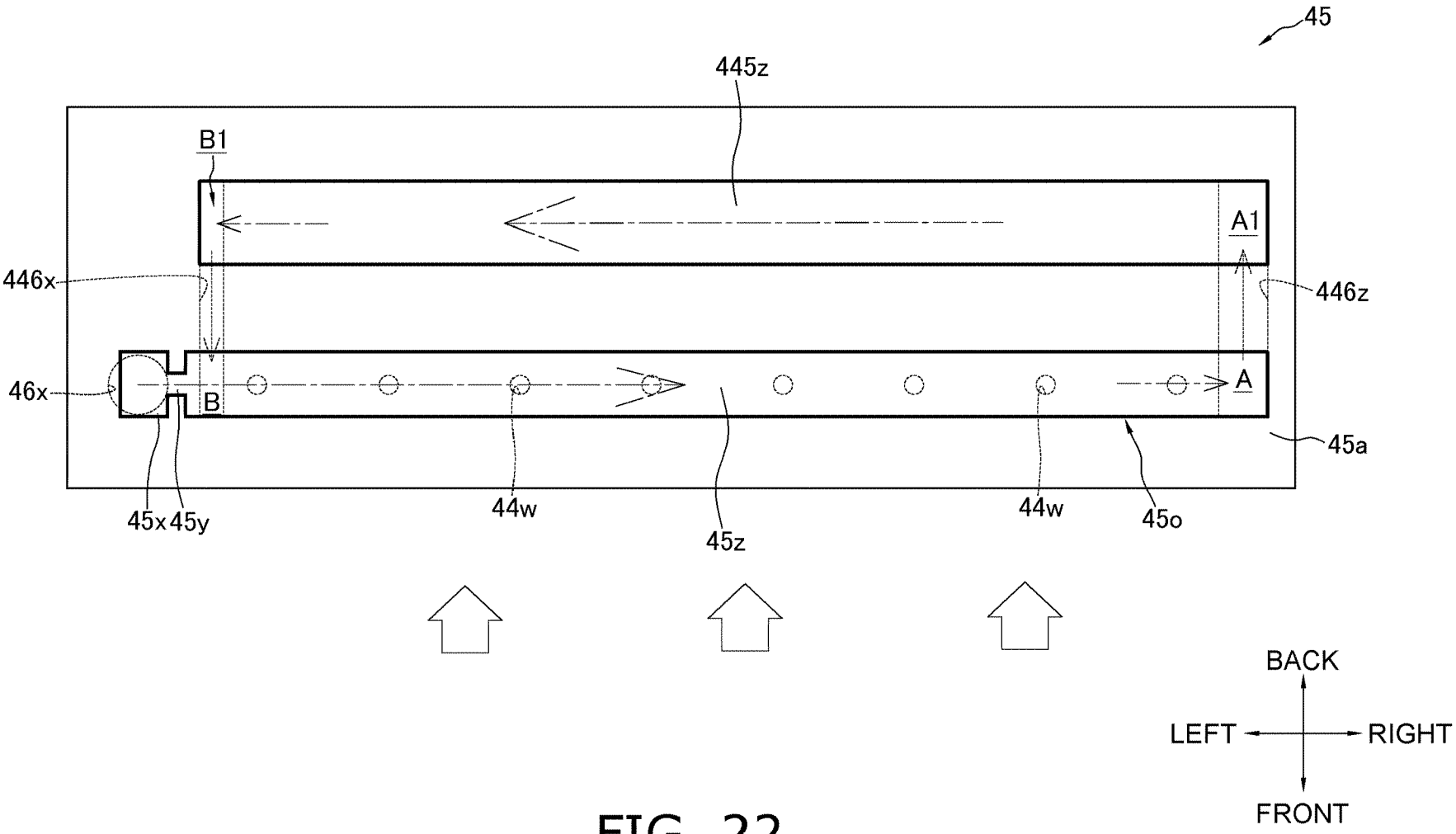
FIG. 22 is a top schematic view of a fifth liquid-side member according to Modification D.
Figure 23:
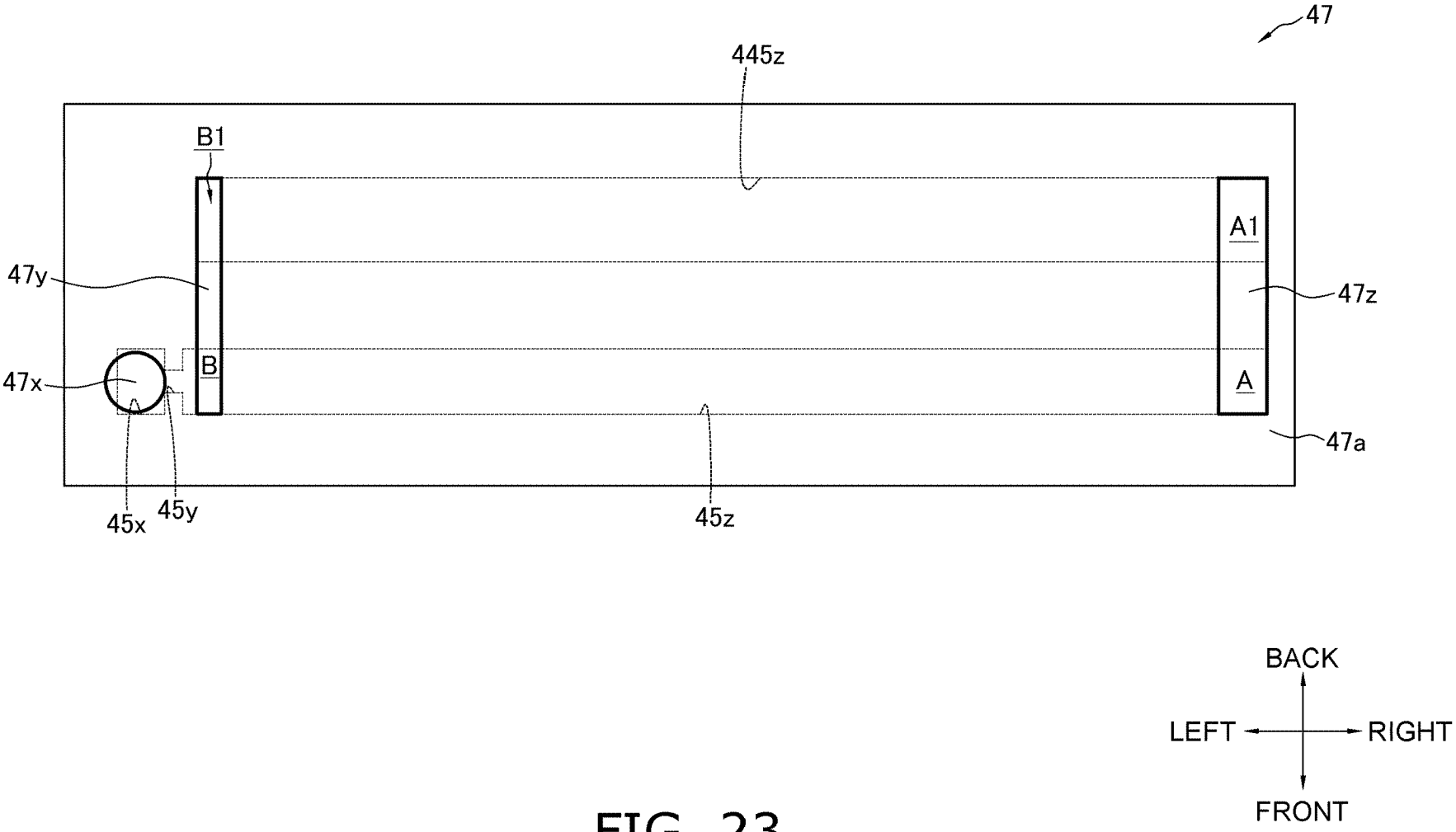
FIG. 23 is a top schematic view of a sixth liquid-side member according to Modification D.

For example, as shown in FIGS. 21, 22, and 23, the fourth liquid-side member 44 may not have the fourth liquid-side opening 44*o* of the embodiments described above, the fifth liquid-side member 45 (an example of a second member) may have an intermediate connection space 445*z* (an example of a second opening) extending parallel to the blowing space 45*z* behind the blowing space 45*z* (an example of a second opening), and a seventh liquid-side member 47 (an example of a first member) including a seventh plate-shaped portion 47*a* (an example of a first plate-shaped portion) may be further provided between the fifth liquid-side member 45 and the sixth liquid-side member 46 of the embodiments described above. Here, the seventh liquid-side member 47 has a connection opening 47*x* provided near a left end portion, a left connection space 47*y* (an example of a first opening) extending in the front-back direction on the right side of the connection opening 47*x*, and a right connection space 47*z* (an example of a first opening) extending in the front-back direction near a right end portion. The connection opening 47*x* allows the external liquid-pipe connection opening 46*x* of the sixth liquid-side member 46 and the introduction space 45*x* of the fifth liquid-side member 45 to communicate with each other.

In this case, in plan view, an overlapping region A that is the right end portion of the blowing space 45*z* and an overlapping region A that is a front end portion of the right connection space 47*z* overlap each other, and an overlapping region B that is the left end portion of the blowing space 45*z* and an overlapping region B that is a front end portion of the left connection space 47*y* overlap each other. Further, in plan view, an overlapping region A1 that is a right end portion of the intermediate connection space 445*z* and an overlapping region A1 that is a back end portion of the right connection space 47*z* overlap each other, and an overlapping region B1 that is a left end portion of the intermediate connection space 445*z* and an overlapping region B1 that is a back end portion of the left connection space 4'7*y* overlap each other.

Even in this case, it is possible to cause a refrigerant to flow so as to circulate in the blowing space 45*z*, the right connection space 47*z*, the intermediate connection space 445*z*, and the left connection space 47*y* via the overlapping regions A, the overlapping regions A1, the overlapping regions B1, and the overlapping regions B, while the refrigerant moves back and forth between the fifth liquid-side member 45 and the seventh liquid-side member 47.

(7-5) Modification E

Figure 24:
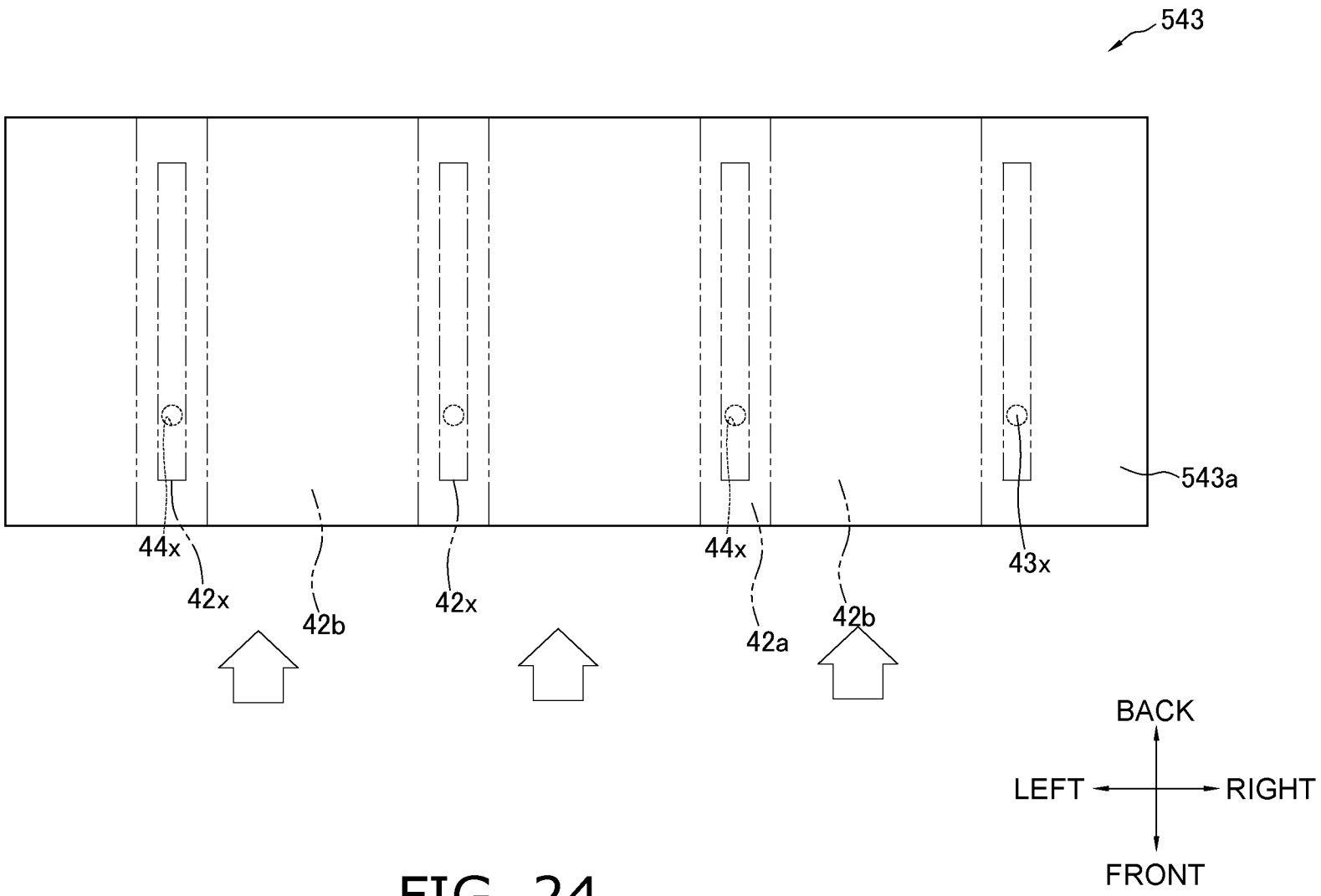
FIG. 24 is a top schematic view of a third liquid-side member according to Modification E.
Figure 25:
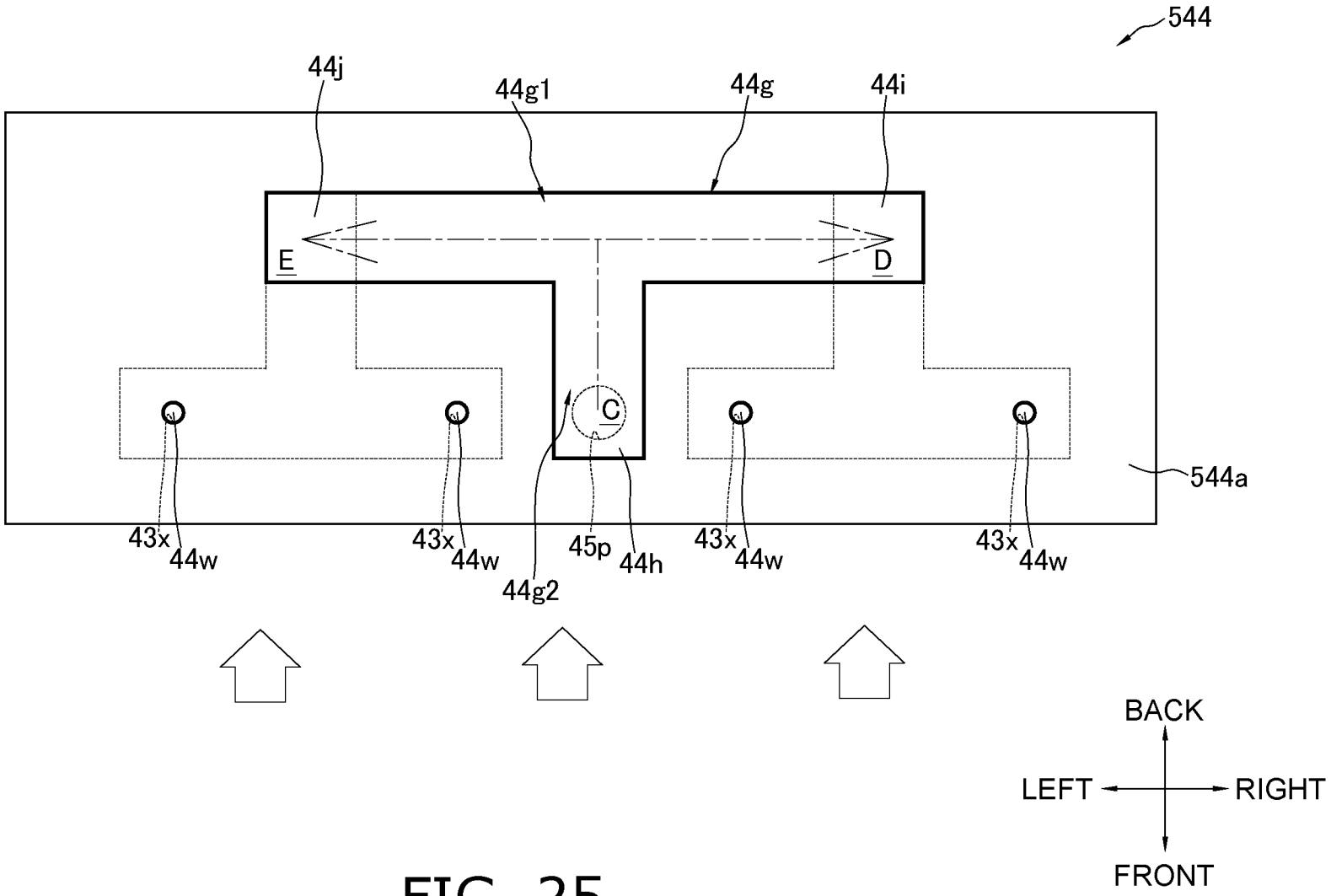
FIG. 25 is a top schematic view of a fourth liquid-side member according to Modification E.
Figure 26:
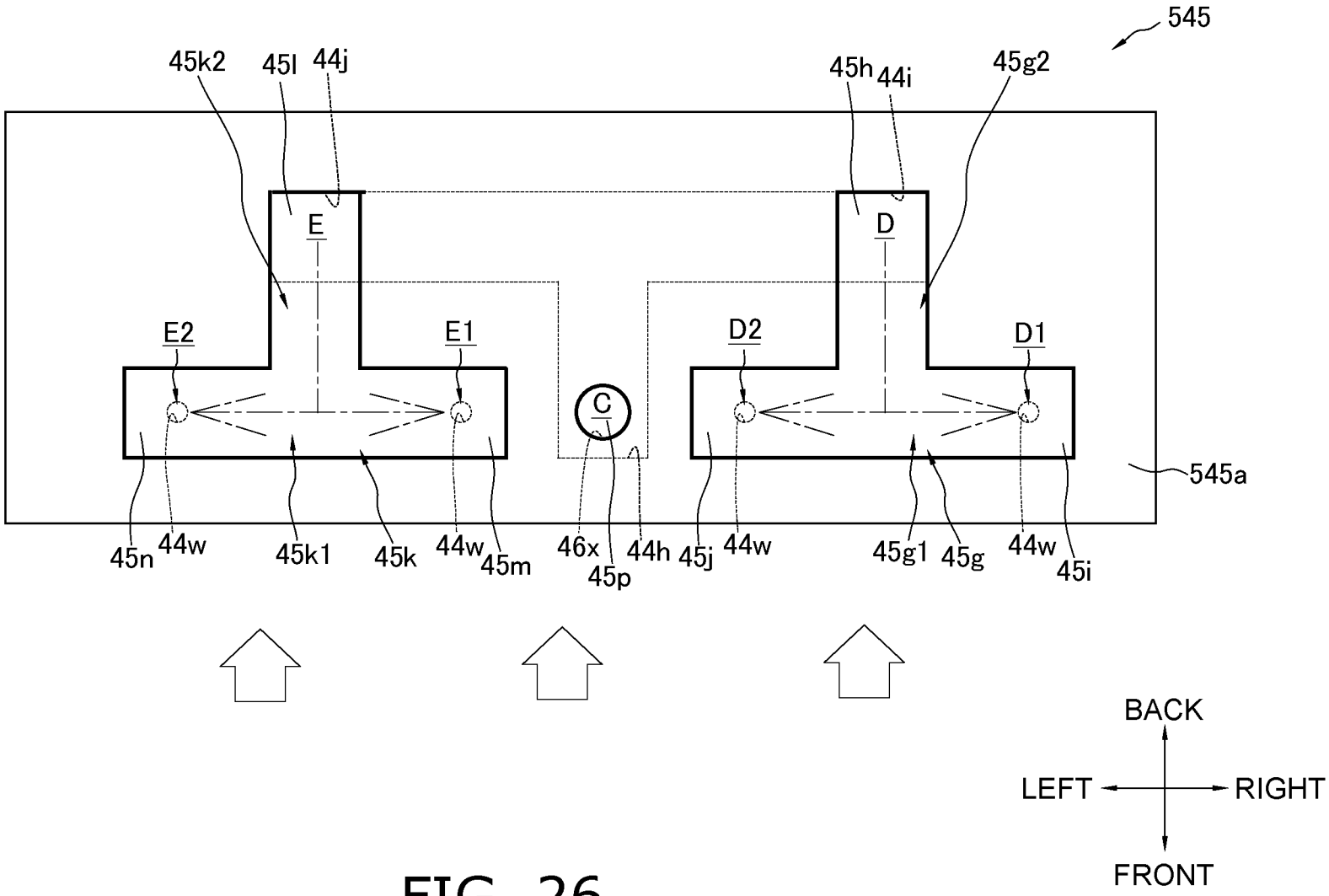
FIG. 26 is a top schematic view of a fifth liquid-side member according to Modification E.
Figure 27:
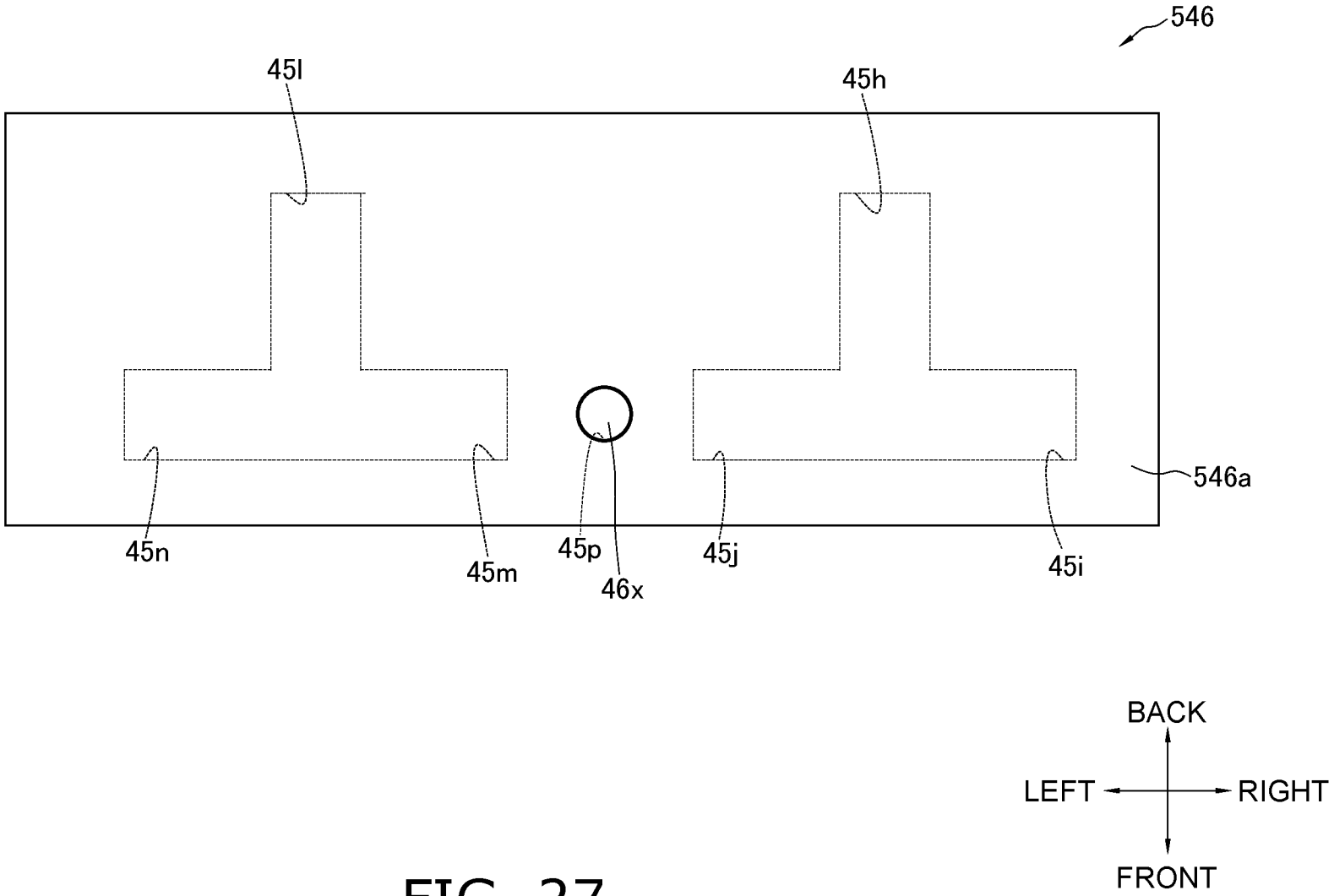
FIG. 27 is a top schematic view of a sixth liquid-side member according to Modification E.

For example, instead of the third liquid-side member 43, the fourth liquid-side member 44, the fifth liquid-side member 45, and the sixth liquid-side member 46 of one or more embodiments, a third liquid-side member 543 shown in FIG. 24, a fourth liquid-side member 544 shown in FIG. 25, a fifth liquid-side member 545 shown in FIG. 26, and a sixth liquid-side member 546 shown in FIG. 27 may be used.

Here, as in the embodiments described above, the third liquid-side member 543 includes a third internal plate 543*a* and a plurality of third flow-dividing openings 43*x*. The fourth liquid-side member 544 (an example of a second member) includes a fourth internal plate 544*a* (an example of a second plate-shaped portion), a fourth liquid-side opening 44*g* (an example of a second opening, an example of an eleventh opening) that does not overlap the third flow-dividing openings 43*x* in plan view, and a plurality of fourth flow-dividing openings 44*w* (an example of twelfth openings) that overlap the plurality of third flow-dividing openings 43*x* in plan view. The fourth liquid-side opening 44*g* includes a portion 44*g*1 (an example of a third opening portion) extending in the left-right direction up to a region 44*j* from a region 44*i*, and a portion 44*g*2 extending toward the front up to a region 44*h* from the center in the left-right direction. The fifth liquid-side member 545 (an example of a first member) includes a fifth internal plate 545*a* (an example of a first plate-shaped portion), a connection opening 45*p* (an example of a fifteenth opening), a right fifth liquid-side opening 45*g* (an example of a first opening, an example of a thirteenth opening), and a left fifth liquid-side opening 45*k* (an example of a first opening, an example of a fourteenth opening). In plan view, the connection opening 45*p* overlaps the region 44*h* of the fourth liquid-side opening 44*g* of the fourth liquid-side member 44 at overlapping regions C. The right fifth liquid-side opening 45*g* includes a portion 45*g*1 (an example of a first opening portion) extending in the left-right direction up to a region 45*j* from a region 45*i* and a portion 45*g*2 (an example of a second opening portion) extending toward the back up to a region 45*h* from the center in the left-right direction. The left fifth liquid-side opening 45*k* includes a portion 45*k*1 (an example of a first opening portion) extending in the left-right direction up to a region 45*n* from a region 45*m* and a portion 45*k*2 (an example of a second opening portion) extending toward the back up to a region 45*l* from the center in the left-right direction. In plan view, the region 45*h* of the right fifth liquid-side opening 45*g* overlaps the region 44*i* of the fourth liquid-side opening 44*g* at overlapping regions D (an example of first regions). In plan view, the region 45*i* of the right fifth liquid-side opening 45*g* overlaps one fourth flow-dividing opening 44*w* at overlapping regions D1 (an example of second regions), and the region 45*j* of the right fifth liquid-side opening 45*g* overlaps a different fourth flow-dividing opening 44*w* at overlapping regions D2 (an example of second regions). In plan view, the region 45*l* of the left fifth liquid-side opening 45*k* overlaps the region 44*j* of the fourth liquid-side opening 44*g* at overlapping regions E (an example of first regions). In plan view, the region 45*m* of the left fifth liquid-side opening 45*k* overlaps one fourth flow-dividing opening 44*w* at overlapping regions E1 (an example of second regions), and the region 45*n* of the left fifth liquid-side opening 45*k* overlaps a different fourth flow-dividing opening 44*w* at overlapping regions E2 (an example of second regions). The sixth liquid-side member 546 includes a liquid-side external plate 546*a*, and the external liquid-pipe connection opening 46*x* that is an opening to which the liquid-refrigerant pipe 20 is connected and that overlaps the connection opening 45*p* of the fifth liquid-side member 45 in plan view.

When the outdoor heat exchanger 11 including the liquid header 40 of the present modification functions as an evaporator of a refrigerant, a refrigerant flows as follows. First, a refrigerant that has flowed in the liquid-refrigerant pipe 20 flows through the external liquid-pipe connection opening 46*x* of the sixth liquid-side member 546 and the connection opening 45*p* of the fifth liquid-side member 545, and flows into the region 44*h* of the fourth liquid-side opening 44*g* of the fourth liquid-side member 544, which is the overlapping region C. The refrigerant that has flowed into the region 44*h* of the fourth liquid-side opening 44*g* flows by being branched into a portion on a side of the region 44*i* and a portion on a side of the region 44*j* at the fourth liquid-side opening 44*g*. The portion of the refrigerant that has flowed to the region 44*i* of the fourth liquid-side opening 44*g* flows to the region 45*h* of the right fifth liquid-side opening 45*g* of the fifth liquid-side member 545 at the overlapping regions D. The portion of the refrigerant that has flowed into the region 45*h* of the right fifth liquid-side opening 45*g* flows by being branched into a portion on a side of the region 45*i* and a portion on a side of the region 45*j* at the right fifth liquid-side opening 45*g*. The portion of the refrigerant that has flowed to the region 45*i* of the right fifth liquid-side opening 45*g* flows to one fourth flow-dividing opening 44*w* of the fourth liquid-side member 544 at the overlapping regions D1. The portion of the refrigerant that has flowed to the region 45*j* of the right fifth liquid-side opening 45*g* flows to a different fourth flow-dividing opening 44*w* of the fourth liquid-side member 544 at the overlapping regions D2. The portion of the refrigerant that has flowed to the region 44*j* of the fourth liquid-side opening 44*g* flows to the region 45*l* of the left fifth liquid-side opening 45*k* of the fifth liquid-side member 545 at the overlapping regions E. The portion of the refrigerant that has flowed into the region 45*l* of the left fifth liquid-side opening 45*k* flows by being branched into a portion on a side of the region 45*m* and a portion on a side of the region 45*n* at the left fifth liquid-side opening 45*k*. The portion of the refrigerant that has flowed to the region 45*m* of the left fifth liquid-side opening 45*k* flows to one fourth flow-dividing opening 44*w* of the fourth liquid-side member 544 at the overlapping regions E1. The portion of the refrigerant that has flowed to the region 45*n* of the left fifth liquid-side opening 45*k* flows to a different fourth flow-dividing opening 44*w* of the fourth liquid-side member 544 at the overlapping regions E2. Then, the portions of the refrigerant that have flowed in the respective fourth flow-dividing openings 44*w* of the fourth liquid-side member 544 flow to a corresponding one of the flat tubes 28 via a corresponding one of the third flow-dividing openings 43*x* of the third liquid-side member 543 and a corresponding one of the communication holes 42*x* of the second liquid-side member 42.

In the liquid header 40 above, the refrigerant that has passed through the fifth liquid-side member 545 flows in the fourth liquid-side member 544, then returns to the fifth liquid-side member 545 again, and flows in the fourth liquid-side member 544 again. In this way, since it is possible to cause a refrigerant to move back and forth a plurality of times between each plate-shaped member via the overlapping regions C, the overlapping regions D, the overlapping regions E, the overlapping regions D1, the overlapping regions D2, the overlapping regions E1, and the overlapping regions E2, it is possible to effectively mix a liquid refrigerant and a gas refrigerant.

For example, for a structure in which the number of flow path branched increases toward one side of the stacking direction of the plurality of plate-shaped members, since a refrigerant flows toward only this one side, a portion at which the refrigerant tends to be retained tends to be produced. In contrast, in the liquid header 40 of the present modification, since the refrigerant flow path can be branched while causing a refrigerant to move back and forth a plurality of times between each plate-shaped member, it is possible to divide the flow of the refrigerant while suppressing the refrigerant from being retained.

(7-6) Modification F

In the embodiments described above, an example in which below the liquid header 40 in the up-down direction, which is the stacking direction, the liquid-refrigerant pipe 20 is connected via the external liquid-pipe connection opening 46*x* of the sixth liquid-side member 46 is given and described.

Figure 28:
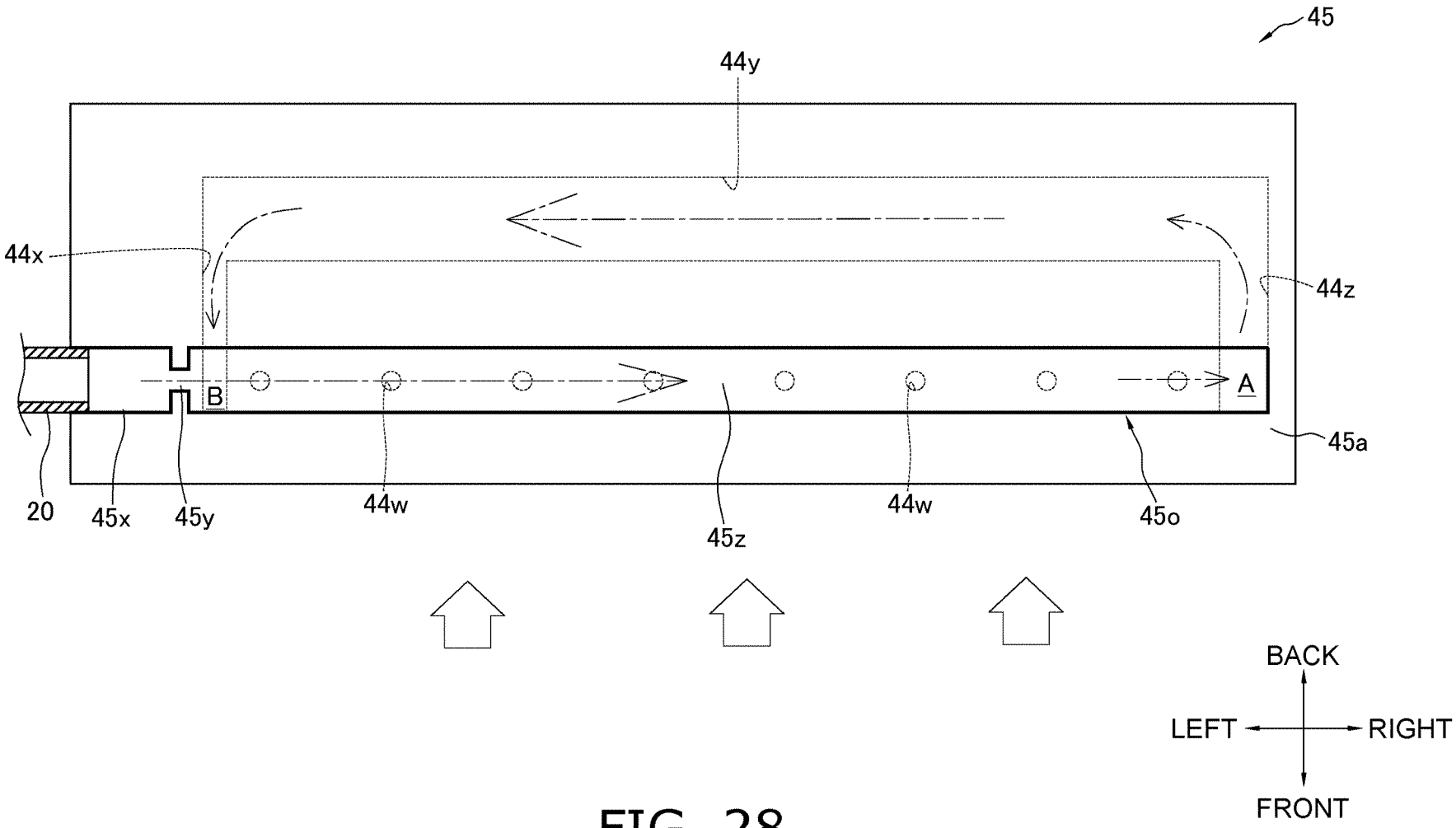
FIG. 28 is a top schematic view of a fifth liquid-side member according to Modification F.

In contrast, the connection mode of the liquid-refrigerant pipe 20 to the liquid header 40 is not limited thereto. For example, with the sixth liquid-side member 46 of the embodiments described above being formed as a plate-shaped member without openings, as shown in FIG. 28, the fifth liquid-side member 45 of the embodiments described above may have its introduction space 45*x* extended up to an end portion of the fifth liquid-side member 45 in the longitudinal direction thereof and the liquid-refrigerant pipe 20 may be connected to an end portion of the introduction space 45*x*.

(7-7) Modification G

In the embodiments described above, an example in which the longitudinal direction of the liquid header 40 is a horizontal direction is given and described.

In contrast, the longitudinal direction of the liquid header 40 may be a direction that is tilted within ±45 degrees or within ±30 degrees with respect to a horizontal plane.

Even in this case, in a flow of a refrigerant that circulates in the liquid header 40, if the flow of the refrigerant that returns to the blowing space 45*z* is in a direction that does not oppose gravity, as in the embodiments described above, the refrigerant easily returns to the blowing space 45*z* and a circulation flow of the refrigerant in the liquid header can be reliably produced.

(7-8) Modification H

In the embodiments described above, an example in which the longitudinal direction of the flat tubes 28 extending from the liquid header 40 is a vertical direction is given and described.

Figure 29:
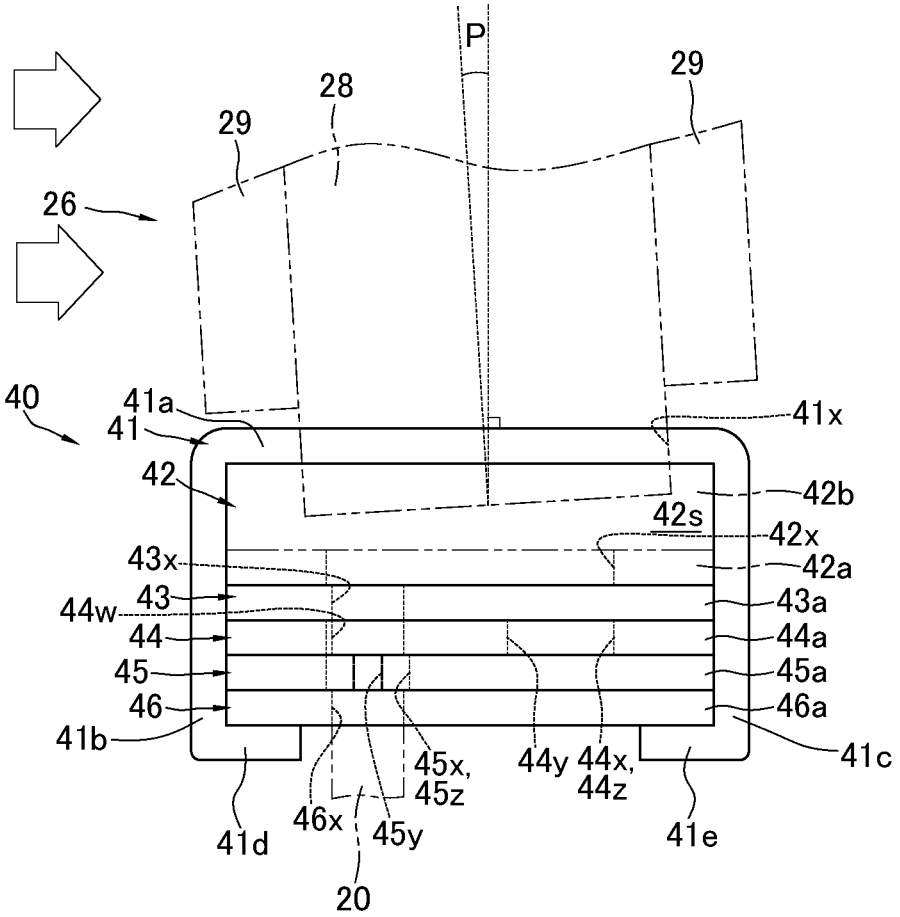
FIG. 29 is a structural view of an arrangement of a liquid header according to Modification H to which the heat transfer portion and the liquid-refrigerant pipe are connected when viewed in the longitudinal direction of the liquid header.
Figure 29:
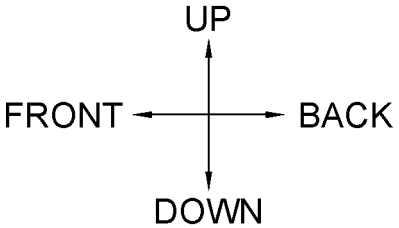

In contrast, for example, as shown in FIG. 29, the longitudinal direction of the flat tubes 28 extending from the liquid header 40 may be a direction that is tilted by a predetermined angle P with respect to the vertical direction when viewed in the longitudinal direction of the liquid header 40. The predetermined angle P may be, for example, a tilt angle within ±45 degrees or a tilt angle within ±30 degrees with respect to the vertical direction.

(7-9) Modification I

In the embodiments described above, an example in which the stacking direction of stacking the liquid-side flat-tube connection plate 41*a* of the first liquid-side member 41, the second liquid-side member 42, the third liquid-side member 43, the fourth liquid-side member 44, the fifth liquid-side member 45, and the sixth liquid-side member 46 of the liquid header 40 is a vertical direction, and in which the longitudinal direction of the flat tubes 28 is a vertical direction is given and described.

Figure 30:
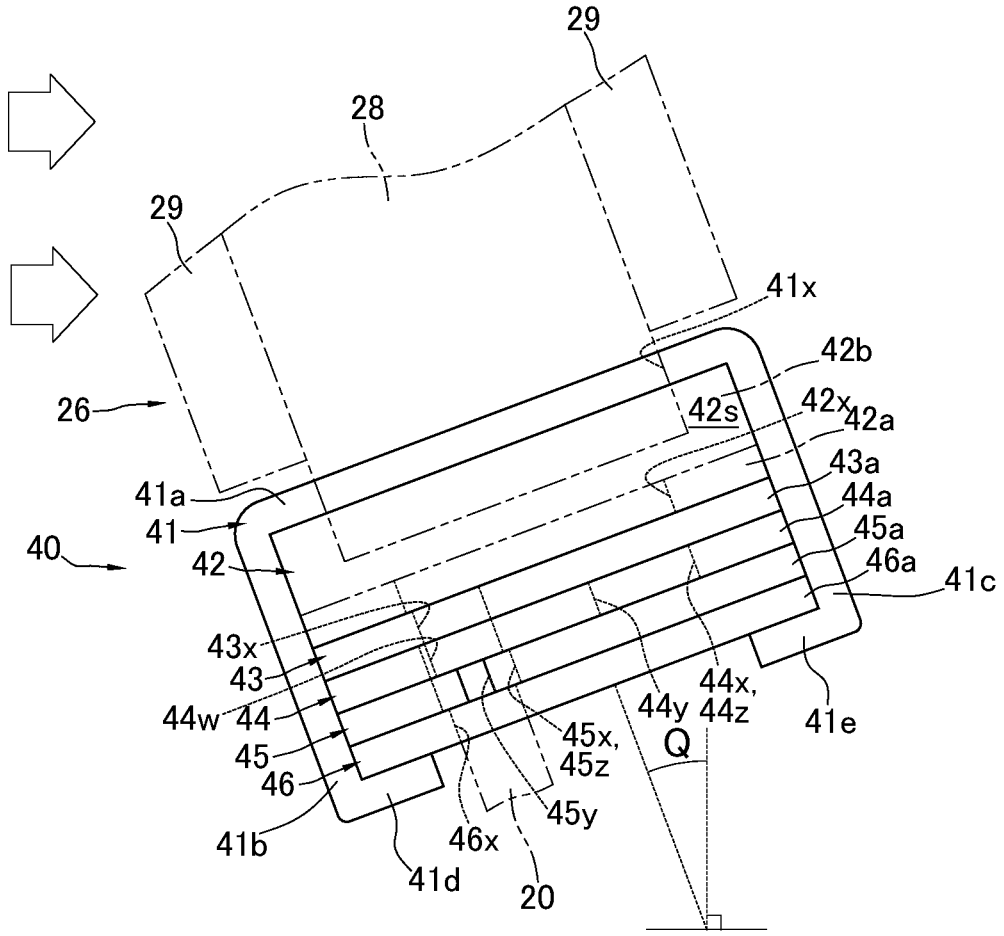
FIG. 30 is a structural view of an arrangement of a liquid header according to Modification I to which the heat transfer portion and the liquid-refrigerant pipe are connected when viewed in the longitudinal direction of the liquid header.
Figure 30:
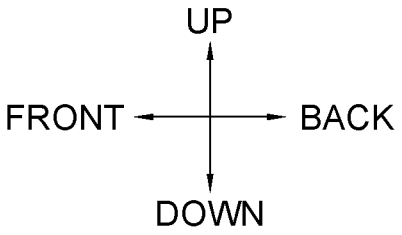

In contrast, for example, as shown in FIG. 30, the liquid header 40 may be such that the stacking direction of stacking the liquid-side flat-tube connection plate 41*a* of the first liquid-side member 41, the second liquid-side member 42, the third liquid-side member 43, the fourth liquid-side member 44, the fifth liquid-side member 45, and the sixth liquid-side member 46 is a direction that is tilted by a predetermined angle Q with respect to the vertical direction when viewed in the longitudinal direction of the liquid header 40. The predetermined angle Q may correspond to a direction that is tilted within ±45 degrees or within ±30 degrees with respect to the vertical direction.

In this case, the longitudinal direction of the flat tubes 28 may similarly be a direction that is tilted by the predetermined angle Q with respect to the vertical direction. Alternatively, the longitudinal direction of the flat tubes 28 not may be the same as the stacking direction, or may be, for example, tilted by a predetermined angle with respect to the stacking direction when viewed in the longitudinal direction of the liquid header 40.

(7-10) Modification J

In the embodiments described above, the outdoor heat exchanger 11 whose direction of flow of a refrigerant in the flat tubes 28 is an up-down direction and that includes the liquid header 40 having a structure in which a refrigerant moves back and forth between the fourth liquid-side member 44 and the fifth liquid-side member 45, whose surfaces contact each other and that are disposed adjacent to each other, in the liquid header 40 is given as an example and described.

In contrast, as described below, an outdoor heat exchanger 611 including a liquid header 30 having a structure in which a refrigerant moves back and forth between plate members that do not directly contact each other may be used. Here, in the outdoor heat exchanger 611, the direction of flow of a refrigerant in the flat tubes 28 can be a horizontal direction. The outdoor heat exchanger 611 according to Modification J is described in detail below.

(7-10-1) Structure of Outdoor Heat Exchanger

A structure of the outdoor heat exchanger 611 is described with reference to the drawings.

Figure 31:
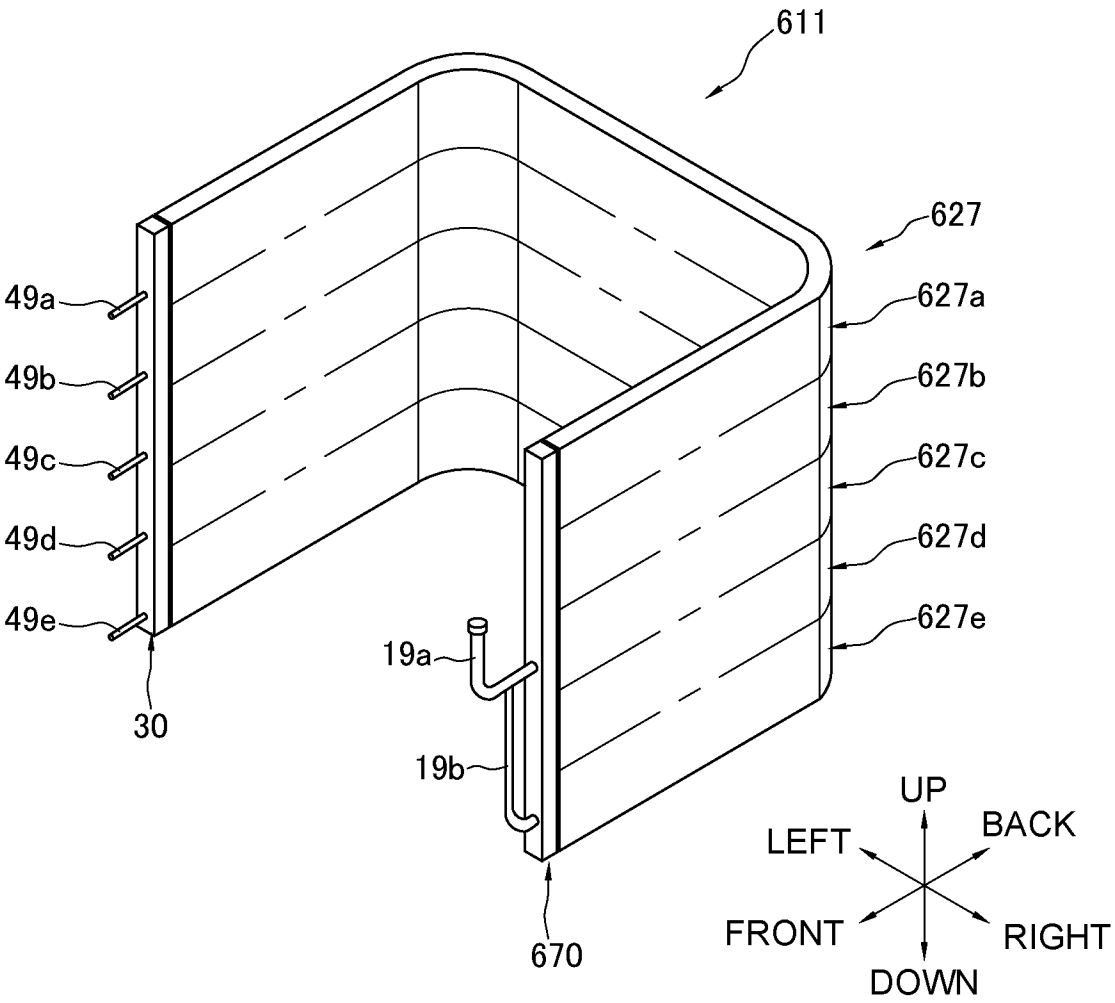
FIG. 31 is a schematic perspective view of an outdoor heat exchanger according to Modification J.
Figure 32:
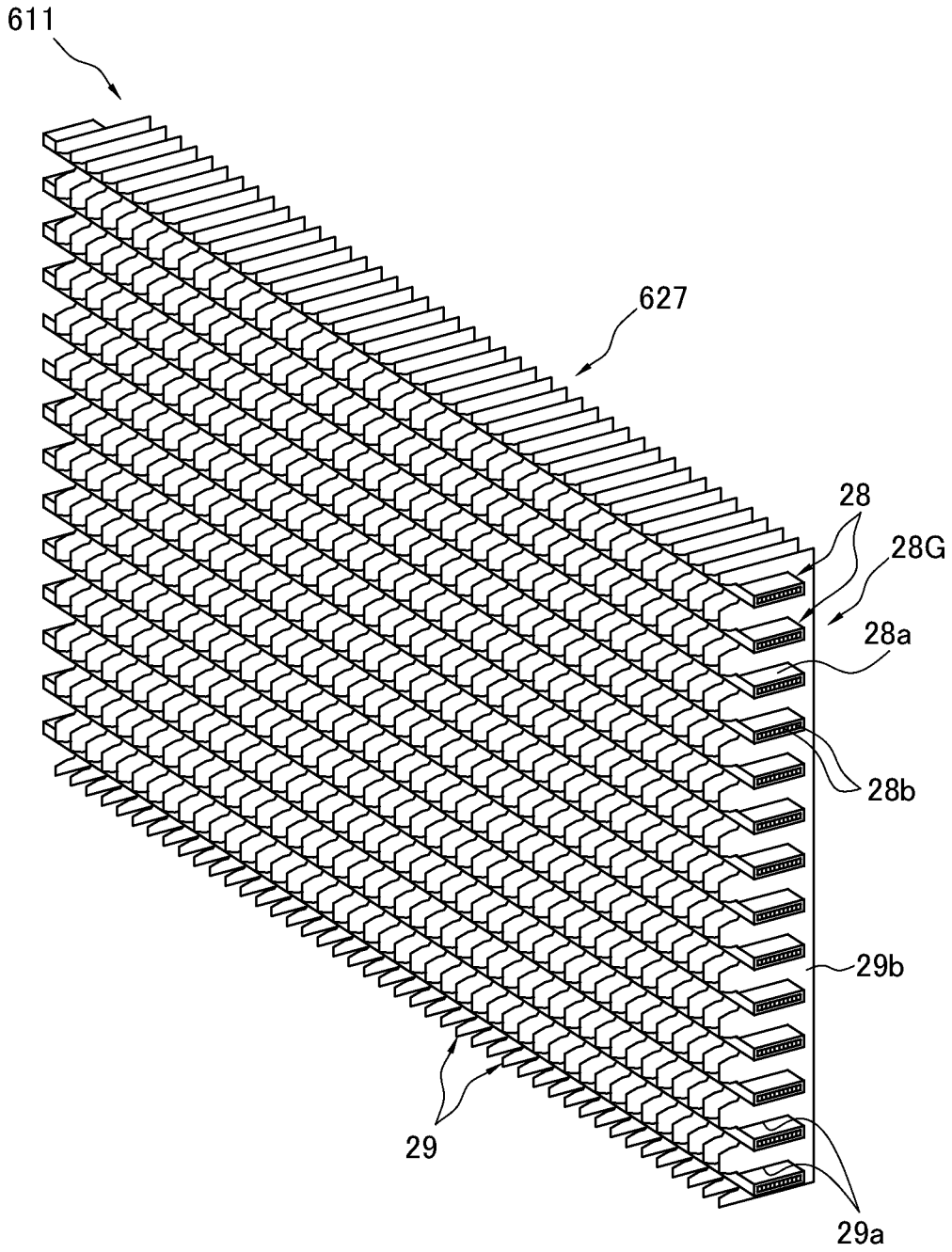
FIG. 32 is an enlarged view of a portion of a heat exchange portion of the outdoor heat exchanger according to Modification J.
Figure 33:
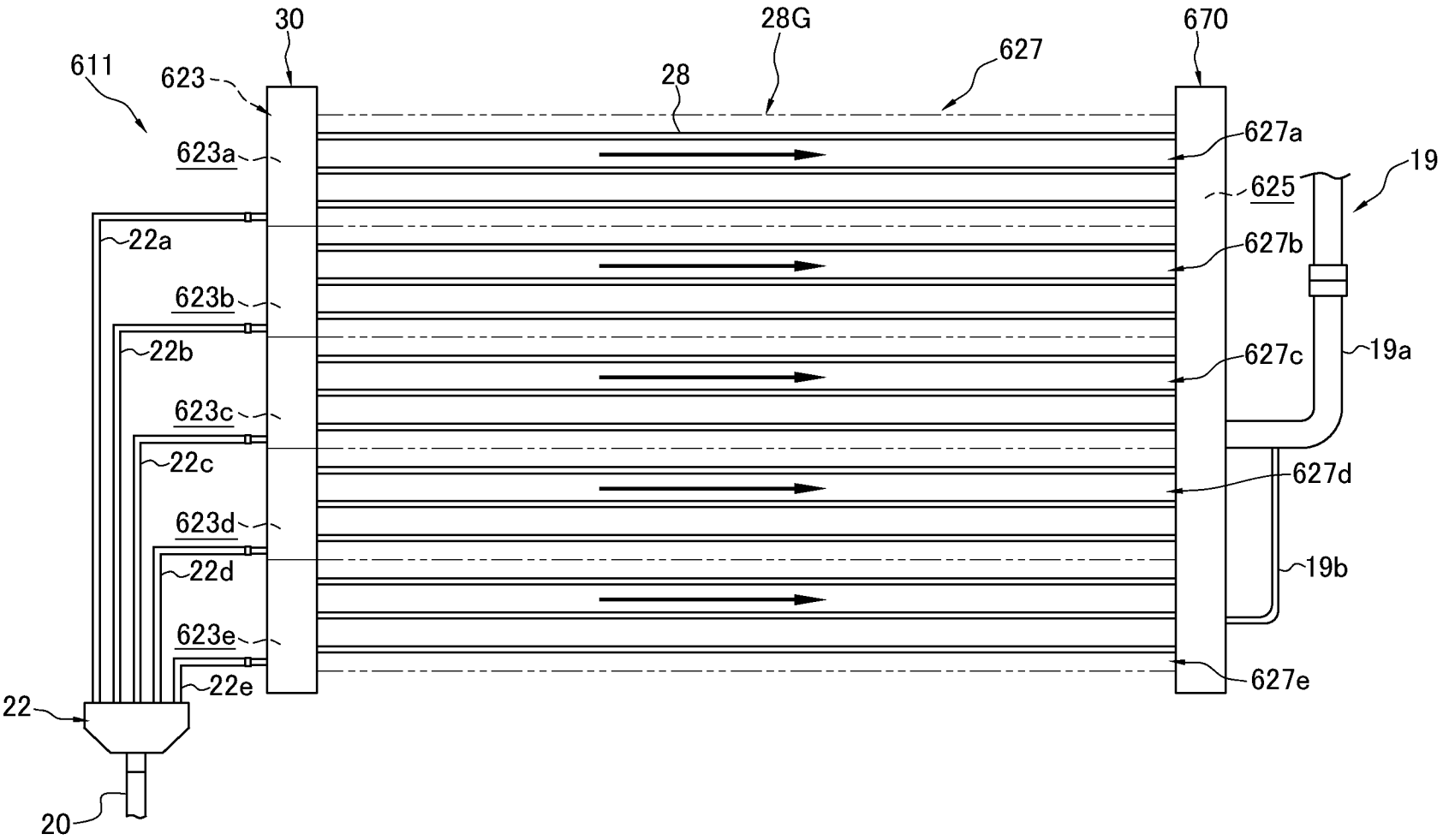
FIG. 33 is an explanatory view showing a state of flow of a refrigerant in the outdoor heat exchanger functioning as an evaporator of the refrigerant according to Modification J.

FIG. 31 is a schematic perspective view of the outdoor heat exchanger 611. FIG. 32 is an enlarged view of a portion of a heat exchange portion 627 (described below) of the outdoor heat exchanger 611. FIG. 33 is a schematic structural view of the outdoor heat exchanger 611. The arrows in the heat exchange portion 627 shown in FIG. 33 indicate flow of a refrigerant at the time of a heating operation (when the outdoor heat exchanger 611 functions as an evaporator).

Note that, in the description of Modification J, for describing an orientation and a position, terms, such as "up", "down", "left", "right", "front (front side)", or "back (back side)" may be used. Unless otherwise specified, these terms are in conformity with the directions of the arrows shown in FIG. 31. Note that these terms that indicate these orientation and positions are used for convenience of explanation, and, unless otherwise specified, the orientation and the position of the entire outdoor heat exchanger 611 and the orientation and the position of each structure of the outdoor heat exchanger 611 are not to be determined by the orientations and the positions indicated by the stated terms.

The outdoor heat exchanger 611 (an example of a heat exchanger) is a device that causes heat to be exchanged between a refrigerant that flows therein and air.

The outdoor heat exchanger 611 primarily includes a flow divider 22, a flat tube group 28G including a plurality of flat tubes 28, a plurality of fins 29, a liquid header 30 (an example of a header), and a gas header 670 (see FIG. 33). In one or more embodiments, the flow divider 22, the flat tubes 28, the fins 29, the liquid header 30, and the gas header 670 are all made of aluminum or an aluminum alloy.

As described below, the flat tubes 28 and the fins 29 that are fixed to the flat tubes 28 form the heat exchange portion 627 (see FIG. 32). The outdoor heat exchanger 611 is a device including the one-column heat exchange portion 627, and is not a device in which the plurality of flat tubes 28 are disposed side by side in an air flow direction. In the outdoor heat exchanger 611, by causing air to flow in a ventilation path that is formed by the flat tubes 28 and the fins 29 of the heat exchange portion 627, a refrigerant that flows in the flat tubes 28 exchanges heat with the air that flows in the ventilation path. The heat exchange portion 627 is divided into a first heat exchange portion 627*a*, a second heat exchange portion 627*b*, a third heat exchange portion 627*c*, a fourth heat exchange portion 627*d*, and a fifth heat exchange portion 627*e*, which are disposed side by side in an up-down direction (see FIG. 31).

(7-10-1-1)) Flow Divider

The flow divider 22 is a mechanism that divides flow of a refrigerant. The flow divider 22 is also a mechanism that merges refrigerants. The liquid-refrigerant pipe 20 is connected to the flow divider 22. The flow divider 22 includes a plurality of flow dividing pipes 22*a* to 22*e*. The flow divider 22 has the function of dividing flow of a refrigerant that has flowed into the flow divider 22 from the liquid-refrigerant pipe 20 by the plurality of flow dividing pipes 22*a* to 22*e* and of guiding the separated portions of the refrigerant to a plurality of spaces that are formed in the liquid header 30. The flow divider 22 also has the function of merging the portions of the refrigerant that have flowed through the flow dividing pipes 22*a* to 22*e* from the liquid header 30 and of guiding the merged portions of the refrigerant to the liquid-refrigerant pipe 20. Specifically, the flow dividing pipes 22*a* to 22*e* and the plurality of spaces in the liquid header 30 are connected to each other via a corresponding one of branch liquid-refrigerant connection pipes 49*a* to 49*e*.

(7-10-1-2) Flat Tube Group

The flat tube group 28G is an example of a heat transfer tube group. The flat tube group 28G includes the plurality of flat tubes 28 as a plurality of heat transfer tubes. As shown in FIG. 32, the flat tubes 28 are flat heat transfer tubes having flat surfaces 28*a*, which are heat transfer surfaces, in the up-down direction. As shown in FIG. 32, the flat tubes 28 have a plurality of refrigerant passages 28*b* in which a refrigerant flows. For example, the flat tubes 28 are flat multi-hole tubes where many refrigerant passages 28*b* in which a refrigerant flows and whose passage cross-sectional area is small are formed. In one or more embodiments, the plurality of refrigerant passages 28*b* are provided side by side in the air flow direction. Note that the maximum width of a cross section of the flat tubes 28 perpendicular to the refrigerant passages 28*b* may be greater than or equal to 70% or greater than or equal to 85% of the outside diameter of a main gas-refrigerant-pipe connection portion 19*a*.

In the outdoor heat exchanger 611, as shown in FIG. 32, the flat tubes 28 extending in a horizontal direction between the liquid header 30 and the gas header 670 are disposed side by side in the up-down direction in a plurality of layers. Note that, in one or more embodiments, the flat tubes 28 extending between the liquid header 30 and the gas header 670 are bent at two locations, and the heat exchange portion 627 that is constituted by the flat tubes 28 is formed in a substantially U shape in plan view (see FIG. 31). In one or more embodiments, the plurality of flat tubes 28 are disposed apart from each other by a certain interval in the up-down direction.

(7-10-1-3) Fins

The plurality of fins 29 are members for increasing the heat transfer area of the outdoor heat exchanger 611. Each fin 29 is a plate-shaped member extending in a direction in which the flat tubes 28 are disposed side by side in layers. The outdoor heat exchanger 611 is used in a mode in which the plurality of flat tubes 28 extending in the horizontal direction are disposed side by side in the up-down direction. Therefore, with the outdoor heat exchanger 611 being installed at the outdoor unit 2, each fin 29 extends in the up-down direction.

As shown in FIG. 32, a plurality of cut portions 29*a* extending in an insertion direction of the flat tubes 28 are formed in each fin 29 to allow the plurality of flat tubes 28 to be inserted therein.

Each fin 29 includes communication portions 29*b* communicating with each other in the up-down direction on an upstream side or a downstream side of the air flow direction with respect to the flat tubes 28. In one or more embodiments, the communication portions 29*b* of the fins 29 are positioned on a windward side with respect to the flat tubes 28.

(7-10-1-4) Gas Header and Liquid Header

The gas header 670 and the liquid header 30 are hollow structures.

As shown in FIG. 33, one end portion of each flat tube 28 is connected to the liquid header 30, and the other end portion of each flat tube 28 is connected to the gas header 670. The outdoor heat exchanger 611 is disposed in the casing (not shown) of the outdoor unit 2 so that longitudinal directions of the liquid header 30 and the gas header 670 are substantially the same as a vertical direction. In one or more embodiments, as shown in FIG. 31, the heat exchange portion 627 of the outdoor heat exchanger 611 has a U shape in plan view. The liquid header 30 is disposed near a left front corner of the casing (not shown) of the outdoor unit 2 (see FIG. 31). The gas header 670 is disposed near a right front corner of the casing (not shown) of the outdoor unit 2 (see FIG. 31).

(7-10-1-4-1) Gas Header

The main gas-refrigerant-pipe connection portion 19*a* and a branch gas-refrigerant-pipe connection portion 19*b* that constitute an end portion of the first gas-refrigerant pipe 19 on the side of the gas header 670 are connected to the gas header 670 (see FIG. 33). Note that, although not limited, the outside diameter of the main gas-refrigerant-pipe connection portion 19*a* may be, for example, greater than or equal to three times, or greater than or equal to five times the outside diameter of the branch gas-refrigerant-pipe connection portion 19*b*.

One end of the main gas-refrigerant-pipe connection portion 19*a* is connected to the gas header 670 to communicate with a gas-side internal space 625 at an intermediate position on the gas header 670 in a height direction.

One end of the branch gas-refrigerant-pipe connection portion 19*b* is connected to the gas header 670 to communicate with the gas-side internal space 625 near a lower end of the gas header 670 in the height direction. The other end of the branch gas-refrigerant-pipe connection portion 19*b* is connected to the main gas-refrigerant-pipe connection portion 19*a*. With the inside diameter of the branch gas-refrigerant-pipe connection portion 19*b* being smaller than the inside diameter of the main gas-refrigerant-pipe connection portion 19*a* and with the branch gas-refrigerant-pipe connection portion 19*b* being connected to the gas header 670 at a location below the main gas-refrigerant-pipe connection portion 19*a*, the branch gas-refrigerant-pipe connection portion 19*b* is capable of drawing refrigerating-machine oil that is retained near the lower end of the gas header 670 into the main gas-refrigerant-pipe connection portion 19*a*.

(7-10-1-4-2) Liquid Header

A liquid-side internal space 623 of the liquid header 30 is divided into a plurality of sub-spaces 623*a* to 623*e* (see FIG. 33).

The plurality of sub-spaces 623*a* to 623*e* are disposed side by side in the up-down direction. Each of the sub-spaces 623*a* to 623*e* does not communicate with each other in the liquid-side internal space 623 of the liquid header 30.

The branch liquid-refrigerant connection pipes 49*a* to 49*e* connected to the respective flow dividing pipes 22*a* to 22*e* of the flow divider 22 are connected in a one-to-one correspondence with the respective sub-spaces 623*a* to 623*e*. Therefore, in a cooling operation state, portions of a refrigerant that have reached the respective sub-spaces 623*a* to 623*e* flow into the respective branch liquid-refrigerant connection pipes 49*a* to 49*e* and the respective flow dividing pipes 22*a* to 22*e*, and merge at the flow divider 22. In a heating operation state, a refrigerant whose flow has been divided at the flow divider 22 flows into each of the flow dividing pipes 22*a* to 22*e* and each of the branch liquid-refrigerant connection pipes 49*a* to 49*e*, and is supplied to each of the sub-spaces 623*a* to 623*e*.

(7-10-2) Flow of Refrigerant in Outdoor Heat Exchanger

When the air conditioner 1 performs a heating operation and thus the outdoor heat exchanger 611 functions as an evaporator of a refrigerant, a refrigerant in a gas-liquid two-phase state that has reached the flow divider 22 from the liquid-refrigerant pipe 20 flows through the flow dividing pipes 22*a* to 22*e* and flows into each of the sub-spaces 623*a* to 623*e* that constitute the liquid-side internal space 623 of the liquid header 30. Specifically, a portion of the refrigerant that has flowed in the flow dividing pipe 22*a* flows to the sub-space 623*a*, a portion of the refrigerant that has flowed in the flow dividing pipe 22*b* flows to the sub-space 623*b*, a portion of the refrigerant that has flowed in the flow dividing pipe 22*c* flows to the sub-space 623*c*, a portion of the refrigerant that has flowed in the flow dividing pipe 22*d* flows to the sub-space 623*d*, and a portion of the refrigerant that has flowed in the flow dividing pipe 22*e* flows to the sub-space 623*e*. The portions of the refrigerant that have flowed into the respective sub-spaces 623*a* to 623*e* of the liquid-side internal space 623 flow to the corresponding flat tubes 28 connected to a corresponding one of the sub-spaces 623*a* to 623*e*. Portions of the refrigerant flowing in the respective flat tubes 28 exchange heat with air and thus evaporate and become portions of a gas-phase refrigerant, and flow into the gas-side internal space 625 of the gas header 670 to merge with each other.

When the air conditioner 1 performs a cooling operation or a defrost operation, the refrigerant flows in the refrigerant circuit 6 in a direction opposite to that when the air conditioner 1 performs the heating operation. Specifically, a high-temperature gas-phase refrigerant flows into the gas-side internal space 625 of the gas header 670 via the main gas-refrigerant-pipe connection portion 19*a* and the branch gas-refrigerant-pipe connection portion 19*b* of the first gas-refrigerant pipe 19. The refrigerant that has flowed into the gas-side internal space 625 of the gas header 670 is divided and flows into each flat tube 28. Portions of the refrigerant that have flowed into the respective flat tubes 28 pass through the respective flat tubes 28, and flow into a corresponding one of the sub-spaces 623*a* to 623*e* of the liquid-side internal space 623 of the liquid header 30. The portions of the refrigerant that have flowed into the corresponding one of the sub-spaces 623*a* to 623*e* of the liquid-side internal space 623 merge at the flow divider 22 and flow out to the liquid-refrigerant pipe 20.

(7-10-3) Details of Liquid Header

Figure 34:
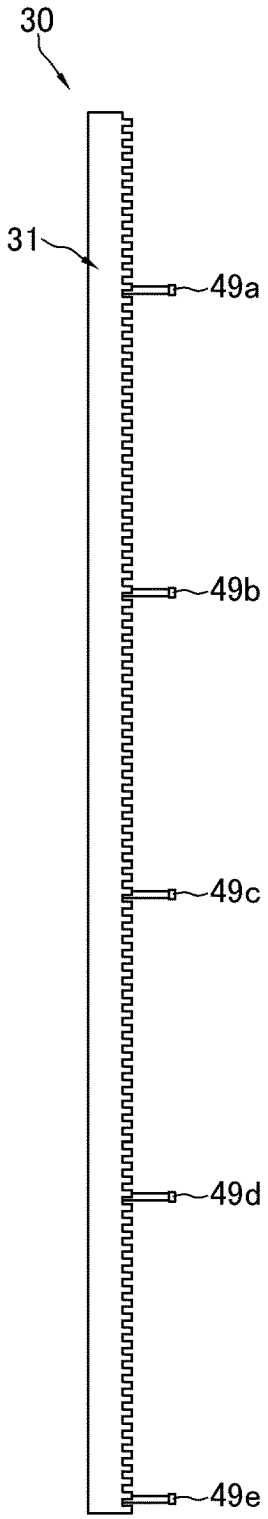
FIG. 34 is a side external structural view showing a state of connection of branch liquid-refrigerant connection pipes to a liquid header according to Modification J.
Figure 35:
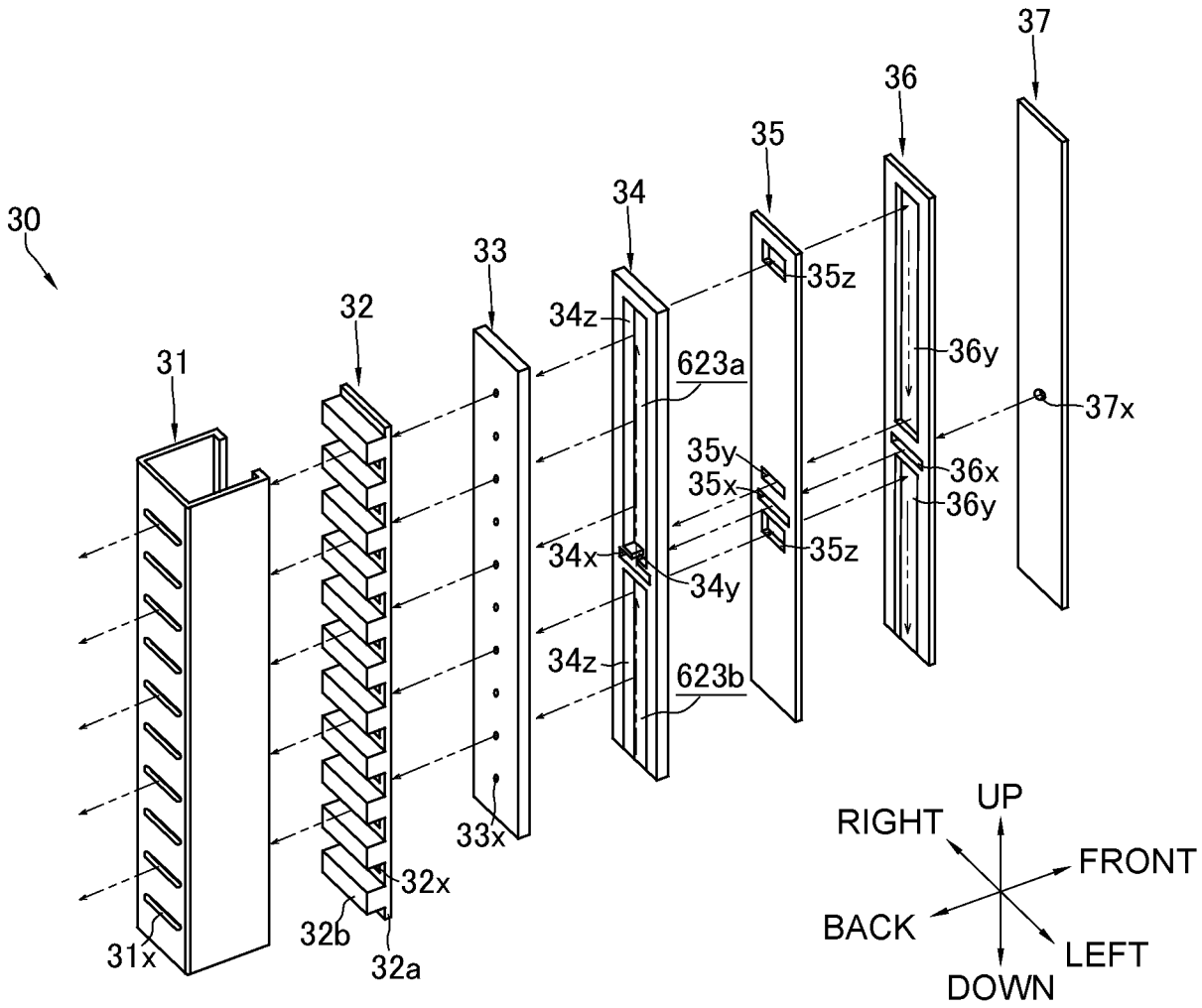
FIG. 35 is an exploded perspective view of a portion of the liquid header according to Modification J near an upper end thereof.
Figure 36:
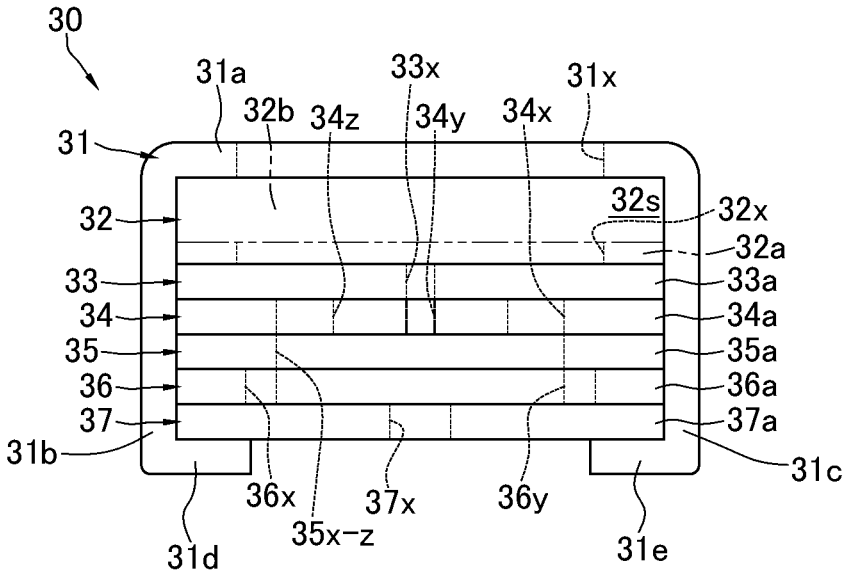
FIG. 36 is a plan sectional view of the liquid header according to Modification J.
Figure 36:
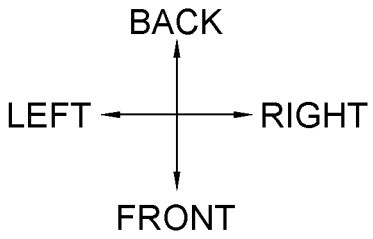
Figure 37:
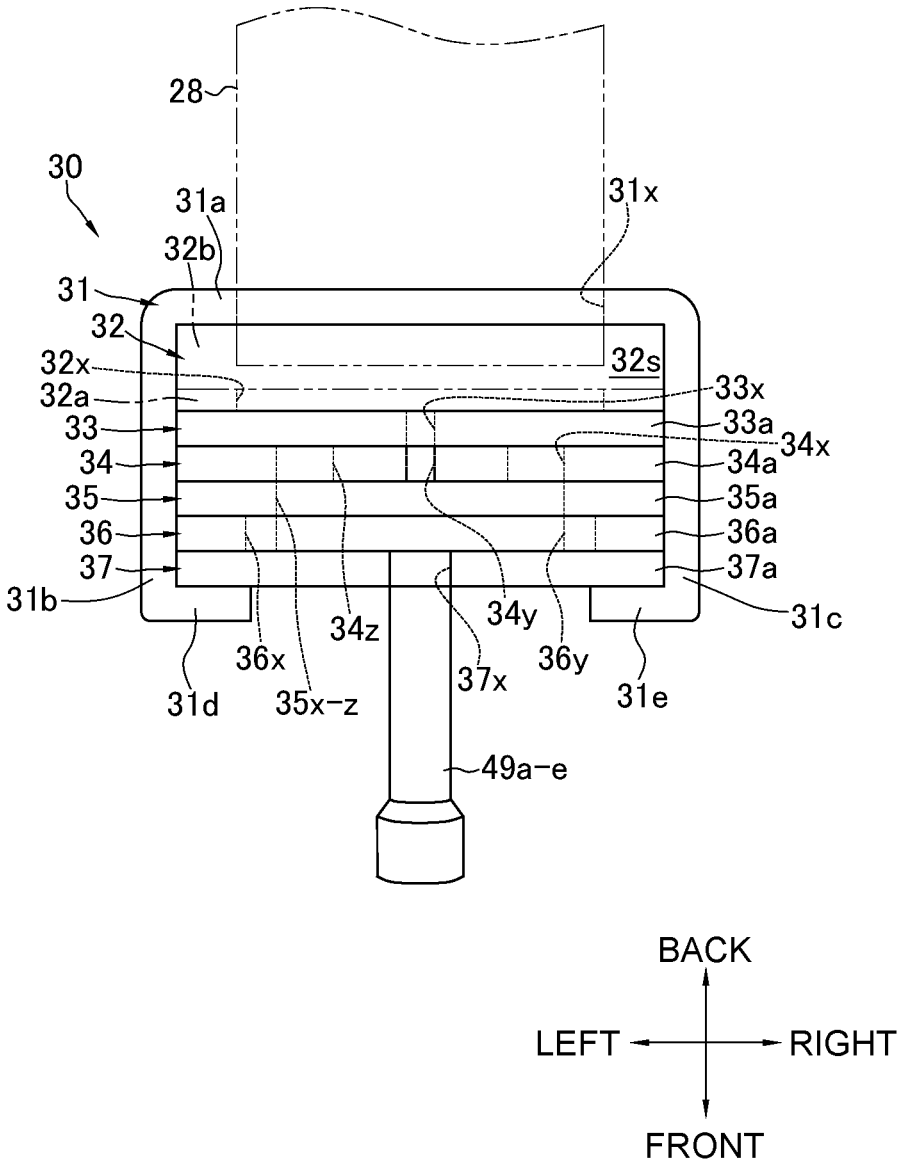
FIG. 37 is a plan sectional view showing a state of connection of the branch liquid-refrigerant connection pipes and flat tubes to the liquid header according to Modification J.
Figure 38:
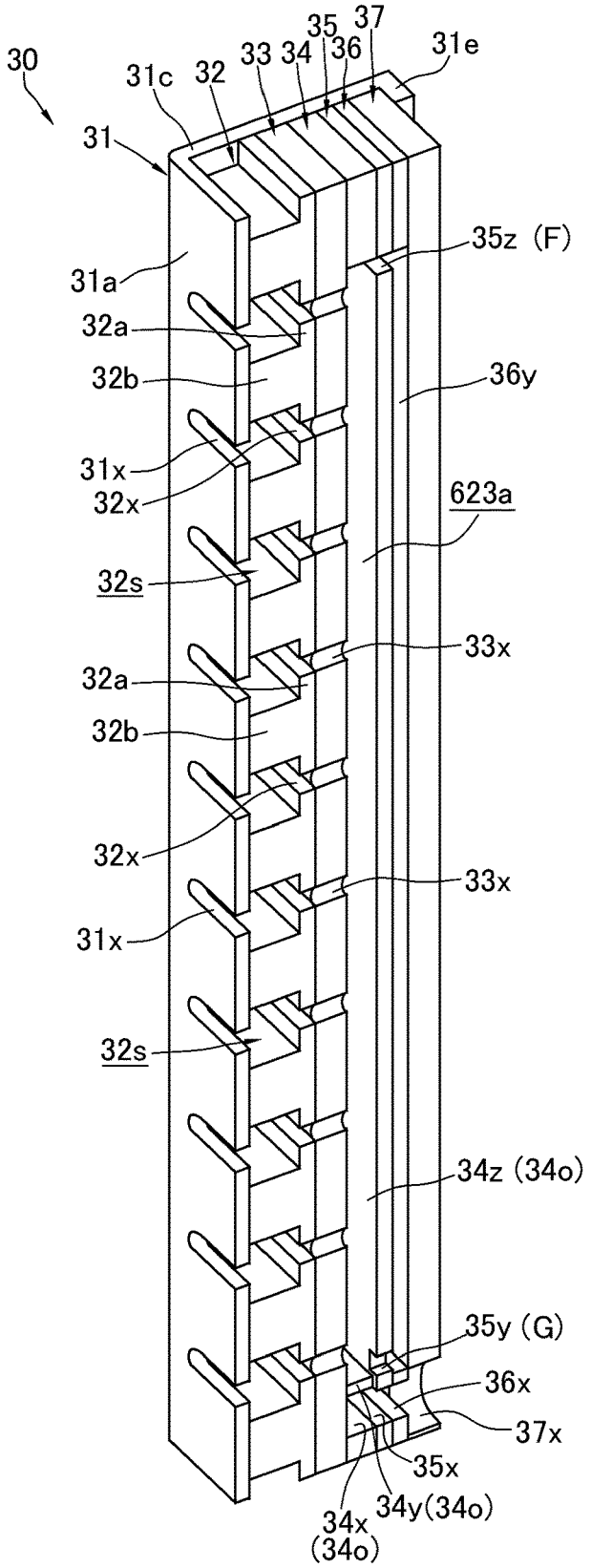
FIG. 38 is a sectional perspective view of a portion of the liquid header according to Modification J near the upper end thereof.

FIG. 34 is a side external structural view showing a state of connection of the branch liquid-refrigerant connection pipes 49*a* to 49*e* to the liquid header 30. FIG. 35 is an exploded perspective view of a portion of the liquid header 30 near an upper end thereof. Note that, in FIG. 35, alternate-long-and-two-short-dash-line arrows indicate the flow of a refrigerant when the outdoor heat exchanger 611 functions as an evaporator of the refrigerant. FIG. 36 is a plan sectional view of the liquid header 30. FIG. 37 is a plan sectional view showing a state of connection of the branch liquid-refrigerant connection pipes 49*a* to 49*e* and the flat tubes 28 to the liquid header 30. FIG. 38 is a sectional perspective view of a portion of the liquid header 30 near the upper end thereof.

Figure 39:
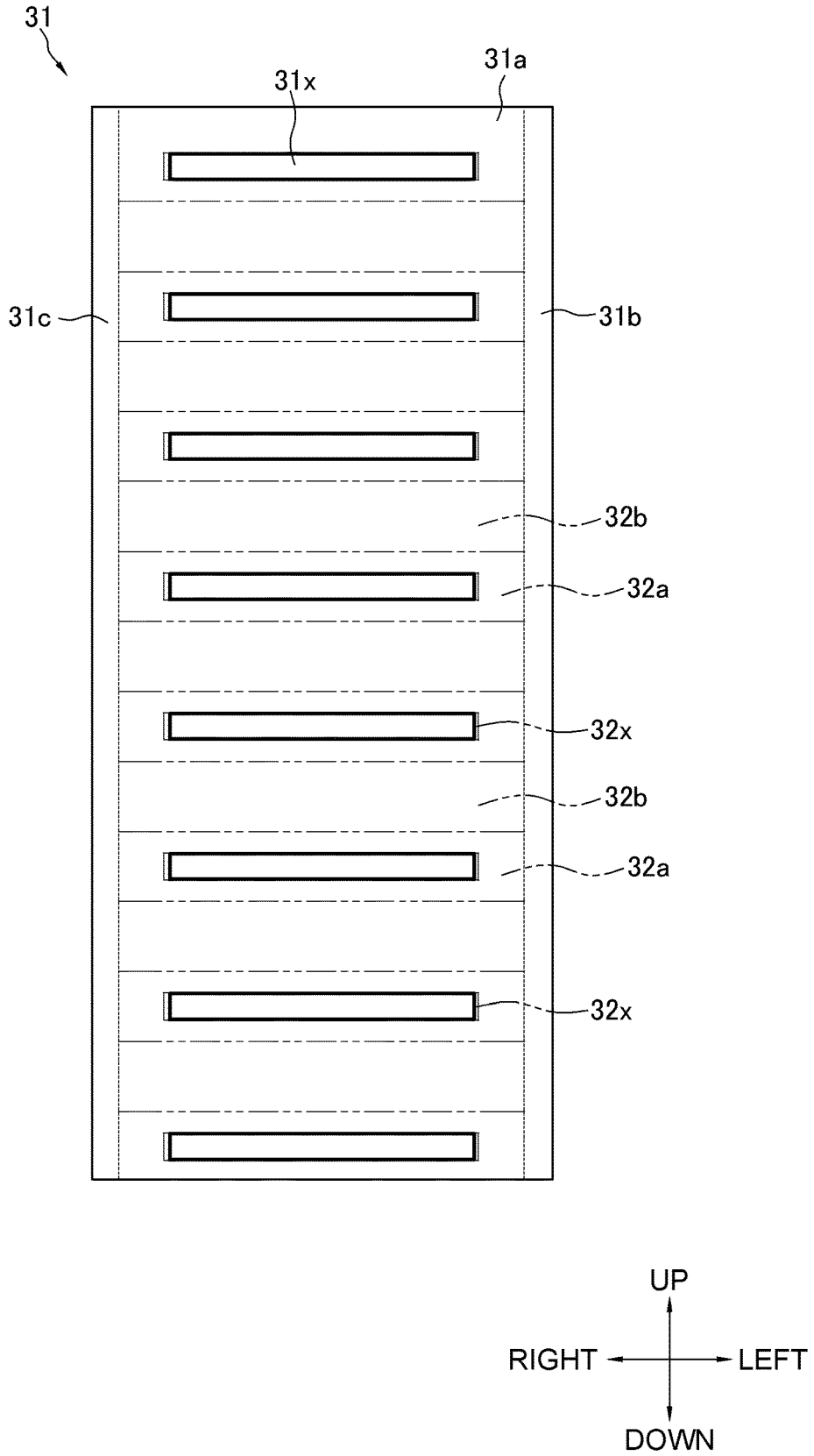
FIG. 39 is a back schematic view of a first liquid-side member according to Modification J.
Figure 40:
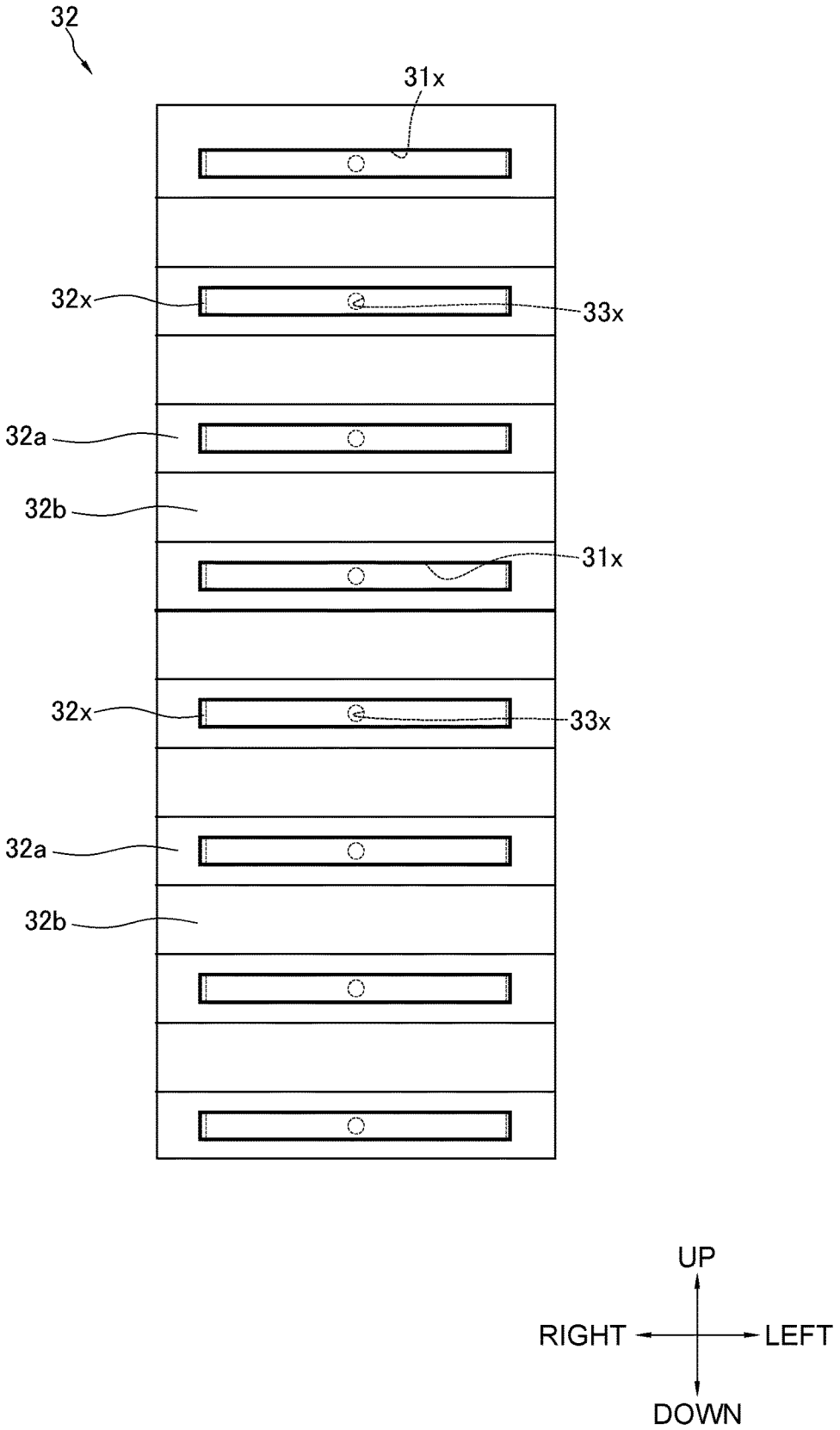
FIG. 40 is a back schematic view of a second liquid-side member according to Modification J.
Figure 41:
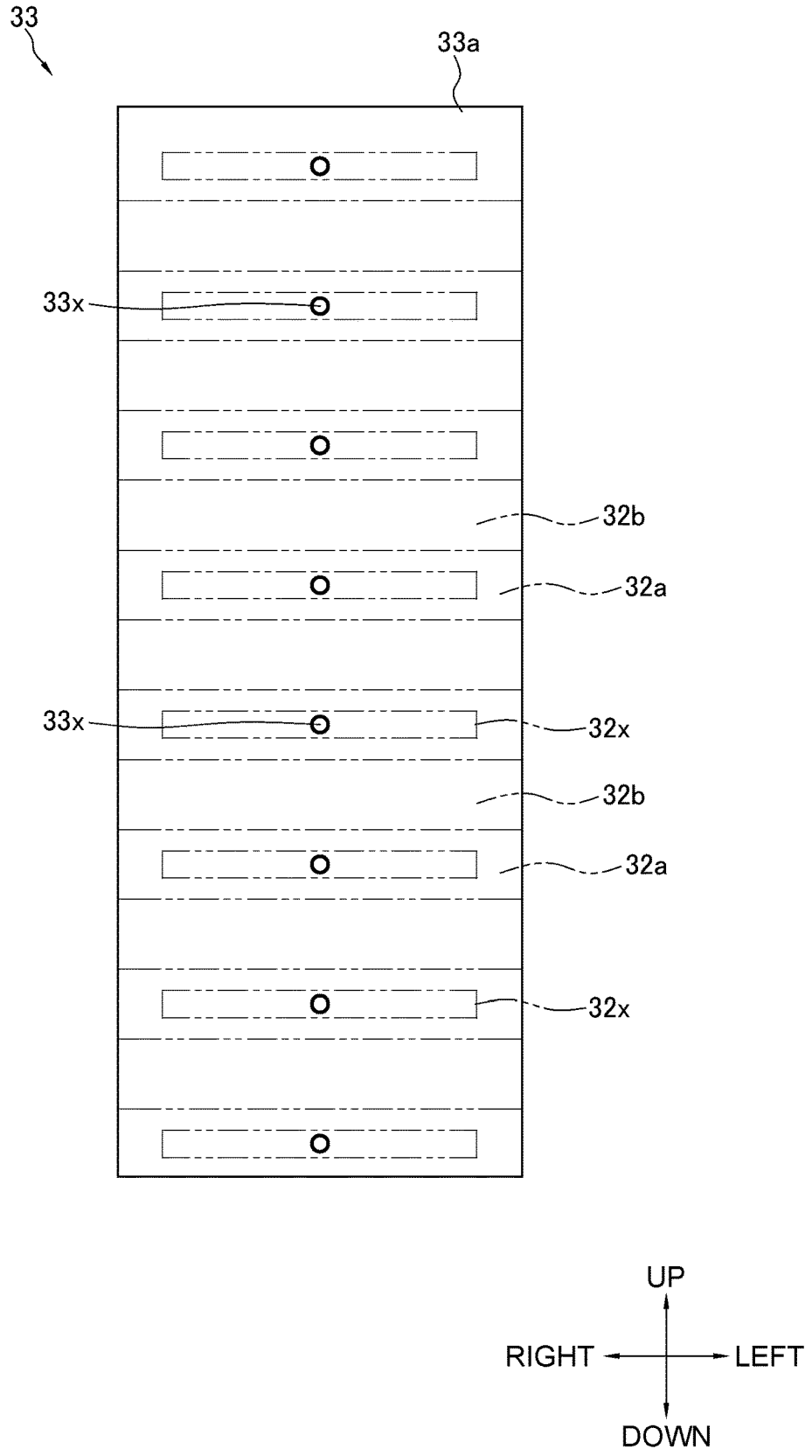
FIG. 41 is a back schematic view of a third liquid-side member according to Modification J.
Figure 42:
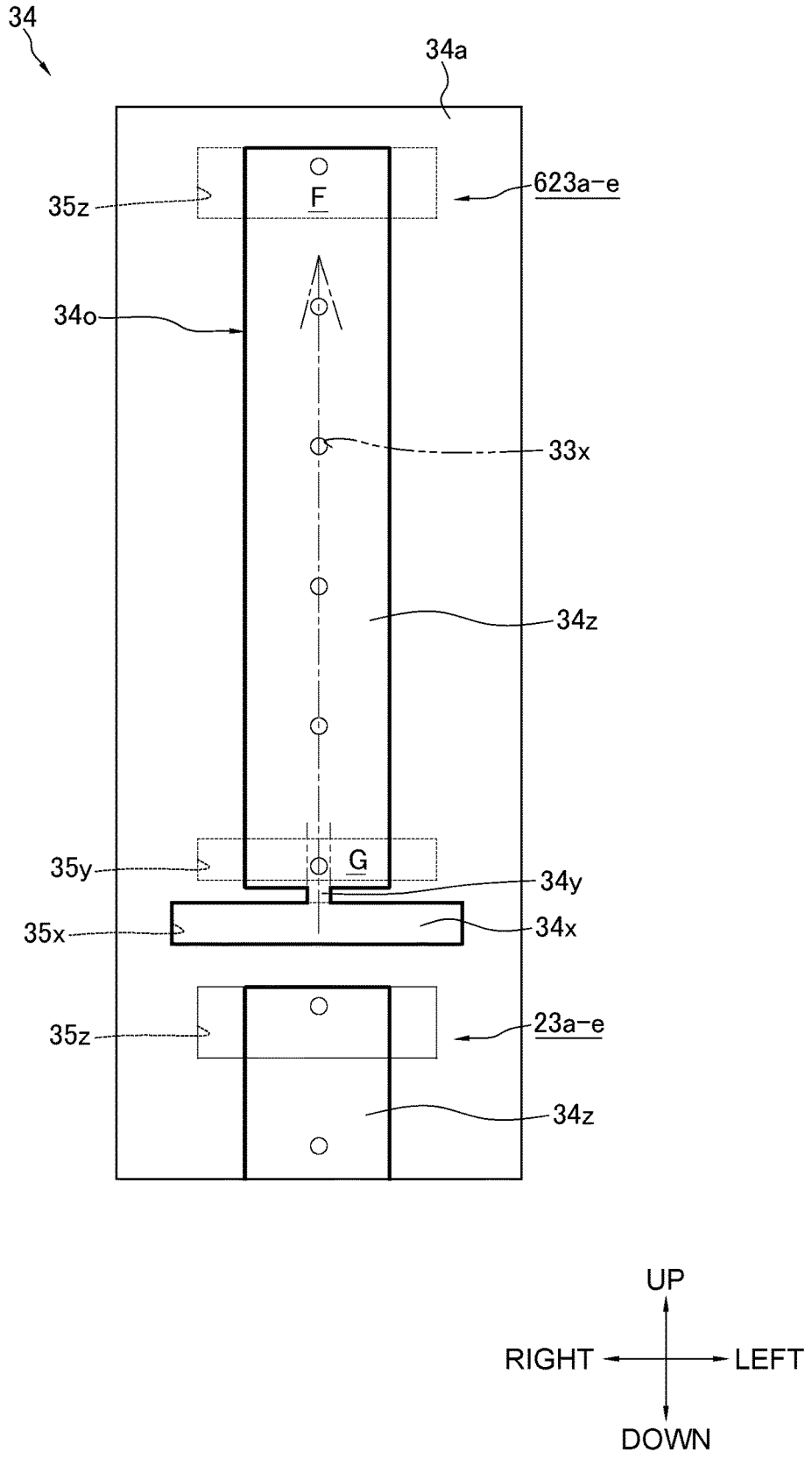
FIG. 42 is a back schematic view of a fourth liquid-side member according to Modification J.
Figure 43:
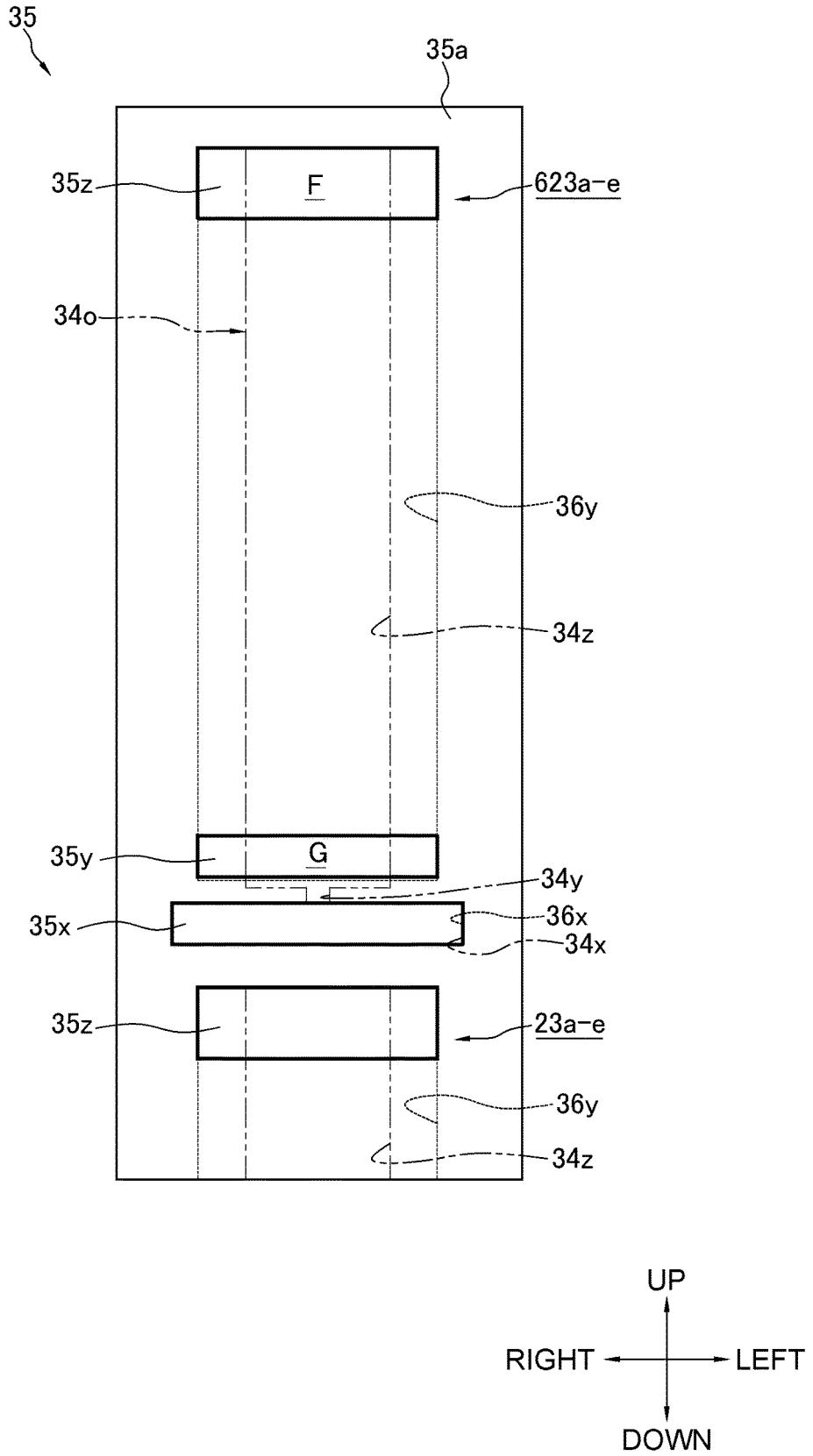
FIG. 43 is a back schematic view of a fifth liquid-side member according to Modification J.
Figure 44:
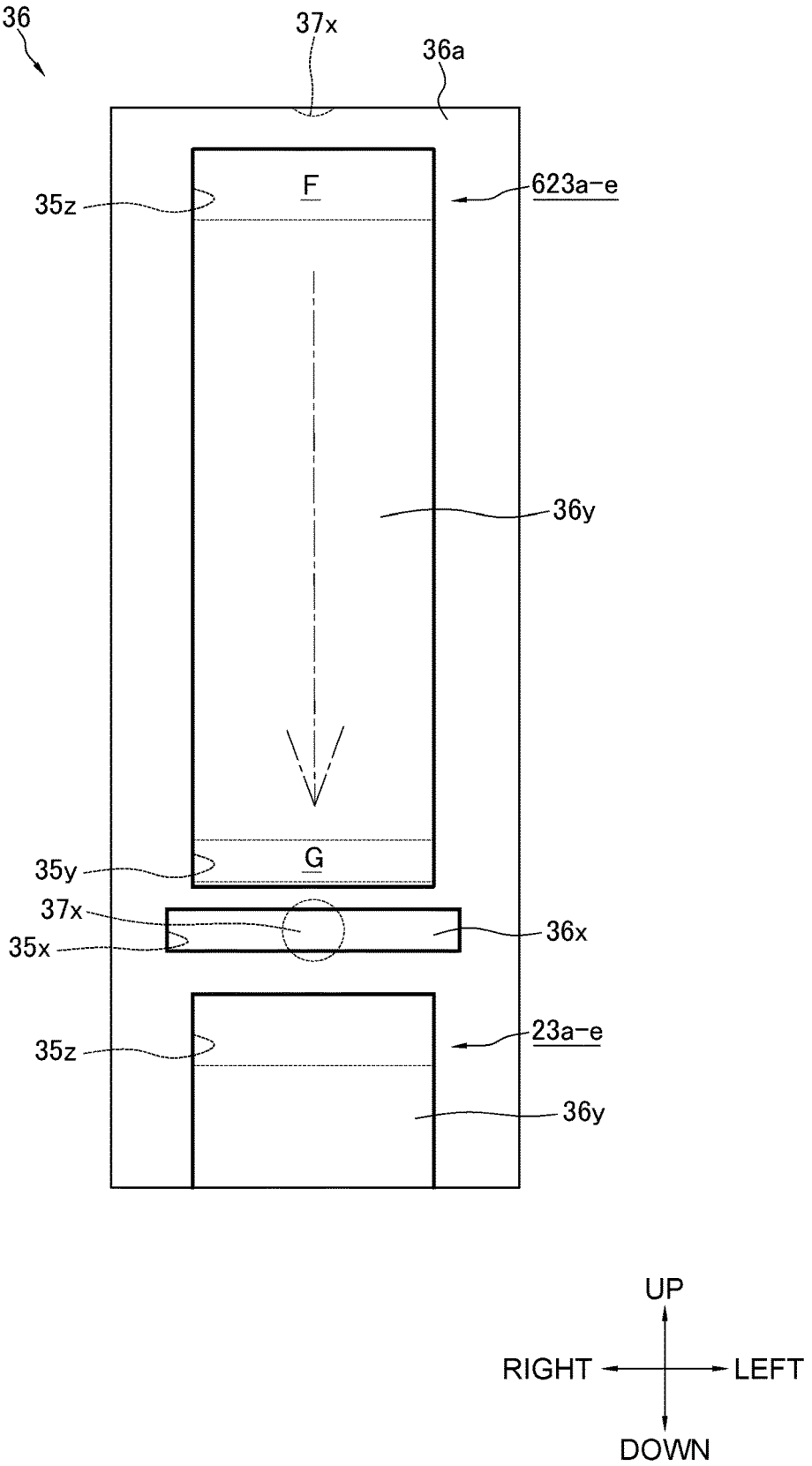
FIG. 44 is a back schematic view of a sixth liquid-side member according to Modification J.
Figure 45:
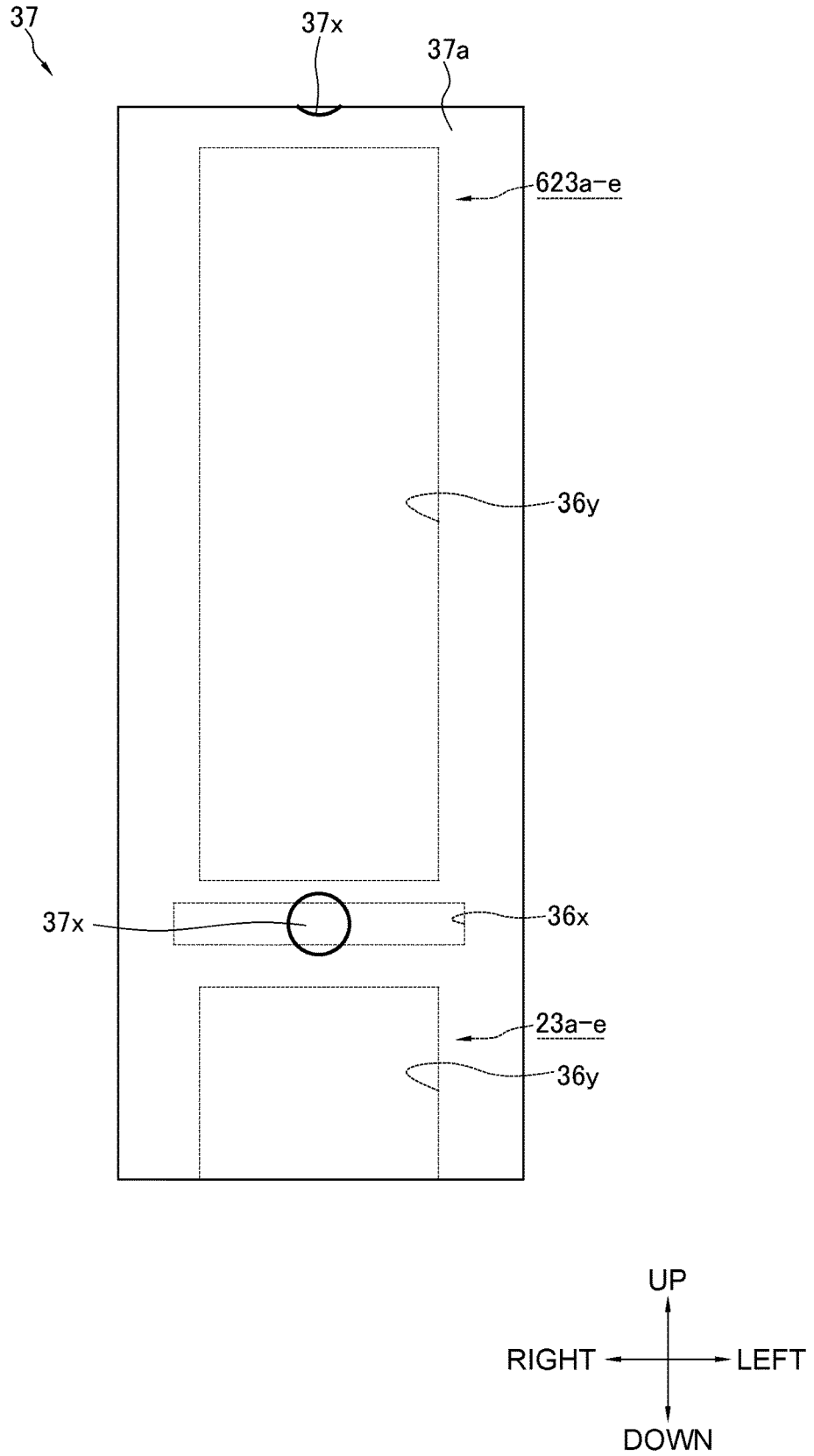
FIG. 45 is a back schematic view of a seventh liquid-side member according to Modification J.

FIG. 39 is a back schematic view of a first liquid-side member 31. FIG. 40 is a back schematic view of a second liquid-side member 32. FIG. 41 is a back schematic view of a third liquid-side member 33. FIG. 42 is a back schematic view of a fourth liquid-side member 34. FIG. 43 is a back schematic view of a fifth liquid-side member 35. FIG. 44 is a back schematic view of a sixth liquid-side member 36. FIG. 45 is a back schematic view of a seventh liquid-side member 37. Note that each of these figures show with, for example, broken lines, the relationship between the positions of openings of members that are disposed adjacent to each other while projecting them.

The liquid header 30 includes the first liquid-side member 31, the second liquid-side member 32, the third liquid-side member 33, the fourth liquid-side member 34, the fifth liquid-side member 35, the sixth liquid-side member 36, and the seventh liquid-side member 37. The liquid header 30 is constituted by joining the first liquid-side member 31, the second liquid-side member 32, the third liquid-side member 33, the fourth liquid-side member 34, the fifth liquid-side member 35, the sixth liquid-side member 36, and the seventh liquid-side member 37 to each other by brazing.

Note that it is desirable that the first liquid-side member 31, the third liquid-side member 33, the fourth liquid-side member 34, the fifth liquid-side member 35, the sixth liquid-side member 36, and the seventh liquid-side member 37 be constituted to have a plate thickness of 3 mm or less. It is desirable that the first liquid-side member 31, the second liquid-side member 32, the third liquid-side member 33, the fourth liquid-side member 34, the fifth liquid-side member 35, the sixth liquid-side member 36, and the seventh liquid-side member 37 each be a member having a thickness in a plate-thickness direction that is smaller than a length in a vertical direction and that is smaller than a length in a left-right direction. The first liquid-side member 31, the third liquid-side member 33, the fourth liquid-side member 34, the fifth liquid-side member 35, the sixth liquid-side member 36, and the seventh liquid-side member 37 are stacked in a stacking direction, which is the plate-thickness direction.

An external shape of the liquid header 30 in plan view has a substantially quadrilateral shape having a connection portion of the flat tubes 28 as one side.

(7-10-3-1) First Liquid-Side Member

The first liquid-side member 31 is primarily a member that, together with the seventh liquid-side member 37 described below, constitutes the periphery of the external shape of the liquid header 30. It is desirable that the first liquid-side member 31 have a clad layer formed on a surface thereof, the clad layer having a brazing material.

The first liquid-side member 31 includes a liquid-side flat-tube connection plate 31*a*, a first liquid-side outer wall 31*b*, a second liquid-side outer wall 31*c*, a first liquid-side claw portion 31*d*, and a second liquid-side claw portion 31*e*.

Although not limited, the first liquid-side member 31 of one or more embodiments can be formed by bending one metal plate obtained by rolling with the longitudinal direction of the liquid header 30 being a direction of fold. In this case, the plate thickness of each portion of the first liquid-side member 31 is uniform.

The liquid-side flat-tube connection plate 31*a* is a flat-shaped portion extending in an up-down direction and in the left-right direction. A plurality of liquid-side flat-tube connection openings 31*x* disposed side by side in the up-down direction are formed in the liquid-side flat-tube connection plate 31*a*. Each liquid-side flat-tube connection opening 31*x* is a through opening in a thickness direction of the liquid-side flat-tube connection plate 31*a*. With the flat tubes 28 being inserted in the liquid-side flat-tube connection openings 31*x* such that one end of each flat tube 28 extends completely through the corresponding liquid-side flat-tube connection opening 31*x*, the flat tubes 28 are joined to the liquid-side flat-tube connection openings 31*x* by brazing. In the joined state realized by brazing, the entire inner peripheral surface of each liquid-side flat-tube connection opening 31*x* and the entire outer peripheral surface of the corresponding flat tube 28 are in contact with each other. Here, since the thickness of the first liquid-side member 31 including the liquid-side flat-tube connection plate 31*a* is relatively small, such as on the order of 1.0 mm or greater and 2.0 mm or less, the length of the inner peripheral surface of each gas-side flat-tube connection opening 71*x* in the plate-thickness direction can be small. Therefore, when, in a stage before the joining by brazing, the flat tubes 28 are inserted into the liquid-side flat-tube connection openings 31*x*, friction that is produced between the inner peripheral surfaces of the liquid-side flat-tube connection openings 31*x* and the outer peripheral surfaces of the flat tubes 28 can be kept low, and the insertion operation can be facilitated.

The first liquid-side outer wall 31*b* is a flat-shaped portion extending toward the front from a front surface of an end portion on a left side (outer side of the outdoor unit 2, side opposite to the gas header 670) of the liquid-side flat-tube connection plate 31*a*.

The second liquid-side outer wall 31*c* is a flat-shaped portion extending toward the front from a front surface of an end portion on a right side (inner side of the outdoor unit 2, side of the gas header 670) of the liquid-side flat-tube connection plate 31*a*.

The first liquid-side claw portion 31*d* is a portion extending toward the right from a front end portion of the first liquid-side outer wall 31*b*. The second liquid-side claw portion 31*e* is a portion extending toward the left from a front end portion of the second liquid-side outer wall 31*c*.

In a state before the second liquid-side member 32, the third liquid-side member 33, the fourth liquid-side member 34, the fifth liquid-side member 35, the sixth liquid-side member 36, and the seventh liquid-side member 37 are disposed on an inner side of the first liquid-side member 31 in plan view, the first liquid-side claw portion 31*d* and the second liquid-side claw portion 31*e* are each in an extended state on an extension line of a corresponding one of the first liquid-side outer wall 31*b* and the second liquid-side outer wall 31*c*. In a state in which the second liquid-side member 32, the third liquid-side member 33, the fourth liquid-side member 34, the fifth liquid-side member 35, the sixth liquid-side member 36, and the seventh liquid-side member 37 are disposed on the inner side of the first liquid-side member 31 in plan view, the first liquid-side claw portion 31*d* and the second liquid-side claw portion 31*e* are bent toward each other to crimp the second liquid-side member 32, the third liquid-side member 33, the fourth liquid-side member 34, the fifth liquid-side member 35, the sixth liquid-side member 36, and the seventh liquid-side member 37 by the first liquid-side member 31, as a result of which they are fixed to each other. When, in this state, the brazing is performed, for example, inside a furnace, the members are joined to each other by the brazing and are completely fixed to each other.

(7-10-3-2) Second Liquid-Side Member

The second liquid-side member 32 includes a plate-shaped base portion 32*a* and a plurality of protrusions 32*b* that protrude toward the liquid-side flat-tube connection plate 31*a* from the base portion 32*a*. The second liquid-side member 32 may not have a clad layer formed on a surface thereof, the clad layer having a brazing material.

The base portion 32*a* extends parallel to the liquid-side flat-tube connection plate 31*a* and has a plate shape in which the direction of extension of the flat tubes 28 is a plate thickness direction. The width of the base portion 32*a* in the left-right direction is the same as the width of a portion of the liquid-side flat-tube connection plate 31*a* in the left-right direction excluding two end portions. A plurality of communication holes 32*x* provided side by side in the up-down direction are formed in a one-to-one correspondence with the flat tubes 28 at positions in the base portion 32*a* other than the positions where the protrusions 32*b* are provided. When viewed from the back, the communication holes 32*x* have shapes that substantially overlap the end portions of the flat tubes 28.

The protrusions 32*b* extend in the horizontal direction up to where they come into contact with a front surface of the liquid-side flat-tube connection plate 31*a* by extending toward the back from portions of the base portion 32*a* between the communication holes 32*x* adjacent to each other. Therefore, there are formed insertion spaces 32*s* surrounded by the front surface of the liquid-side flat-tube connection plate 31*a* of the first liquid-side member 31, the first liquid-side outer wall 31*b* and the second liquid-side outer wall 31*c* of the first liquid-side member 31, the protrusions 32*b* that are adjacent to each other in the up-down direction of the second liquid-side member 32, and portions of a back surface of the base portion 32*a* of the second liquid-side member 32 other than the communication holes 32*x*. A plurality of the insertion spaces 32*s* are provided side by side in the longitudinal direction of the liquid header 30. End portions of the flat tubes 28 are positioned in the insertion spaces 32*s*. Note that the lengths of the protrusions 32*b* in the front-back direction are adjusted to be larger than the plate thickness of any of the first liquid-side member 31, the third liquid-side member 33, the fourth liquid-side member 34, the fifth liquid-side member 35, the sixth liquid-side member 36, and the seventh liquid-side member 37 that constitute the liquid header 30. Therefore, even if an error occurs in the amount of insertion of the flat tubes 28 into the liquid header 30, as long as the error is within a range of the lengths of the protrusions 32*b* in the front-back direction, blockages or difficulty flowing, such as there being portions at which a flow of a refrigerant is blocked or portions at which a refrigerant has difficulty flowing when the liquid header 30 has been completed, are less likely to occur. It is also possible to suppress a brazing material from moving due to a capillary action when the members are joined by brazing, and to thus suppress the brazing material from closing the refrigerant passages 28*b* of the flat tubes 28.

(7-10-3-3) Third Liquid-Side Member

The third liquid-side member 33 is a member that is stacked on a surface on a front side (side at which the branch liquid-refrigerant connection pipes 49*a* to 49*e* and the liquid header 30 are connected to each other) of the base portion 32*a* of the second liquid-side member 32 so as to face and contact this surface. The length of the third liquid-side member 33 in the left-right direction is the same as the length of the second liquid-side member 32 in the left-right direction. It is desirable that the third liquid-side member 33 have a clad layer formed on a surface thereof, the clad layer having a brazing material.

The third liquid-side member 33 (an example of a third member) includes a third internal plate 33*a* (an example of a third plate-shaped portion) and a plurality of flow-dividing openings 33*x* (an example of third openings).

The third internal plate 33*a* has a flat shape extending in the up-down direction and in the left-right direction.

The plurality of flow-dividing openings 33*x* are disposed side by side in the up-down direction, and are through openings in the plate-thickness direction of the third internal plate 33*a*. In one or more embodiments, each flow-dividing opening 33*x* is formed near the center of the third internal plate 33*a* in the left-right direction. When viewed from the back, each flow-dividing opening 33*x* overlaps a corresponding one of the communication holes 32*x* of the second liquid-side member 32 and communicates therewith. Therefore, a refrigerant that flows in an ascending space 34*z* (described below) can be made to flow by being branched toward each of the flow-dividing openings 33*x*, and the refrigerant can be divided with respect to each flat tube 28 connected to a corresponding one of the flow-dividing openings 33*x*.

Note that, of a front surface of the third internal plate 33*a*, a surface thereof other than where the flow-dividing openings 33*x* are formed forms the contour of the ascending space 34*z* (described below).

(7-10-3-4) Fourth Liquid-Side Member

The fourth liquid-side member 34 is a member that is stacked on a surface on a front side (side at which the branch liquid-refrigerant connection pipes 49*a* to 49*e* and the liquid header 30 are connected to each other) of the third internal plate 33*a* of the third liquid-side member 33 so as to face and contact this surface. The length of the fourth liquid-side member 34 in the left-right direction is the same as the length of the third liquid-side member 33 in the left-right direction. The fourth liquid-side member 34 may not have a clad layer formed on a surface thereof, the clad layer having a brazing material.

The fourth liquid-side member 34 (an example of a fourth member) includes a fourth internal plate 34*a* (an example of a fourth plate-shaped portion) and a first penetrating portion 34*o*.

The fourth internal plate 34*a* has a flat shape extending in the up-down direction and in the left-right direction.

The first penetrating portion 34*o* is an opening extending through the fourth internal plate 34*a* in the plate-thickness direction, and has an introduction space 34*x*, a nozzle 34*y*, and the ascending space 34*z* (an example of a tenth opening). In one or more embodiments, the introduction space 34*x*, the nozzle 34*y*, and the ascending space 34*z* are provided side by side in the vertical direction in order from the bottom. In one or more embodiments, the widths of the introduction space 34*x*, the nozzle 34*y*, and the ascending space 34*z* in the front-back direction are the same.

The introduction space 34*x*, the nozzle 34*y*, and the ascending space 34*z* are spaces that are interposed in the front-back direction between the front surface of the third internal plate 33*a* of the third liquid-side member 33 and a back surface of a fifth internal plate 35*a* of the fifth liquid-side member 35 (described below).

The introduction space 34*x* faces the third internal plate 33*a* of the third liquid-side member 33, and, when viewed from the back, does not overlap the flow-dividing openings 33*x* and does not communicate with the flow-dividing openings 33*x*. Note that, when viewed from the back, the introduction space 34*x* overlaps a second connection opening 35*x* of the fifth liquid-side member 35 (described below) and communicates with the second connection opening 35*x*.

The nozzle 34*y* faces the third internal plate 33*a* of the third liquid-side member 33, and, when viewed from the back, does not overlap the flow-dividing openings 33*x* and does not communicate with the flow-dividing openings 33*x*. Note that the nozzle 34*y* faces the fifth internal plate 35*a* of the fifth liquid-side member 35 (described below), and, when viewed from the back, does not overlap the second connection opening 35*x*, a return flow path 35*y*, and an outward flow path 35*z*, and does not communicate therewith.

The ascending space 34*z* faces the third internal plate 33*a* of the third liquid-side member 33, and, when viewed from the back, overlaps the plurality of flow-dividing openings 33*x* and communicates with the plurality of flow-dividing openings 33*x*. Note that the ascending space 34*z* faces the fifth internal plate 35*a* of the fifth liquid-side member 35 (described below), and, when viewed from the back, does not overlap the second connection opening 35*x*, and overlaps the return flow path 35*y* and the outward flow path 35*z*. The ascending space 34*z* does not communicate with the second connection opening 35*x* and communicates with the return flow path 35*y* and the outward flow path 35*z*. Note that the length of the ascending space 34*z* in the longitudinal direction of the liquid header 30 is longer than the length of the introduction space 34*x* in the longitudinal direction of the liquid header 30 and is longer than the length of the nozzle 34*y* in the longitudinal direction of the liquid header 30. Therefore, it is possible to increase the number of flat tubes 28 that are made to communicate via the ascending space 34*z*.

Note that, in the ascending space 34*z*, a refrigerant flow path in which a refrigerant flows so as to be blown in the longitudinal direction of the liquid header 30 can be constituted by the front surface of the third internal plate 33*a* of the third liquid-side member 33, the back surface of the fifth internal plate 35*a* of the fifth liquid-side member 35 (described below), and thick portions of left and right edges of the first penetrating portion 34*o* of the fourth internal plate 34*a* of the fourth liquid-side member 34. Therefore, the structure is one that makes it less likely for errors in a flow-path cross-sectional area caused by manufacturing to occur, and that makes it easy to obtain the liquid header 30 that allows a refrigerant to stably move upward and flow.

Here, the length of the nozzle 34*y* in the left-right direction (a direction that is perpendicular to the longitudinal direction of the liquid header 30 and that is perpendicular to the direction of extension of the flat tubes 28) is shorter than the length of the introduction space 34*x* in the left-right direction and shorter than the length of the ascending space 34*z* in the left-right direction. Therefore, when the outdoor heat exchanger 611 is used as an evaporator of a refrigerant, a refrigerant that has been sent to the introduction space 34*x* has its flow velocity increased when passing through the nozzle 34*y* and easily reaches an upper portion of the ascending space 34*z*. Note that, since the width of the ascending space 34*z* in the left-right direction is narrower than the width of the introduction space 34*x* in the left-right direction and a passage cross-sectional area of a refrigerant in the ascending space 34*z* can be decreased, a flow velocity of a refrigerant that flows upward in the ascending space 34*z* can be kept high.

Here, the nozzle 34*y* is provided near the center of the fourth internal plate 34*a* in the left-right direction. In the left-right direction that is perpendicular to the longitudinal direction of the liquid header 30 and that is perpendicular to the plate-thickness direction of the fourth internal plate 34*a*, the width of the nozzle 34*y* is longer than the plate thickness of the fourth internal plate 34*a*. Therefore, an opening width can be made larger than the plate thickness. Therefore, for example, when the first penetrating portion 34*o* is to be formed in the fourth internal plate 34*a* by a punching operation, it is possible to reduce the load applied to a punch portion corresponding to the nozzle 34*y* and to suppress damage to the punch portion.

Note that, when viewed from the back, the plurality of flow-dividing openings 33*x* of the third liquid-side member 33 are positioned to overlap the inside of a range of a virtual region obtained by extending in a virtual manner the nozzle 34*y* in the longitudinal direction of the liquid header 30. When the outdoor heat exchanger 611 functions as an evaporator of a refrigerant, although a refrigerant that has passed through the nozzle 34*y* has its flow velocity increased and flows upward, a liquid refrigerant tends to be retained in left and right spaces of the ascending space 34*z* located slightly above the nozzle 34*y*. In contrast, by disposing the plurality of flow-dividing openings 33*x* and the nozzle 34*y* in the arrangement relationship above, it is possible to prevent the liquid refrigerant from flowing in a concentrated manner with respect to the lowest flow-dividing opening 33*x* among the flow-dividing openings 33*x* that communicate with the certain ascending space 34*z*.

(7-10-3-5) Fifth Liquid-Side Member

The fifth liquid-side member 35 is a member that is stacked on a surface on a front side (side at which the branch liquid-refrigerant connection pipes 49*a* to 49*e* and the liquid header 30 are connected to each other) of the fourth internal plate 34*a* of the fourth liquid-side member 34 so as to face and contact this surface. The length of the fifth liquid-side member 35 in the left-right direction is the same as the length of the fourth liquid-side member 34 in the left-right direction. It is desirable that the fifth liquid-side member 35 have a clad layer formed on a surface thereof, the clad layer having a brazing material.

The fifth liquid-side member 35 (an example of a second member) includes the fifth internal plate 35*a* (an example of a second plate-shaped portion), the second connection opening 35*x*, the return flow path 35*y* (an example of a second opening, an example of an eighth opening), and the outward flow path 35*z* (an example of a second opening, an example of a ninth opening).

The fifth internal plate 35*a* has a flat shape extending in the up-down direction and in the left-right direction.

The second connection opening 35*x*, the return flow path 35*y*, and the outward flow path 35*z* are openings that are independently disposed side by side in this order from the bottom, and are through openings in a plate-thickness direction of the fifth internal plate 35*a*.

When viewed from the back, the second connection opening 35*x* overlaps the introduction space 34*x* of the first penetrating portion 34*o* of the fourth liquid-side member 34, and communicates therewith. When viewed from the back, the second connection opening 35*x* overlaps a first connection opening 36*x* of the sixth liquid-side member 36 (described below) and communicates therewith. When viewed from the back, the second connection opening 35*x* does not overlap the nozzle 34*y* and the ascending space 34*z* of the first penetrating portion 34*o* of the fourth liquid-side member 34, and does not communicate therewith. When viewed from the back, the second connection opening 35*x* does not overlap a descending space 36*y* of the sixth liquid-side member 36 (described below), and does not communicate therewith.

The return flow path 35*y* is such that, when viewed from the back, an overlapping region G (an example of a second region) of the return flow path 35*y* overlaps an overlapping region G that is a portion of the first penetrating portion 34*o* of the fourth liquid-side member 34 near a lower end of the ascending space 34*z*, and communicates with the portion near the lower end of the ascending space 34*z*. Note that, when viewed from the back, the return flow path 35*y* does not overlap the nozzle 34*y* and does not communicate with the nozzle 34*y*.

The outward flow path 35*z* is such that, when viewed from the back, an overlapping region F (an example of a first region) of the outward flow path 35*z* overlaps an overlapping region F that is a portion of the first penetrating portion 34*o* of the fourth liquid-side member 34 near an upper end of the ascending space 34*z*, and communicates with the portion near the upper end of the ascending space 34*z*. Note that, in one or more embodiments, the width of the outward flow path 35*z* in the longitudinal direction of the liquid header 30 is longer than the width of the return flow path 35*y* in the longitudinal direction of the liquid header 30. Therefore, a refrigerant that has moved upward in the ascending space 34*z* and that has reached the vicinity of the upper end thereof easily passes through the outward flow path 35*z* and the refrigerant cannot easily flow to the return flow path 35*y* from the ascending space 34*z*.

Note that the fifth internal plate 35*a* covers from the front side a portion of the first penetrating portion 34*o* of the fourth liquid-side member 34 between the overlapping region G and the overlapping region F.

(7-10-3-6) Sixth Liquid-Side Member

The sixth liquid-side member 36 is a member that is stacked on a surface on a front side (side at which the branch liquid-refrigerant connection pipes 49*a* to 49*e* and the liquid header 30 are connected to each other) of the fifth internal plate 35*a* of the fifth liquid-side member 35 so as to face and contact this surface. The length of the sixth liquid-side member 36 in the left-right direction is the same as the length of the fifth liquid-side member 35 in the left-right direction. The sixth liquid-side member 36 may not have a clad layer formed on a surface thereof, the clad layer having a brazing material.

The sixth liquid-side member 36 (an example of a first member) includes a sixth internal plate 36*a* (an example of a first plate-shaped portion), the first connection opening 36*x*, and the descending space 36*y* (an example of a first opening).

The sixth internal plate 36*a* has a flat shape extending in the up-down direction and in the left-right direction.

The first connection opening 36*x* and the descending space 36*y* are openings that are independently disposed side by side in this order from the bottom, and are through openings in a plate-thickness direction of the sixth internal plate 36*a*.

When viewed from the back, the first connection space 36*x* overlaps the second connection opening 35*x* of the fifth liquid-side member 35 and communicates therewith. When viewed from the back, the first connection opening 36*x* overlaps an external liquid-pipe connection opening 37*x* of the seventh liquid-side member 37 (described below) and communicates therewith.

When viewed from the back, an overlapping region G (an example of a second region) of the descending space 36*y* that is near a lower end of the descending space 36*y* overlaps a part of the fifth internal plate 35*a* of the fifth liquid-side member 35 and the overlapping region G (an example of a second region) of the return flow path 35*y*, and communicates therewith. When viewed from the back, an overlapping region F (an example of a first region) of the descending space 36*y* that is near an upper end of the descending space 36*y* overlaps a part of the fifth internal plate 35*a* of the fifth liquid-side member 35 and the overlapping region F (an example of a first region) of the outward flow path 35*z*, and communicates therewith. Note that, when viewed from the back, the descending space 36*y* does not overlap the external liquid-pipe connection opening 37*x* of the seventh liquid-side member 37 (described below), and does not communicate therewith. Note that a portion of the descending space 36*y* between the overlapping region G and the overlapping region F is covered from the back by the fifth internal plate 35*a* of the fifth liquid-side member 35.

In the longitudinal direction of the liquid header 30, the length of the descending space 36*y* is the same as the length of the ascending space 34*z*, and the descending space 36*y* and the ascending space 34*z* communicate near upper ends of the ascending space 34*z* and the descending space 36*y* via the outward flow path 35*z* and communicate near lower ends of the ascending space 34*z* and the descending space 36*y* via the return flow path 35*y*. Note that the width of the descending space 36*y* in the left-right direction is larger than the width of the ascending space 34*z* in the left-right direction. Therefore, it is possible to reduce pressure loss when a refrigerant passes in the descending space 36*y*, while suppressing a reduction in the flow velocity when the refrigerant moves upward and flows in the ascending space 34*z*.

(7-10-3-7) Seventh Liquid-Side Member

The seventh liquid-side member 37 is a member that is stacked on a surface on a front side (side at which the branch liquid-refrigerant connection pipes 49*a* to 49*e* and the liquid header 30 are connected to each other) of the sixth internal plate 36*a* of the sixth liquid-side member 36 so as to face and contact this surface. The length of the seventh liquid-side member 37 in the left-right direction is the same as the length of the sixth liquid-side member 36 in the left-right direction. It is desirable that the seventh liquid-side member 37 have a clad layer formed on a surface thereof, the clad layer having a brazing material.

The seventh liquid-side member 37 includes a liquid-side external plate 37*a* and the external liquid-pipe connection opening 37*x*.

The liquid-side external plate 37*a* has a flat shape extending in the up-down direction and in the left-right direction. The liquid-side external plate 37*a* covers the entire descending space 36*y* of the sixth liquid-side member 36 from the front.

The external liquid-pipe connection opening 37*x* is a through opening in a plate-thickness direction of the liquid-side external plate 37*a*. When viewed from the back, the external liquid-pipe connection opening 37*x* overlaps a part of the first connection opening 36*x* of the sixth liquid-side member 36 and communicates therewith. Note that, when viewed from the back, the external liquid-pipe connection opening 37*x* does not overlap the descending space 36*y* of the sixth liquid-side member 36, and does not communicate therewith.

The external liquid-pipe connection opening 37*x* is a circular opening to which any one of the branch liquid-refrigerant connection pipes 49*a* to 49*e* is inserted and connected. Therefore, when the outdoor heat exchanger 611 functions as an evaporator of a refrigerant, a refrigerant that flows in each of the branch liquid-refrigerant connection pipes 49*a* to 49*e* is sent to the introduction space 34*x* of a corresponding one of first penetrating portions 34*o* via a corresponding one of first connection openings 36*x* and a corresponding one of second connection openings 35*x*.

Note that a front surface of the seventh liquid-side member 37 is in contact with and crimped to the first liquid-side claw portion 31*d* and the second liquid-side claw portion 31*e* of the first liquid-side member 31.

(7-10-3-8) Repetition of Shapes of Sub-Spaces

Note that, in the description above, among the plurality of sub-spaces 623*a* to 623*e* that constitute the liquid-side internal space 623 of the liquid header 30, one of the sub-spaces 623*a* to 623*e* to which one of the branch liquid-refrigerant connection pipes 49*a* to 49*e* is connection is focused upon and described.

Therefore, for example, in the seventh liquid-side member 37, external liquid-pipe connection openings 37*x* for the respective branch liquid-refrigerant connection pipes 49*a* to 49*e* are formed side by side in the longitudinal direction of the liquid header 30 in one liquid-side external plate 37*a*. Similarly, in the fourth liquid-side member 34, first penetrating portions 34*o* each including an introduction space 34*x*, a nozzle 34*y*, and an ascending space 34*z* are formed side by side in the longitudinal direction of the liquid header 30 in one fourth internal plate 34*a*.

(7-10-4) Flow of Refrigerant in Liquid Header

A flow of a refrigerant in the liquid header 30 when the outdoor heat exchanger 611 functions as an evaporator of the refrigerant is described below. Note that, when the outdoor heat exchanger 611 functions as a condenser or a heat dissipater of the refrigerant, the flow is in a direction substantially opposite to that when the outdoor heat exchanger 611 functions as an evaporator.

First, a liquid refrigerant or a refrigerant in a gas-liquid two-phase state that has flowed by being divided by the plurality of flow dividing pipes 22*a* to 22*e* of the flow divider 22 flows in the branch liquid-refrigerant connection pipes 49*a* to 49*e* to pass through the external liquid-pipe connection openings 37*x* of the liquid-side external plate 37*a* of the seventh liquid-side member 37 and to flow into the sub-spaces 623*a* to 623*e* of the liquid header 30.

Specifically, the refrigerant flows into the first connection openings 36*x* at the corresponding sub-spaces 623*a* to 623*e*.

The refrigerant that has flowed into each first connection opening 36*x* flows into the introduction space 34*x* of the corresponding first penetrating portion 34*o* of the fourth liquid-side member 34 via the corresponding second connection opening 35*x*.

The refrigerant that has flowed into each introduction space 34*x* has its flow velocity increased when the refrigerant passes through the corresponding nozzle 34*y*, and moves upward in the corresponding ascending space 34*z*. Note that, even if a refrigerant circulation amount of the refrigerant circuit 6 is small, such as even if a driving frequency of the compressor 8 is low, by causing the width of the ascending spaces 34*z* in the left-right direction to be narrower than the introduction spaces 34*x*, a refrigerant that has flowed into each ascending space 34*z* easily reaches the flow dividing openings 33*x* that are positioned near the upper end of the corresponding ascending space 34*z*. Here, the refrigerant that has flowed into each ascending space 34*z* moves to the vicinity of the upper end of each the ascending space 34*z* while being divided and flowing toward the flow-dividing openings 33*x*. Note that, when a refrigerant circulation amount of the refrigerant circuit 6 is large, such as when a driving frequency of the compressor 8 is high, the amount of refrigerant that reaches the vicinity of the upper end of each ascending space 34*z* is large, and the refrigerant reaches the corresponding descending space 36*y* via the corresponding outward flow path 35*z*. The refrigerant that has reached each descending space 36*y* moves downward and is returned again to a space above the corresponding nozzle 34*y* near a lower portion of the corresponding ascending space 34*z* via the corresponding return flow path 35*y*. Here, in each ascending space 34*z*, since the flow velocity of the refrigerant is increased as a result of passing through the corresponding nozzle 34*y*, the static pressure is lower at a portion of each ascending space 34*z* near the corresponding return flow path 35*y* than at a portion of the corresponding descending space 36*y* near the corresponding return flow path 35*y*. Therefore, the refrigerant that has moved down each descending space 36*y* easily returns to the corresponding ascending space 34*z* via the corresponding return flow path 35*y*. In this way, since it is possible to circulate the refrigerant by using each ascending space 34*z*, each outward flow path 35*z*, each descending space 36*y*, and each return flow path 35*y*, even if there is a refrigerant that has not flowed by being divided by any one of the flow-dividing openings 33*x* when the refrigerant moves upward and flows in each ascending space 34*z*, the refrigerant can be returned again to each ascending space 34*z* via the corresponding outward flow path 35*z*, the corresponding descending space 36*y*, and the corresponding return flow path 35*y*. Therefore, the refrigerant easily flows in any one of the flow-dividing openings 33*x*.

As described above, the refrigerant that has flowed by being divided by the flow-dividing openings 33*x* flows into the flat tubes 28 via the insertion spaces 32*s* while being kept divided.

(7-10-5) Features of Modification J (7-10-5-1)

Since the liquid header 30 of the outdoor heat exchanger 611 of the present Modification J can be manufactured by stacking a plurality of plate-shaped members (the liquid-side flat-tube connection plate 31*a* of the first liquid-side member 31, the second liquid-side member 32, the third liquid-side member 33, the fourth liquid-side member 34, the fifth liquid-side member 35, the sixth liquid-side member 36, and the seventh liquid-side member 37), the assembly operation is easily performed.

In this way, in the liquid header 30 that is constituted by stacking the plurality of plate-shaped members, after the refrigerant that has moved upward in the ascending spaces 34*z* of the respective first penetrating portions 34*o* of the fourth liquid-side member 34 has flowed in the outward flow paths 35*z* of the fifth liquid-side member 35, the descending spaces 36*y* of the sixth liquid-side member 36, and the return flow paths 35*y* of the fifth liquid-side member 35, the refrigerant can return again to the ascending spaces 34*z* of the respective first through holes 34*o* of the fourth liquid-side member 34. After the refrigerant that has moved downward in the descending spaces 36*y* of the sixth liquid-side member 36 has flowed in the descending spaces 36*y* of the sixth liquid-side member 36, the ascending spaces 34*z* of the respective first penetrating portions 34*o* of the fourth liquid-side member 34, and the outward flow paths 35*z* of the fifth liquid-side member 35, the refrigerant can return again to the descending spaces 36*y* of the sixth liquid-side member 36. In this way, in the liquid header 30, it is possible to, at locations between the plate-shaped portions stacked upon each other in the plate-thickness direction, cause a refrigerant to flow back and forth in the stacking direction. Therefore, since, compared with a structure in which a refrigerant flows only toward one side in the stacking direction, the flow of the refrigerant can be changed via the overlapping regions F and the overlapping regions G, a liquid refrigerant and a gas refrigerant are easily mixed. Consequently, it is possible to suppress the bias of distribution of the liquid refrigerant and the gas refrigerant in the liquid header 30.

(7-10-5-2)

In the liquid header 30 of the outdoor heat exchanger 611 of the present modification, the length of each nozzle 34*y* in the left-right direction is shorter than the length of the corresponding introduction space 34*x* in the left-right direction and is shorter than the length of the corresponding ascending space 34*z* in the left-right direction. Therefore, in terms of a flow-path cross-sectional area with respect to a refrigerant passage direction, which is the longitudinal direction of the liquid header 30, each nozzle 34*y* is smaller than the corresponding introduction space 34*x* and is smaller than the corresponding ascending space 34*z*.

Therefore, when the outdoor heat exchanger 611 functions as an evaporator of a refrigerant, the refrigerant that passes through each nozzle 34*y* has its flow velocity increased and flows into the corresponding ascending space 34*z*. Consequently, it is possible to sufficiently guide the refrigerant also to, among the plurality of flow-dividing openings 33*x* that communicate with a corresponding one of the ascending spaces 34*z*, the flow-dividing openings 33*x* that are positioned far away above a corresponding one of the nozzles 34*y*. Thus, biased flows of the refrigerant between the plurality of flat tubes 28 that communicate with the same ascending space 34*z* can be kept small.

Moreover, as described above, the structure that narrows a flow path for blowing a refrigerant in the longitudinal direction of the liquid header 30, which is the direction in which the flat tubes 28 are disposed side by side, can be realized by one fourth liquid-side member 34. Therefore, it no longer becomes necessary to provide, as a new member different from a member for forming an internal space, a plate-shaped member in which a nozzle is formed while the internal space is partitioned into one side and the other side in the longitudinal direction of the liquid header, as has been provided in liquid headers known in the art.

(7-10-5-3)

In the liquid header 30 of the outdoor heat exchanger 611 of the present Modification J, since the refrigerant that has flowed to each ascending space 34*z* from the corresponding nozzle 34*y* has its flow velocity increased while moving upward, it is possible to supply the refrigerant even to the flow-dividing openings 33*x* that communicate with the upper portion of a corresponding one of the ascending spaces 34*z*. Further, since the width of each ascending space 34*z* in the left-right direction is narrower than the width of the corresponding introduction space 34*x* in the left-right direction, and a refrigerant passage area of each ascending space 34*z* is small, even when a circulation amount of a refrigerant in the refrigerant circuit 6 is small, it is possible to suppress a reduction in the refrigerant flow velocity of the refrigerant on the upper side that flows in each ascending space 34*z* and to sufficiently supply the refrigerant even to the flow-dividing openings 33*x* on the upper side.

Each ascending space 34*z* communicates, near the upper end thereof, with the corresponding descending space 36*y* via the corresponding outward flow path 35*z*. Further, each descending space 36*y* communicates, near the lower end thereof, with the corresponding ascending space 34*z* via the corresponding return flow path 35*y*. Therefore, even if a circulation amount of the refrigerant in the refrigerant circuit 6 is large and a large amount of refrigerant is supplied to the vicinity of the upper end of each ascending space 34*z*, it is possible to return again the refrigerant to each ascending space 34*z* and guide the refrigerant to the flow-dividing openings 33*x* via the corresponding outward flow path 35*z*, the corresponding descending space 36*y*, and the corresponding return flow path 35*y*.

Consequently, even if the longitudinal direction of the liquid header 30 when the outdoor heat exchanger 611 is constructed is the vertical direction, it is possible to suppress biased flows of the refrigerant between the flat tubes 28 in the up-down direction.

(7-10-5-4)

In the liquid header 30 of the outdoor heat exchanger 611 of the present Modification J, the flat tubes 28 are connected on a side near a corresponding one of the ascending spaces 34*z* instead of on a side near a corresponding one of the descending spaces 36*y*. Therefore, when the outdoor heat exchanger 611 functions as an evaporator of a refrigerant, since a refrigerant that flows in each ascending space 34*z* easily flows to be drawn toward the plurality of flow-dividing openings 33*x*, a reverse flow of a refrigerant in each return flow path 35*y* (a flow toward each descending space 36*y* via the corresponding return flow path 35*y* from the corresponding ascending space 34*z*) can be suppressed.

(7-10-5-5)

In the liquid header 30 of the outdoor heat exchanger 611 of the present Modification J, the branch liquid-refrigerant connection pipes 49*a* to 49*e* and the respective introduction spaces 34*x* communicate with each other via the respective first connection openings 36*x* of the sixth liquid-side member 36 and respective second connection openings 35*x* of the fifth liquid-side member 35.

Therefore, by using the fifth liquid-side member 35, in which the outward flow paths 35*z* and the return flow paths 35*y* are formed, and the sixth liquid-side member 36, in which the descending spaces 36*y* are formed, the fifth liquid-side member 35 and the sixth liquid-side member 36 being provided for circulating a refrigerant in the liquid header 30, the branch liquid-refrigerant connection pipes 49*a* to 49*e* and the respective introduction spaces 34*x* can be made to communicate with each other.

(7-10-5-6)

In the liquid header 30 of the outdoor heat exchanger 611 of the present Modification J, the first liquid-side member 31, the third liquid-side member 33, the fourth liquid-side member 34, the fifth liquid-side member 35, the sixth liquid-side member 36, and the seventh liquid-side member 37 have a plate thickness of 3 mm or less. Therefore, the through openings in the plate-thickness direction of the members can be easily formed by a pressing operation.

(7-10-5-7)

A connection portion of the liquid header 30 of the present Modification J to the flat tubes 28 is a surface that extends in a direction perpendicular to the longitudinal direction of the flat tubes 28, and has a substantially rectangular shape in plan view. Therefore, it is possible to provide a shape in which difficulties caused by structures in which the flat tubes are inserted by a large amount as in circular cylindrical headers do not easily occur. In addition, since the insertion spaces 32*s*, in which the flat tubes 28 are inserted, and the ascending spaces 34*z* are separated by the plate-shaped base portion 32*a* of the second liquid-side member 32 and the third internal plate 33*a* of the third liquid-side member 33, useless space in which a refrigerant is retained is not easily formed. The magnitude a flow-path cross-sectional area of each ascending space 34*z* in which a refrigerant flows in the longitudinal direction of the liquid header 30 can be easily adjusted by only adjusting the plate thickness of a plate-shaped member or the size of an opening, and the flow velocity of the refrigerant can also be increased by reducing a passage cross-sectional area of the refrigerant.

(7-11) Modification K

In Modification J above, the liquid header 30 in which, with respect to each ascending space 34*z*, the corresponding outward flow path 35*z*, the corresponding descending space 36*y*, and the corresponding return flow path 35*y* are provided on a side opposite to where the flat tubes 28 are connected has been given as an example and described.

Figure 46:
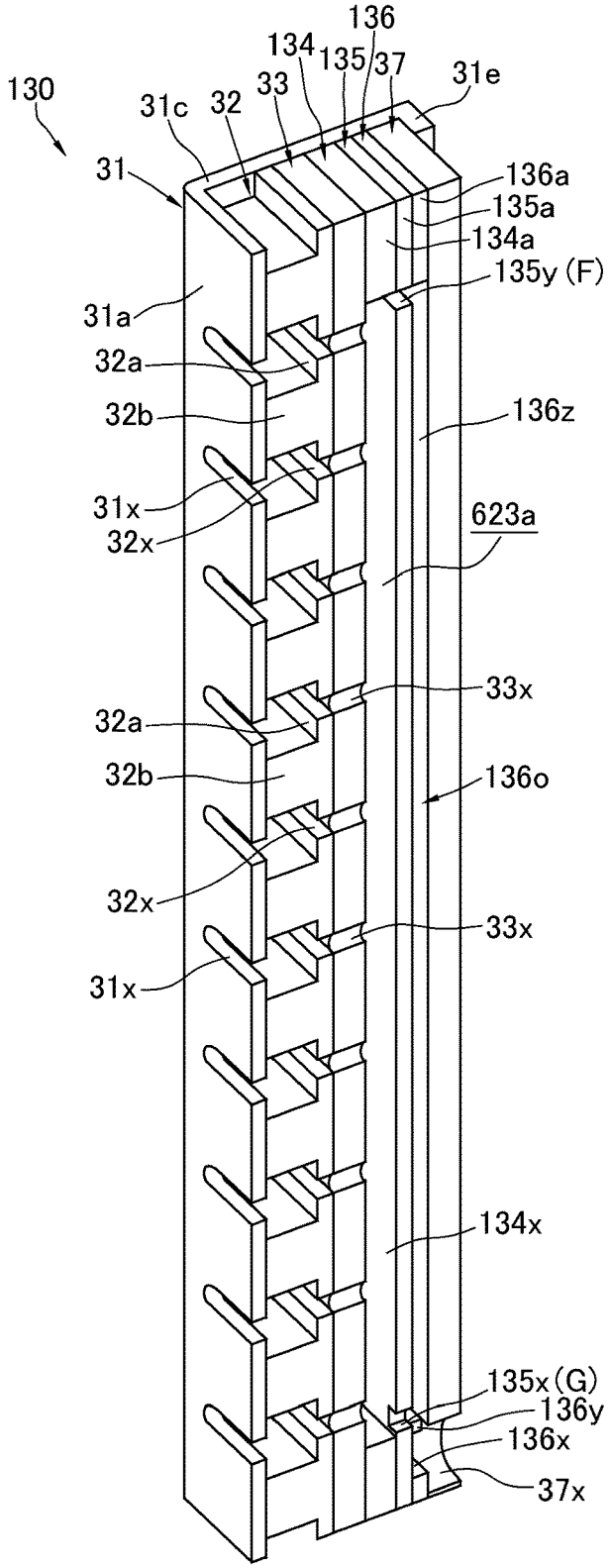
FIG. 46 is a sectional perspective view of a portion of a liquid header according to Modification K near an upper end thereof.

In contrast, as a liquid header, for example, as shown in FIG. 46, a liquid header 130 in which, with respect to each ascending space 136*z*, a corresponding outward flow path 135*y*, a corresponding descending space 134*x*, and a corresponding return flow path 135*x* are provided on a side where the flat tubes 28 are connected may be used.

Note that, in the liquid header 130 (an example of a header), the first liquid-side member 31, the second liquid-side member 32, the third liquid-side member 33, and the seventh liquid-side member 37 are the same as those of Modification J above, and are not described.

The liquid header 130 includes an eighth liquid-side member 134, a ninth liquid-side member 135, and a tenth liquid-side member 136, instead of the fourth liquid member 34, the fifth liquid-side member 35, and the sixth liquid-side member 36 of Modification J above.

The eighth liquid-side member 134 is disposed to contact the third liquid-side member 33, and includes an eighth internal plate 134*a* and each descending space 134*x*. The descending spaces 134*x* communicate with the plurality of flow-dividing openings 33*x*.

The ninth liquid-side member 135 (an example of a second member) is disposed to contact the eighth liquid-side member 134, and includes a ninth internal plate 135*a* (an example of a second plate-shaped portion), each return flow path 135*x* (an example of a second opening), and each outward flow path 135*y* (an example of a second opening). Here, each return flow path 135*x* forms an overlapping region G, and each outward flow path 135*y* forms an overlapping region F. Note that the shapes of and the relationships between the outward flow paths 135*y* and the return flow paths 135*x* are the same as the shapes of and the relationships between the outward flow paths 35*z* and the return flow paths 35*y* in the embodiments described above. The outward flow paths 135*y* cause the vicinities of upper ends of the ascending spaces 136*z* and the vicinities of upper ends of the descending spaces 134*x* to communicate with each other, and the return flow paths 135*x* cause the vicinities of lower ends of the ascending spaces 136*z* and the vicinities of lower ends of the descending spaces 134*x* to communicate with each other.

The tenth liquid-side member 136 (an example of a first member) is disposed to contact the ninth liquid-side member 135, and includes a tenth internal plate 136*a* (an example of a first plate-shaped portion) and first penetrating portions 136*o* (an example of first openings). Each first penetrating portion 136*o* includes, in order from the bottom, an introduction space 136*x* (an example of a third region), a nozzle 136*y* (an example of a connection region), and the ascending space 136*z*. Note that the shapes of and the relationships between the introduction spaces 136*x*, the nozzles 136*y*, and the ascending spaces 136*z* are the same as the shapes of and the relationships between the introduction spaces 34*x*, the nozzles 34*y*, and the ascending spaces 34*z* in the embodiments described above. Here, each introduction space 34*x* communicates with a corresponding one of the external liquid-pipe connection openings 37*x* of the seventh liquid-side member 37.

In the structure above, when the outdoor heat exchanger 11 functions as an evaporator of a refrigerant, a refrigerant that has flowed into the liquid header 130 via the branch liquid-refrigerant connection pipes 49*a* to 49*e* flows into the introduction spaces 136*x*. The refrigerant that has been sent to each introduction space 136*x* has its flow velocity increased at the corresponding nozzle 136*y* and moves upward in the corresponding ascending space 136*z*. The refrigerant that has reached the vicinity of the upper end of each ascending space 136*z* reaches the corresponding descending space 134*x* via the corresponding outward flow path 135*y*. The refrigerant that has reached each descending space 134*x* is branched by the plurality of flow-dividing openings 33*x* and flows while moving downward. The refrigerant that has reached the vicinity of the lower end of each descending space 134*x* without flowing in the flow-dividing openings 33*x* is guided again to the corresponding ascending space 136*z* via the corresponding return flow path 135*x* and circulates.

Even in the liquid header 130 above, as in Modification J above, a refrigerant can be made to flow in the direction in which the plurality of flat tubes 28 are disposed side by side.

(7-12) Modification L

In the embodiments and each modification above, an example in which only one heat transfer tube group that is constituted by a plurality of heat transfer tubes disposed side by side in a direction intersecting the air flow direction is provided in the air flow direction has been described.

In contrast, with the heat transfer tubes of the heat exchanger not being limited thereto, for example, a plurality of heat transfer tube groups, each being constituted by a plurality of heat transfer tubes disposed side by side in a direction intersecting the air flow direction, may be disposed side by side in the air flow direction. In this case, it is desirable that each refrigerant flow path in the liquid header be disposed side by side in the air flow direction.

(8)

Note that it is desirable that the second opening of the second plate-shaped portion and the first opening of the first plate-shaped portion communicate with each other via the second region while communicating with each other via the first region.

"Stack" is not limited to when the plate-shaped portions are disposed to directly contact each other, and may refer to when a different plate-shaped portion is interposed between the plate-shaped portions. Note that when the plate-shaped portions are disposed to directly contact each other, a flow path can be formed with a small number of plates. Further, in joining the plate-shaped portions to each other by brazing, when the plate-shaped portions are disposed to directly contact each other, the heat input amount for the brazing can be kept small.

The second plate-shaped portion may have one second opening including both the first region and the second region, or may separately have (at different positions when viewed in the stacking direction) a second opening including the first region and a second opening including the second region.

Note that the first opening of the first plate-shaped portion may have, for example, a longitudinal direction, and the longitudinal direction of the first opening may be the same as a longitudinal direction of the first plate-shaped portion.

It is desirable that the refrigerant pipe that is connected to the heat exchanger be a liquid-refrigerant pipe. The dryness of a refrigerant that flows in the liquid-refrigerant pipe is lower than the dryness of a refrigerant that flows in an end portion of a flow path on a side opposite to the liquid-refrigerant pipe in the heat exchanger.

Note that it is desirable that the plate thickness of each of the first plate-shaped portion and the second plate-shaped portion be 3 mm or less.

Note that it is desirable that the third openings and the heat transfer tubes be in a one-to-one correspondence.

Note that it is desirable that the third plate-shaped portion and the second plate-shaped portion have, respectively, three or more third openings and three or more fourth openings that overlap the first opening when viewed in the stacking direction.

Note that it is desirable that the second opening cause the first region and the second region to communicate with each other in a range of the plate thickness of the second plate-shaped portion.

Note that it is desirable that the third openings and the heat transfer tubes be in a one-to-one correspondence.

Note that the entire second plate-shaped portion need not be positioned above an upper end portion of the first plate-shaped portion. It is desirable that the second plate-shaped portion be stacked upon an upper surface of the first plate-shaped portion.

It is desirable that the second opening portion extend in the direction that intersects the direction in which the plurality of twelfth openings are disposed side by side from portions of the first opening portion other than both ends thereof in a direction of extension of the first opening portion.

Note that it is desirable that the header be constituted so that a refrigerant that has flowed to the second opening portion in the first opening of the first plate-shaped portion from the eleventh opening of the second plate-shaped portion flows to the first opening portion from the second opening portion in the first opening of the first plate-shaped portion and flows to the plurality of twelfth openings of the second plate-shaped portion from the first opening portion in the first opening of the first plate-shaped portion.

(9)

Although the disclosure has been described with respect to only a limited number of embodiments, those skilled in the art, having benefit of this disclosure, will appreciate that various other embodiments may be devised without departing from the scope of the disclosure invention. Accordingly, the scope of the disclosure should be limited only by the attached claims.

REFERENCE SIGNS LIST

1 air conditioner (heat pump device)
11 outdoor heat exchanger (heat exchanger)
18 outdoor fan (fan)
20 liquid-refrigerant pipe (refrigerant pipe)
26 heat transfer portion
28 flat tube (heat transfer tube)
30 liquid header (header)
31 first liquid-side member
31*a* liquid-side flat-tube connection plate
32 second liquid-side member
32*s* insertion space
33 third liquid-side member (third member)
33*a* third internal plate (third plate-shaped portion)
33*x* flow-dividing opening (third opening)
34 fourth liquid-side member (fourth member)
34*a* fourth internal plate (fourth plate-shaped portion)
34*o* first penetrating portion
34*x* introduction space
34*y* nozzle
34*z* ascending space (tenth opening)
35 fifth liquid-side member (second member)
35*a* fifth internal plate (second plate-shaped portion)
35*x* second connection opening
35*y* return flow path (second opening, eighth opening)
35*z* outward flow path (second opening, ninth opening)
36 sixth liquid-side member (first member)
36*a* sixth internal plate (first plate-shaped portion)
36*x* first connection opening
36*y* descending space (first opening)
37 seventh liquid-side member
37*a* liquid-side external plate
37*x* external liquid-pipe connection opening
40 liquid header (header)
41 first liquid-side member
42 second liquid-side member
43 third liquid-side member (third member)
43*a* third internal plate (third plate-shaped portion, plate-shaped portion)
43*x* third flow-dividing opening (third opening)
44 fourth liquid-side member (second member)
44*a* fourth internal plate (second plate-shaped portion, plate-shaped portion)
44*g* fourth liquid-side opening (second opening, eleventh opening)
44*g*1 portion extending in left-right direction (third opening portion)
44*g*2 portion extending toward front
44*o* fourth liquid-side opening (second opening)
44*x* left connection space
44*y* intermediate connection space
44*z* right connection space
44*w* fourth flow-dividing opening (second opening, fourth opening, twelfth opening)
45 fifth liquid-side member (first member)
45*a* fifth internal plate (first plate-shaped portion)
45*g* left fifth liquid-side opening (first opening, thirteenth opening)
45*g*1 portion extending in left-right direction (first opening portion)
45*g*2 portion extending toward back (second opening portion)
45*k* right fifth liquid-side opening (first opening, fourteenth opening)
45*k*1 portion extending in left-right direction (first opening portion)
45*k*2 portion extending toward back (second opening portion)
45*o* fifth liquid-side opening (first opening)
45*p* connection opening (fifteenth opening)

45*x* introduction space (third region)
45*y* nozzle (connection region)
45*z* blowing space (first opening, second opening)
46 sixth liquid-side member (third member)
46*a* liquid-side external plate (third plate-shaped portion)
46*x* external liquid-pipe connection opening
47 seventh liquid-side member (first member)
47*a* seventh internal plate (first plate-shaped portion)
47*x* connection opening
47*y* left connection space (first opening)
47*z* right connection space (first opening)
134 eighth liquid-side member
134*a* eighth internal plate
134*x* descending space
135 ninth liquid-side member (second member)
135*a* ninth internal plate (second plate-shaped portion)
135*x* return flow path (second opening)
135*y* outward flow path (second opening)
136 tenth liquid-side member (first member)
136*a* tenth internal plate (first plate-shaped portion)
136*o* first penetrating portion (first opening)
136*x* introduction space (third region)
136*y* nozzle (connection region)
144*o* fourth liquid-side opening (second opening)
145*o* fifth liquid-side opening (first opening)
244*o* fourth liquid-side opening (second opening)
245*o* fifth liquid-side opening (first opening)
344*x* left connection space (second opening, seventh opening)
344*z* right connection space (second opening, sixth opening)
345*z* intermediate connection space (fifth opening)
445*z* intermediate connection space (second opening)
543 third liquid-side member
543*a* third internal plate
544 fourth liquid-side member (second member)
544*a* fourth internal plate (second plate-shaped portion)
545 fifth liquid-side member (first member)
545*a* fifth internal plate (first plate-shaped portion)
611 outdoor heat exchanger (heat exchanger)
A overlapping region (second region)
A1 overlapping region (second region)
B overlapping region (first region)
B1 overlapping region (first region)
C overlapping region
D overlapping region (first region)
D1 overlapping region (second region)
D2 overlapping region (second region)
E overlapping region (first region)
E1 overlapping region (second region)
E2 overlapping region (second region)
F overlapping region (second region)
G overlapping region (first region)

The invention claimed is:

1. A heat exchanger connected to a refrigerant pipe, the heat exchanger comprising:
heat transfer tubes; and
a header that connects the refrigerant pipe and the heat transfer tubes, and that forms a refrigerant flow path between the refrigerant pipe and the heat transfer tubes,
wherein the header includes
a first member that includes a first plate-shaped portion, and
a second member that includes a second plate-shaped portion that is stacked adjacent to the first member on a heat transfer tubes side of the first plate-shaped portion,
wherein the first plate-shaped portion has a first opening that forms the refrigerant flow path,
wherein the second plate-shaped portion has second openings that form the refrigerant flow path,
wherein, when viewed in a stacking direction of the first plate-shaped portion and the second plate-shaped portion, the second openings and the first opening overlap each other at a first region and at a second region that is different from the first region, and
wherein the first plate-shaped portion and the second plate-shaped portion are configured such that:
a refrigerant flows to the first plate-shaped portion from the second plate-shaped portion at the first region, the refrigerant flows to the second region from the first region at the first opening, and the refrigerant flows to the second plate-shaped portion from the first plate-shaped portion at the second region; or
the refrigerant flows to the first plate-shaped portion from the second plate-shaped portion at the second region, the refrigerant flows to the first region from the second region at the first opening, and the refrigerant flows to the second plate-shaped portion from the first plate-shaped portion at the first region.

2. The heat exchanger according to claim 1, wherein the header further includes a third member and a fourth member, the third member including a third plate-shaped portion that is stacked upon the second plate-shaped portion on a side opposite to the first plate-shaped portion side of the second plate-shaped portion in the stacking direction, and the fourth member including a fourth plate-shaped portion that is stacked between and adjacent to each of the second plate-shaped portion and the third plate-shaped portion,
wherein the second openings of the second plate-shaped portion include an eighth opening and a ninth opening,
wherein the ninth opening forms the second region while the eighth opening forms the first region, or the ninth opening forms the first region while the eighth opening forms the second region,
wherein the third plate-shaped portion has third openings that correspond to the heat transfer tubes, and
wherein the fourth plate-shaped portion has a tenth opening that connects the eighth opening and the ninth opening of the second plate-shaped portion and the third openings of the third plate-shaped portion.

3. A heat pump device comprising:
the heat exchanger according to claim 1.

4. A heat exchanger connected to a refrigerant pipe, the heat exchanger comprising:
heat transfer tubes; and
a header that connects the refrigerant pipe and the heat transfer tubes, and that forms a refrigerant flow path between the refrigerant pipe and the heat transfer tubes,
wherein the header includes
a first member that includes a first plate-shaped portion,
a second member that includes a second plate-shaped portion that is stacked on a heat transfer tubes side of the first plate-shaped portion, and
a fourth member that includes a fourth plate-shaped portion that is stacked on a heat transfer tubes side of the second plate-shaped portion,
wherein the first plate-shaped portion has a first opening that forms the refrigerant flow path,
wherein the second plate-shaped portion has an eighth opening and a ninth opening that form the refrigerant flow path,
wherein the fourth plate-shaped portion has a tenth opening that forms the refrigerant flow path, wherein, when viewed in a stacking direction of the first plate-shaped portion and the second plate-shaped portion, the ninth opening connects an upper longitudinal end portion of the first opening and an upper longitudinal end portion of the tenth opening at a first region, the eighth opening connects a lower longitudinal end portion of the first opening and a lower longitudinal end portion of the tenth opening at a second region that is different from the first region, and a portion of the tenth opening between the lower longitudinal end portion and the upper longitudinal end portion of the tenth opening overlaps the second plate-shaped portion between the eighth opening and the ninth opening, and wherein the first plate-shaped portion and the second plate-shaped portion are configured such that:

a refrigerant flows to the first plate-shaped portion from the fourth plate-shaped portion via the ninth opening at the first region, the refrigerant flows to the second region from the first region at the first opening, and the refrigerant flows to the fourth plate-shaped portion from the first plate-shaped portion via the eighth opening at the second region; or the refrigerant flows to the first plate-shaped portion from the fourth plate-shaped portion via the eighth opening at the second region, the refrigerant flows to the first region from the second region at the first opening, and the refrigerant flows to the fourth plate-shaped portion from the first plate-shaped portion via the ninth opening at the first region.

5. A heat exchanger connected to a refrigerant pipe, the heat exchanger comprising:

heat transfer tubes; and a header that connects the refrigerant pipe and the heat transfer tubes, and that forms a refrigerant flow path between the refrigerant pipe and the heat transfer tubes, wherein the header includes a first member that includes a first plate-shaped portion, a second member that includes a second plate-shaped portion that is stacked on a heat transfer tubes side of the first plate-shaped portion, a fourth member that includes a fourth plate-shaped portion that is stacked on a heat transfer tubes side of the second plate-shaped portion, and a third member that includes a third plate-shaped portion that is stacked on a heat transfer tubes side of the fourth plate-shaped portion, wherein the first plate-shaped portion has a first opening that forms the refrigerant flow path, wherein the second plate-shaped portion has an eighth opening and a ninth opening that form the refrigerant flow path, wherein the fourth plate-shaped portion has a tenth opening that forms the refrigerant flow path, wherein the third plate-shaped portion has third openings that form the refrigerant flow path, wherein, when viewed in a stacking direction of the first plate-shaped portion and the second plate-shaped portion, the eighth opening and the tenth opening overlap each other at a first region and the ninth opening and the tenth opening overlap each other at a second region that is different from the first region, wherein, when viewed in the stacking direction of the first plate-shaped portion and the second plate-shaped portion, the tenth opening and the third openings overlap each other, and wherein the first plate-shaped portion and the second plate-shaped portion are configured such that:

a refrigerant flows to the first plate-shaped portion from the second plate-shaped portion at the first region, the refrigerant flows to the second region from the first region at the first opening, and the refrigerant flows to the second plate-shaped portion from the first plate-shaped portion at the second region; or the refrigerant flows to the first plate-shaped portion from the second plate-shaped portion at the second region, the refrigerant flows to the first region from the second region at the first opening, and the refrigerant flows to the second plate- shaped portion from the first plate-shaped portion at the first region.

* * * * *